US006115017A

United States Patent [19]

Mikami et al.

[11] Patent Number: 6,115,017

[45] Date of Patent: Sep. 5, 2000

[54] LIQUID CRYSTAL DISPLAY APPARATUS

[75] Inventors: Yoshiro Mikami, Hitachi; Tetsuro Minemura, Hitachioota; Makoto Tsumura, Hitachi; Kazuhiro Kuwabara, Hitachi; Shinichi Komura, Hitachi; Tatsuya Ohkubo, Hitachinaka; Hideo Sato, Hitachi; Shoichi Hirota, Hitachi; Masaya Adachi, Hitachi; Kazuhito Masuda, Hitachi, all of Japan

[73] Assignee: Hitachi, Ltd., Tokyo, Japan

[21] Appl. No.: 08/820,835

[22] Filed: Mar. 19, 1997

[30] Foreign Application Priority Data

| | | | |
|---|---|---|---|
| Mar. 19, 1996 | [JP] | Japan | 8-062996 |
| Apr. 4, 1996 | [JP] | Japan | 8-082340 |
| Jun. 11, 1996 | [JP] | Japan | 8-148986 |
| Jun. 18, 1996 | [JP] | Japan | 8-156790 |

[51] Int. Cl.[7] ..... G09G 3/36

[52] U.S. Cl. ..... 345/92; 345/98; 349/48

[58] Field of Search ..... 345/90, 98, 89, 345/147, 99, 100, 92; 349/48, 38, 144; 359/59; 340/784

[56] References Cited

U.S. PATENT DOCUMENTS

| | | | |
|---|---|---|---|
| 5,091,722 | 2/1992 | Kitajima et al. | 340/784 |
| 5,194,974 | 3/1993 | Hamada et al. | 359/59 |
| 5,296,870 | 3/1994 | Nicholas | 345/89 |
| 5,566,010 | 10/1996 | Ishii et al. | 359/59 |
| 5,623,279 | 4/1997 | Itakura et al. | 345/98 |
| 5,627,557 | 5/1997 | Yamaguchi et al. | 345/90 |
| 5,724,107 | 3/1998 | Nishikawa et al. | 349/38 |
| 5,790,213 | 8/1998 | Sasaki et al. | 349/48 |

FOREIGN PATENT DOCUMENTS

| | | |
|---|---|---|
| 0 414 478 A1 | 2/1991 | European Pat. Off. . |
| 0 586 155 A2 | 3/1994 | European Pat. Off. . |
| 7-261155 | 10/1995 | Japan . |

*Primary Examiner*—Vijay Shankar
*Assistant Examiner*—Jeff Piziali
*Attorney, Agent, or Firm*—Antonelli, Terry, Stout & Kraus, LLP

[57] ABSTRACT

An improved liquid crystal display apparatus for low power consumption is provided, within each of the regions surrounded by a plurality of scanning electrodes and a plurality of signal electrodes, with a display data holding circuit connected to the corresponding scanning electrodes and signal electrodes, for fetching and storing a display data from the signal electrode in response to a scanning signal; a switching device connected to the display data holding circuit, its switching operation being controlled by the holding circuit; and a display electrode connected to the switching device.

24 Claims, 36 Drawing Sheets n - CHANNEL TFT p - CHANNEL TFT

LIQUID CRYSTAL DISPLAY APPARATUS

BACKGROUND OF THE INVENTION

The present invention relates to a liquid crystal display apparatus, particularly to a TFT active matrix type liquid crystal display apparatus capable of low power consumption.

A conventional driving system of a TFT active matrix type liquid crystal display apparatus will be explained hereinafter. A known active matrix type panel technique is described in detail in Shunsuke Kobayashi "A Color Liquid Crystal Display" Sangyo Tosho Co. Ltd.

The TFT active matrix type liquid crystal display apparatus is driven by using a line-at-a-time scanning method, in which one scanning pulse is applied every one frame period of time. One frame period is generally set to about 1/60 second. These pulses applied from the top panel to the bottom panel each has a certain delay of time in the order from top to bottom.

Because one pixel is formed of 3 dots in a color panel having 640×480 dots, the total number of dots is 1920×480. Further, because 480 gate wires are scanned in one frame, the time width of the scanning pulse is about 37 $\mu$s.

Liquid crystal driving voltages, to be applied to the liquid crystal to which the scanning pulse is applied, are applied to signal electrodes in synchronization with the scanning pulse. In the selected pixel to which the gate pulse is applied, the voltage of a gate electrode of the TFT connected to the scanning electrode increases, and thus the TFT turns to the "ON" state. At this time, the liquid crystal driving voltage is applied to a display electrode via a source and a drain of the TFT, and thereby the pixel capacity is charged, being comprised of the liquid crystal capacity formed between the display electrode and an opposed electrode formed on an counter substrate and a load capacity provided to a pixel. By repeating this operation, the liquid crystal applying voltage is applied repeatedly to the pixel capacity of the whole surface of the panel every frame time.

Further, because an alternating voltage is required to drive the liquid crystal, a voltage whose polarity is inverted every frame time is applied to the signal electrode. Therefore, the liquid crystal driving frequency is 30 Hz, a half of the normal frame frequency of 60 Hz. As a result, flicker appears and it becomes difficult to watch the display. In the conventional liquid crystal display apparatus, the effect of such flicker is decreased by inverting alternately the polarity of the liquid crystal driving voltage at every adjacent pixel. Most of the electric power for driving the liquid crystal panel is consumed in the repeated charging and discharging of the capacity at intersecting portions of the scanning wires and the signal wires and the capacity of the liquid crystal between the wires and the opposed electrodes formed on the whole surface of the counter substrate every time the gates are selected.

In the current panel configuration and the liquid crystal driving system, the electric power consumed to repeatedly charge and discharge the capacity at intersecting portions of the scanning wires and the signal wires and the capacity of the liquid crystal between the wires and the opposed electrodes formed on the whole surface of the counter substrate every time of the selection of the gates, occupies a major percentage of the total power consumption. While it is possible to reduce the power consumption by narrowing the width of the wires or lowering the liquid crystal driving frequency, to narrow the width of the wires leads to an increase in the high impedance resulting in signal delay and distortion, and to lower the liquid crystal driving frequency leads to a drop in the response speed of the display and the occurrence of flicker.

SUMMARY OF THE INVENTION

An object of the present invention is to provide an improved liquid crystal display apparatus capable of low power consumption.

Another object of the present invention is to provide an improved and compact liquid crystal display apparatus having no image memory.

A further object of the present invention is to provide an improved liquid crystal display apparatus which can produce a display with multi-gray levels.

Preferably, the present invention has the following configuration for implementation.

(1) A liquid crystal display apparatus has a pair of substrates of which at least one substrate is transparent and a liquid crystal layer sandwiched between the substrates. The display apparatus further includes a plurality of scanning electrodes formed on one of the substrates; and a plurality of signal electrodes intersecting like a matrix with the plurality of scanning electrodes; wherein the display apparatus further includes, within each of the regions surrounded by said plurality of scanning electrodes and said plurality of signal electrodes: a display data holding circuit connected to a corresponding scanning electrode and a signal electrode, for fetching and storing display data from the signal electrode in response to a scanning signal; a switching device connected to said display data holding circuit, its switching operation being controlled by the holding circuit; and a display electrode connected to said switching device.

(2) A liquid crystal display apparatus having a pair of substrates of which at least one substrate is transparent and a liquid crystal layer sandwiched between the substrates. The display apparatus further includes a plurality of first scanning electrodes formed on one of the substrates; a plurality of signal electrodes intersecting like a matrix with said plurality of first scanning electrodes; and a plurality of second scanning electrodes provided along said first scanning electrodes or said signal electrodes; wherein the display apparatus further, includes within each of the regions surrounded by said plurality of first scanning electrodes and said plurality of signal electrodes: a data holding circuit connected to a corresponding first scanning electrode, signal electrode, and second scanning electrode for fetching and storing display data from the signal electrode in response to voltages applied to the first and the second scanning electrodes; a capacitor connected to said data holding circuit; a switching device connected to said capacitor, its switching operation being controlled by a voltage of the capacitor; and a display electrode connected to said switching device.

(3) A liquid crystal display apparatus having a pair of substrates of which at least one substrate is transparent and a liquid crystal layer sandwiched between the substrates. The display apparatus further includes a plurality of scanning electrodes formed on one of the substrates; and a plurality of signal electrodes intersecting like a matrix with each of said plurality of scanning electrodes; wherein the display apparatus further includes, within each of the regions forming pixels surrounded by said plurality of scanning electrodes and said plurality of signal electrodes: a sampling data holding circuit connected to a corresponding signal electrode, for sampling and storing signal data from the signal electrode in response to a scanning signal; a gray level selecting circuit connected to said sampling data holding circuit, for selecting the gray levels for the pixel in response to a state of the sampling of said sampling data holding circuit; and a display electrode connected to said gray level selecting circuit.

BRIEF DESCRIPTION OF THE DRAWINGS

These and other objects, features and advantages of the present invention will be understood more clearly from the following detailed description with reference to the accompanying drawings, wherein.

DESCRIPTION OF THE PREFERRED EMBODIMENTS

Figure 1:
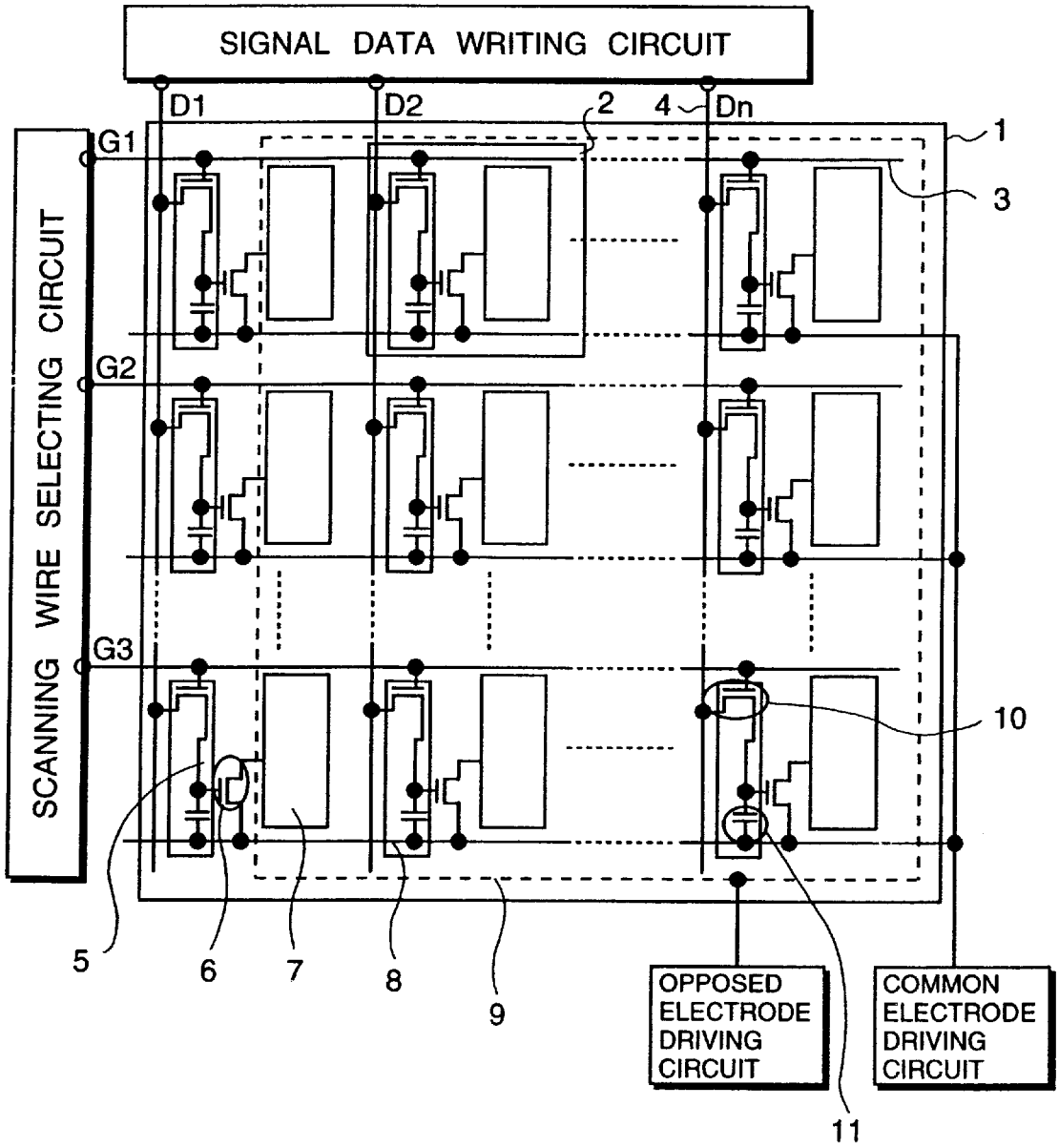
FIG. 1 is a schematic diagram of the liquid crystal display apparatus according to a first embodiment of the present invention.

FIG. 1 is a schematic diagram of the liquid crystal display apparatus according to a first embodiment of the present invention. Pixel portions 2, each formed from an m high by n wide matrix of dots, are arranged on a display portion 1 formed on a TFT substrate. Each pixel portion comprises a display data holding circuit 5, pixel driving TFT 6 and a transparent electrode 7 for display. The display data holding circuit 5 has a sampling TFT 10 provided in the intersection of a scanning electrode 3 and a signal electrode 4. Each scanning electrode is connected to a scanning line selecting circuit, and each signal electrode is connected to a signal data write-in circuit.

Common electrodes 8 driven by a common electrode driving circuit are arranged in parallel with the scanning electrodes in every row. All of the pixel portions are connected in common to the common electrodes. An opposed electrode 9 formed on a counter substrate faces through a liquid crystal to the transparent electrode provided on the TFT substrate. The opposed electrode 9 is driven by a opposed electrode driving circuit.

The liquid crystal display apparatus has a polarizer and a back light (not shown) in addition to the above configuration.

Figure 2:
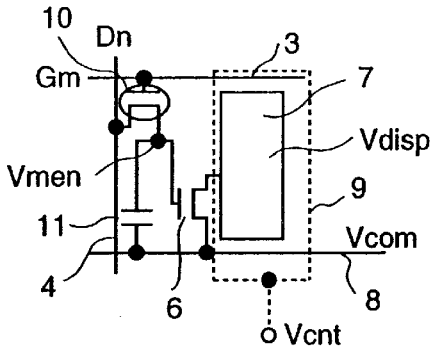
FIG. 2 is a schematic circuit diagram showing the configuration of the pixel portion shown in FIG. 1.
Figure 3:
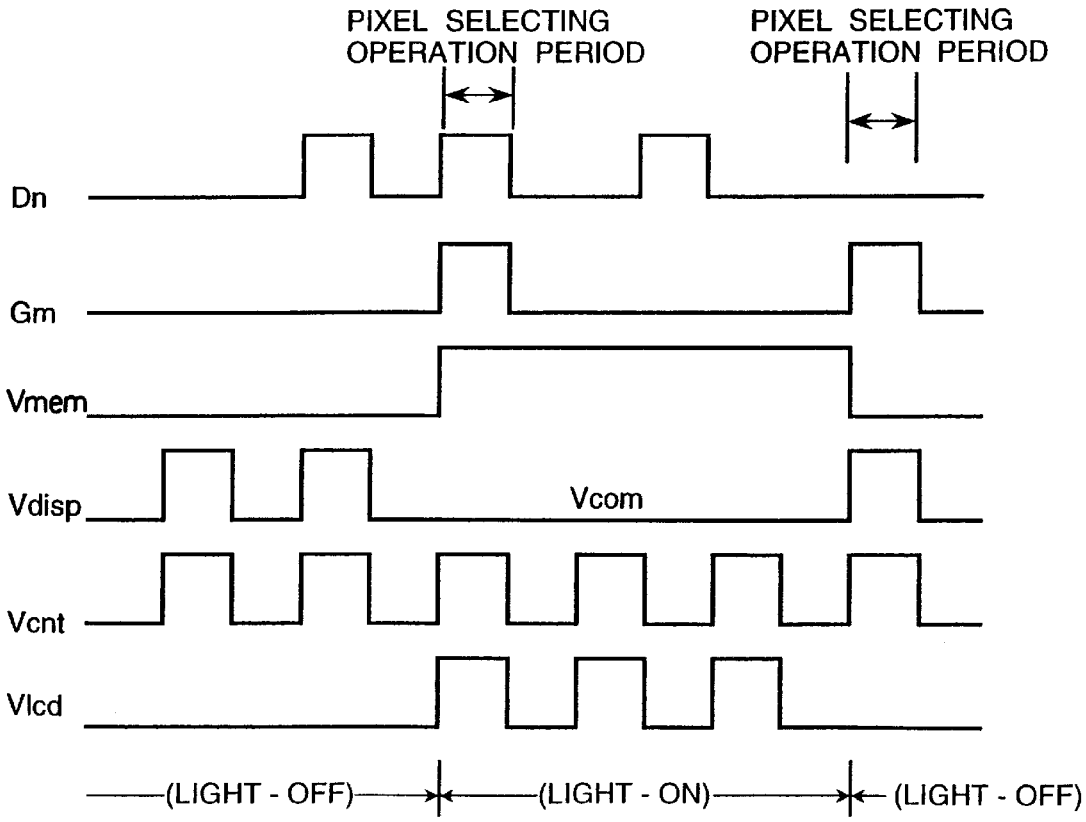
FIG. 3 is a wave form chart of driving signals applied to the pixel portion shown in FIG. 2.

FIG. 2 is a view showing the configuration of the pixel portion shown in FIG. 1. FIG. 3 is a wave form chart of driving signals applied to the pixel portion shown in FIG. 2.

The principle of operation of the liquid crystal display apparatus will be explained mainly with reference to FIG. 3. When a voltage more than the threshold voltage of the sampling TFT is applied to the scanning wire selected by the scanning wire selecting circuit, a scanning wire Gm is selected. Thereby, a row of pixels connected to the same scanning wire are selected at the same time and turn to a state in which the pixels are selected. As a result, the sampling TFT 10 turns to an ON state. At this time, a signal data voltage indicative of the display data of a row of pixels is applied to all of the signal wires at the same time.

A signal data voltage on a certain signal wire Dn charges a sampling capacitor 11 through the sampling TFT 10. As a result, a sampling voltage Vmem or a terminal voltage of the capacitor changes. Because one terminal of the capacitor is connected to a gate terminal of the pixel driving TFT 6 which acts as a switch, the sampling voltage controls an ON or Off state of the pixel driving TFT. When the sampling voltage is more than the threshold voltage of the TFT, the TFT turns to the ON state. A current flows therefore between its source and drain, and thus the transparent electrode is electrically connected to the common electrodes. The liquid crystal driving voltage Vcnt applied from the opposed electrode driving circuit to the opposed electrode 9 is applied between the common electrodes. As a result, the liquid crystal turns to a ON state or display state.

On the other hand, when the sampling voltage is less than the threshold voltage of the TFT, the TFT turns to an OFF state. A current stops flowing between its source and drain. As a result, the display turns to the OFF state. In this embodiment, the signal voltage from the signal electrode is applied to the display electrode, and to the sampling capacitor as a control voltage of the display state. Further, until the scanning electrode is selected next time after the signal is once written to the sampling capacitor, the sampling voltage gradually drops due to a leakage current of the sampling capacitor. Because the quality of display does not change until the sampling voltage becomes less than the threshold voltage, the time constant of the display data holding becomes sufficiently longer than the frame time. It is, therefore, possible to suitably retain the sampling voltage. As a result, the state of the display of the pixel can be held during a sufficient time longer than the frame time.

In the prior art, the liquid crystal is directly driven by using the voltage applied from a signal wire. Therefore, the variation in the voltage of a liquid crystal or a TFT is a factor in the deterioration of the quality of the display. For example, when the leakage current of the data holding TFT is 0.1 pA, the threshold voltage is 1 V, the capacity of the data holding capacitor is 1 pF, and the display data signal voltage is 10 V, the time required to discharge to 1 V or the threshold value of the data holding TFT is 90 sec. This discharge time is 5400 times longer than that in the prior art in which the scants carried out every sixty seconds. Further, the polarity of the liquid crystal driving voltage must be inverted every frame. Therefore, even when the display is in the same state, the liquid crystal driving voltage whose polarity is inverted at every frame must be applied to all the pixels.

According to the present embodiment, because the scanning electrode and the signal electrode is driven only when the display is rewritten, and the display can be held by applying the liquid crystal driving voltage only between the common electrodes and the opposed electrode when the display is in the same state, the power consumption of a panel can be reduced. Since the display can be rewritten in a unit of a scanning electrode, only the signal electrode in a position where the display is rewritten is driven. Because this voltage is gradually changed due to the leakage of insulation of the pixel driving TFT and the sampling capacity and the leakage of an off-current of the sampling TFT, it is preferable to change the sampling voltage, for example, it can change periodically without generating a flicker in the display.

Figure 4:
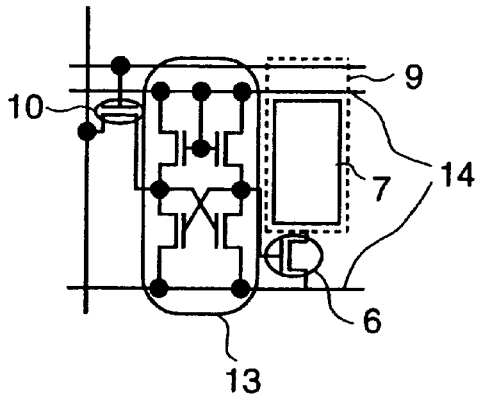
FIG. 4 is a schematic circuit diagram showing the configuration of the pixel portion with a memory circuit used in the present invention.

It is possible to obtain an effect similar to the above-mentioned embodiment by using a memory circuit in which a plurality of TFTs are used as the display data holding circuit, as shown in FIG. 4. According to this example, the output of the sampling TFT 10 is supplied to a gate terminal of the pixel driving TFT 6 through the memory circuit 13 provided instead of the sampling capacitor. Because the sampling voltage can be held or stored as a state of the circuit while the power source wiring 14 is necessary to drive the memory circuit, the state written in can be maintained until the electric power is shut off or new information is written in. Accordingly, the display of a pixel can be maintained for a long time.

It should be appreciated that a flip-flop circuit and a static memory cell circuit using CMOS devices may be used, in addition to the circuit configuration shown in FIG. 4.

It is possible to form a two-layer-wiring in the pixel with a display data holding circuit. Therefore, if it is possible to employ a multi-layer wiring technique to do the inter-layer connecting and form a capacitor and a TFT, the above-mentioned pixel can apply to any structures, such as the existing p-Si coplanar structure, inverse-Stagger structure and Stagger structure.

Figure 5:
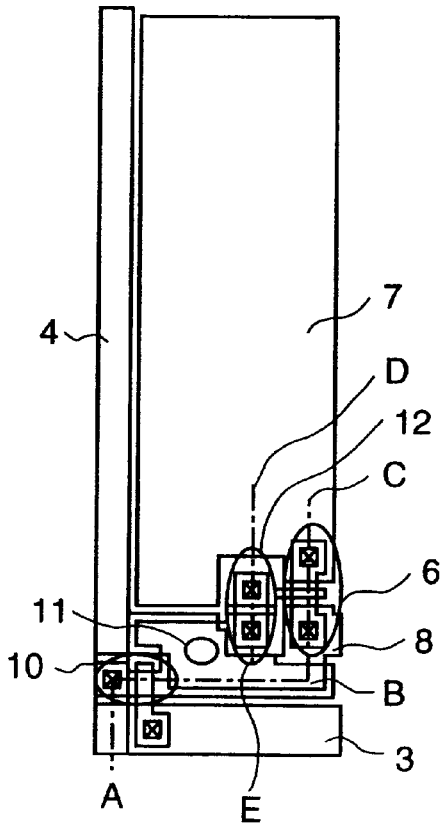
FIG. 5 is a diagram showing the configuration of a mask for the pixel portion with the coplanar structure.
Figure 6:
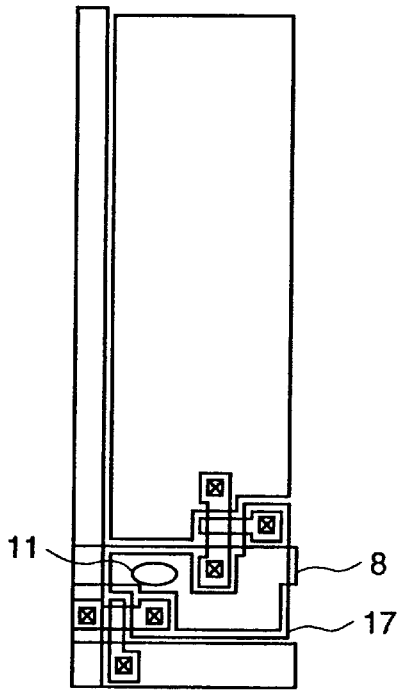
FIG. 6 is a diagram showing of the configuration of another mask for the pixel portion with the coplanar structure.
Figure 7:
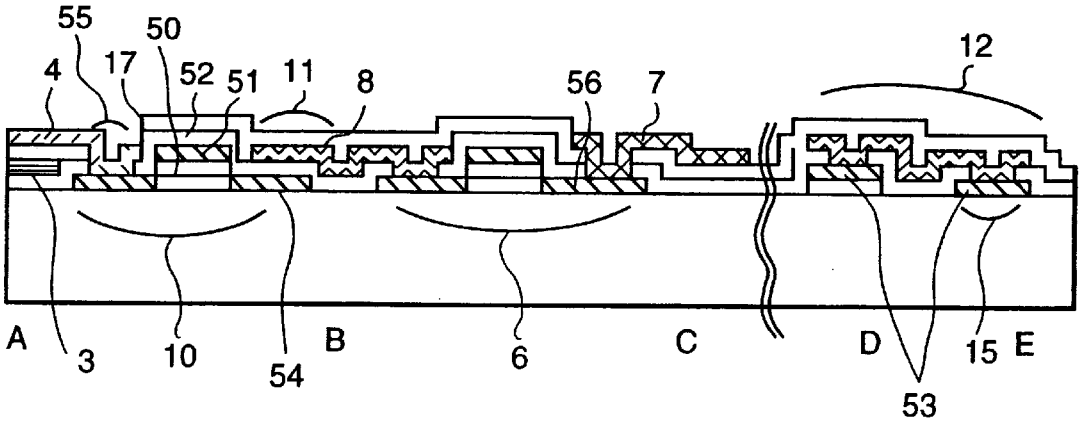
FIG. 7 is a sectional view of the coplanar structure shown in FIG. 5.

The mask patterns and the cross-sectional structure of the pixel shown in FIG. 2 are shown in FIGS. 5 to 11. FIGS. 5 to 7 show examples of application to a TFT with a coplanar structure. FIGS. 5 and 6 show the configuration of a mask for the pixel portion with a coplanar structure. FIG. 7 shows sections of the coplanar structure taken along an A–B line and a C–D line in FIG. 5. The process for forming the TFT substrate will be briefly explained.

Firstly, a silicon film is formed by using a LPCVD method and is poly-crystalized by performing a thermal annealing approximately at 500 to 600° C. and for 20 to 100 hours. After that, an island Si pattern of the TFT portions 10 and 11 is formed by the patterning. The resultant layers are used also lower electrodes 54 of the sampling capacitor 11. Next, the insulating film 16 or $SiO_2$ film is formed by using an APCVD method, and then a gate Si layer of the TFT portion is formed by using the LPCVD method. After then, a gate portion 51 of the TFT portions 10 and 11 is formed by dry-etching two $SiO_2$ films.

A dopant, such as phosphorous ions, is implanted in a source, a drain and the gate Si layer of the island Si pattern by using an ion implantation method The source, the drain and the gate Si layer is activated by heat treatment and changed to an n type Si with low resistance. After that, a protecting film 52 for the TFT or $SiO_2$ film is formed, a first contact hole 53 is formed, and the scanning electrode 3 and a connection 12 are formed by using a metal film, such as Cr. After the island pattern is formed in the connection 56 to the display electrode, the transparent electrode 7 is formed by ITO. It is, therefore, possible to decrease the connection resistance to the ITO. After that, an inter-layer insulating layer 17 or $SiO_2$ film is formed, and a second contact hole 55 is formed. Finally, the TFT substrate is completed by forming the signal electrode 4. The above process is a low temperature poly-Si TFT process. However, it should be appreciated that a high temperature poly-Si TFT process can be also used instead. By using this process, it is possible to obtain a TFT with superior mobility and miniature size. Further, there is an advantage in incorporating easily the peripheral circuit, such as a scanning wire selecting circuit, in the TFT. In the mask pattern shown in FIGS. 5 and 6, both of the sampling TFT 10 and the pixel driving TFT 6 have a coplanar structure. The sampling capacitor is formed between the island Si 50 of the source electrode of the sampling TFT 10 and the metal wire of the common electrode through the protecting film for the TFT. The Si island and the gate electrode layer are connected by the contact hole 15 through the connection 12. Therefore, the sampling capacitor can be formed so as to incorporate the whole source region of the sampling TFT.

In FIG. 6, the sampling capacitor 11 is configured by patterning the layer of the signal electrode and the common electrode 8 like an island. All of the electrodes of the capacitor are formed by a metal film. While the area of the sampling capacitor becomes smaller than that of FIG. 5, the resistance of an electrode is smaller as well. It is, therefore, possible to write fast in a capacitor.

Figure 8:
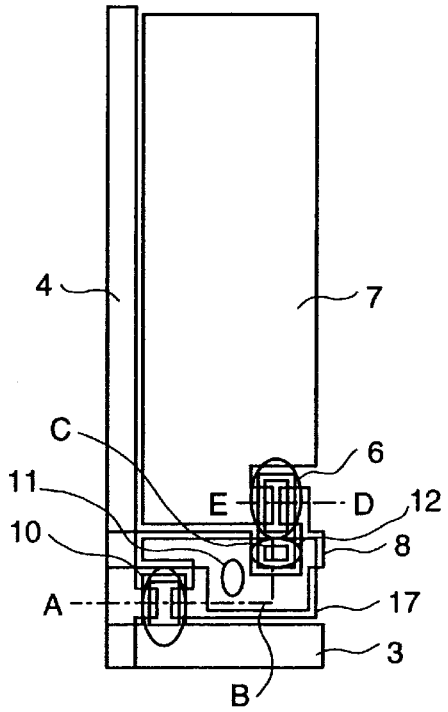
FIG. 8 is a diagram showing the configuration of the mask for the pixel portion with the inverse stagger structure.
Figure 9:
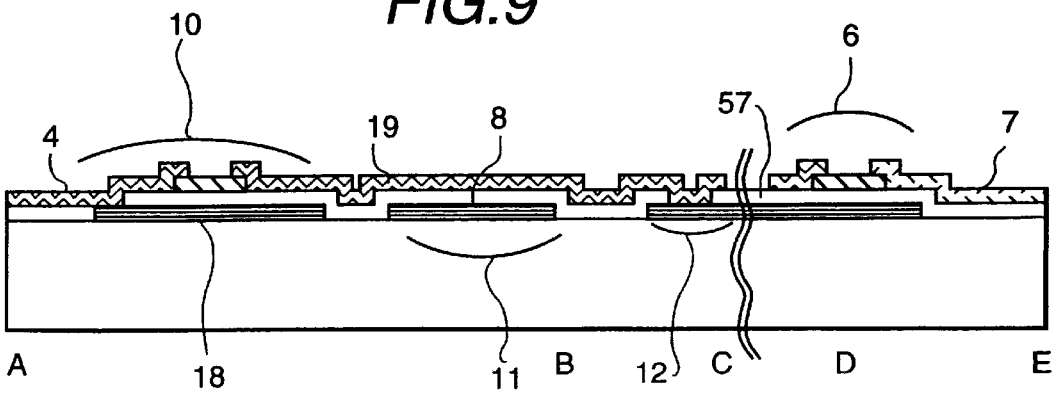
FIG. 9 is a sectional view of the inverse stagger structure shown in FIG. 8.

FIG. 8 shows the configuration of the mask for the pixel portion with an inverse stagger structure, and FIG. 9 shows the cross section of A-B-C-D-E portions of the inverse stagger structure shown in FIG. 8. Because of the inverse stagger structure, the gate electrode 18 of the TFT exists on the lowest layer. The sampling capacitor 11 is formed between the common electrode 8 and the source electrode 19 of the sampling capacitor. By adopting such a structure, the insulating film of the sampling capacitor can be commonly used with a protection insulating film 57 of the sampling TFT. Therefore, it is possible to simplify the manufacturing process, making it suitable for a mass production in the currently main product.

Figure 10:
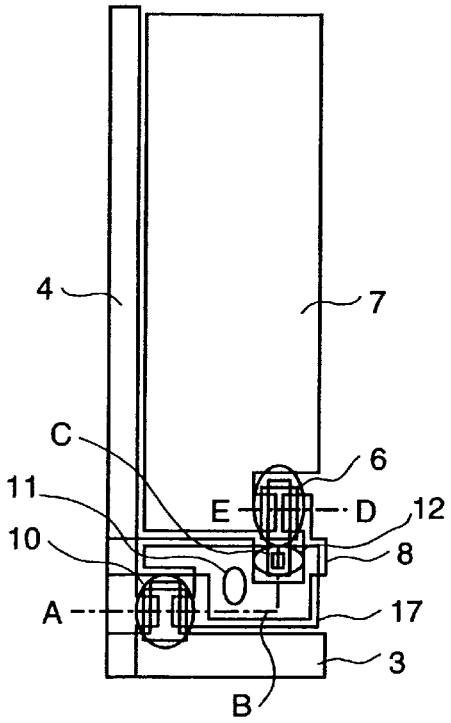
FIG. 10 is a diagram showing the configuration of the mask for the pixel portion with the stagger structure.
Figure 11:
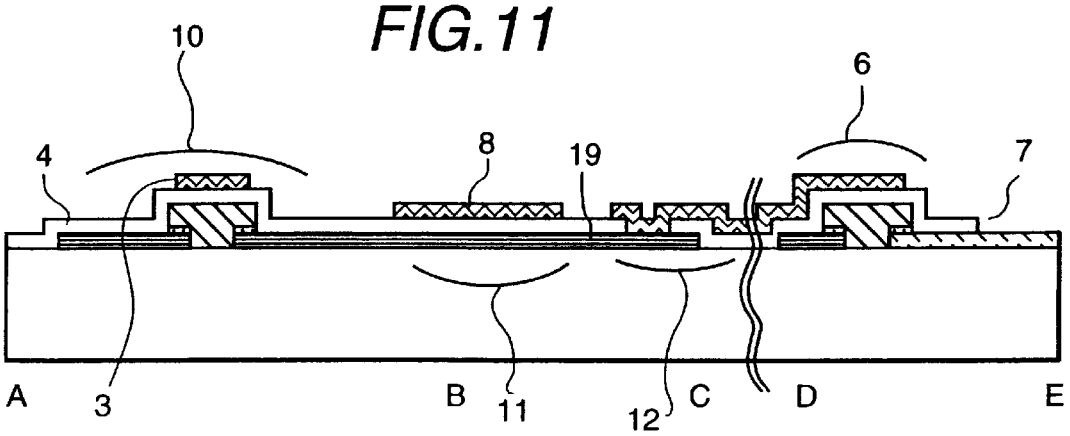
FIG. 11 is a sectional view of the stagger structure shown in FIG. 10.

FIG. 10 shows the configuration of the mask for the pixel portion with a stagger structure, and FIG. 11 shows the cross section of A-B-C-D-E portions of the stagger structure shown in FIG. 10. Because of the stagger structure, the gate electrode is on the top surface. The sampling capacitor is formed like the inverse stagger structure between the common electrode 8 and the source electrode 19 of the sampling capacitor. The manufacturing process is as follows. Firstly, the signal electrode 4 and the transparent electrode 7 are formed, and then the patterning is performed independently. The semiconductor layer, n-Si layer is formed by using a PE-CVD method. After the patterning, the i-Si layer and the silicon nitride layer are formed and the patterning is performed. After that, the scanning electrode and the common electrode are formed and the patterning is performed. Because more than five times of exposure is not required, the manufacturing can be simplified.

Figure 12:
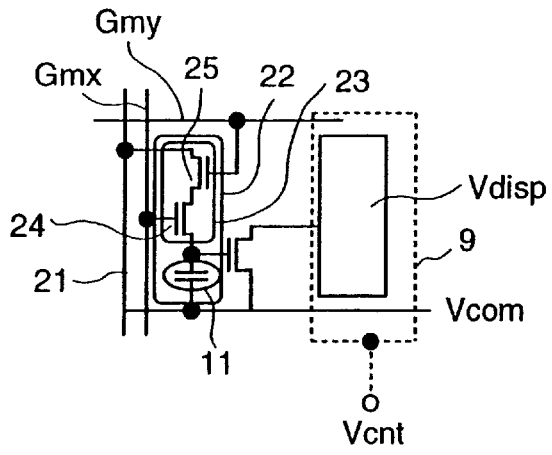
FIG. 12 is a schematic circuit diagram showing the configuration of the pixel portion with a pixel address selecting circuit used in the present invention.
Figure 13:
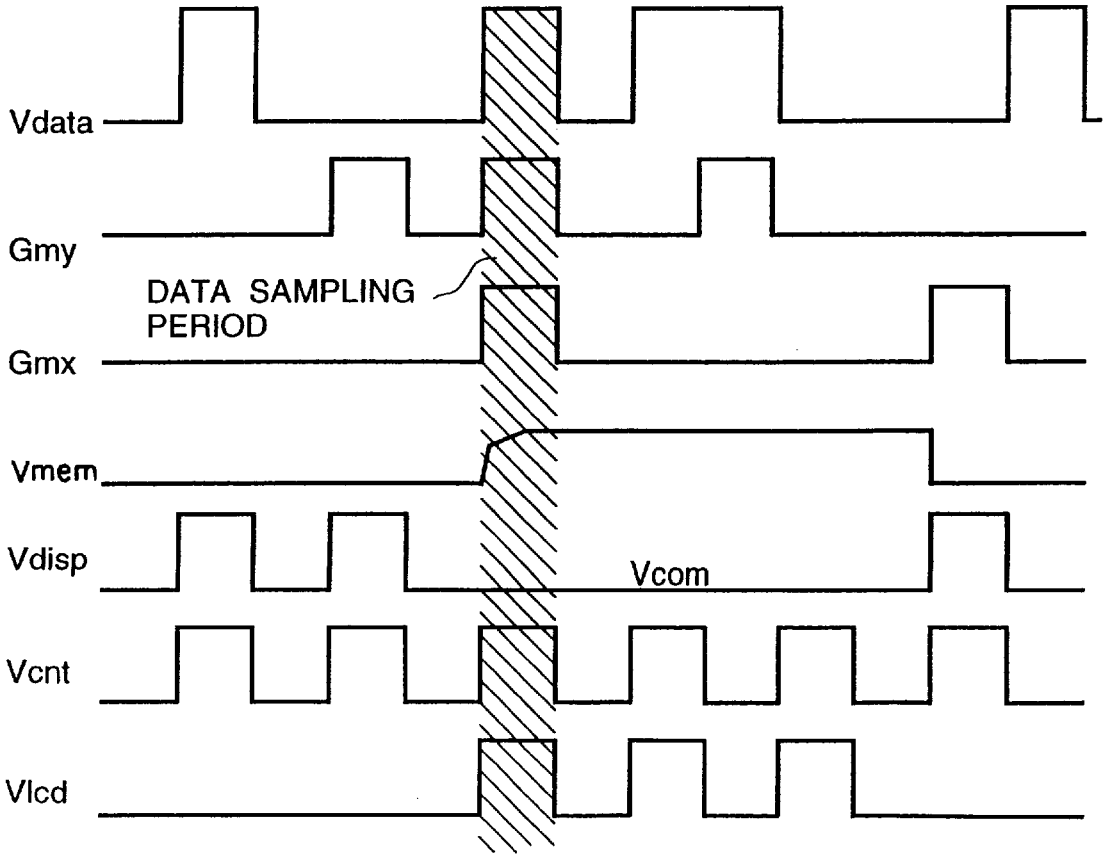
FIG. 13 is a wave form chart showing driving signals applied to the pixel portion shown in FIG. 12.
Figure 14:
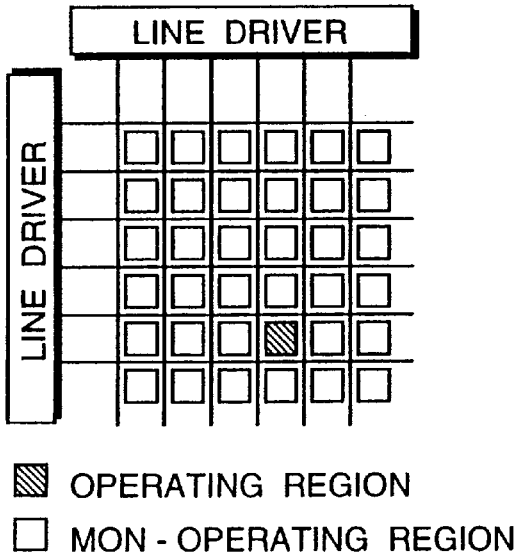
FIG. 14 is diagram for explaining the operation of the partial display of the present invention.

FIG. 12 shows another embodiment of the present invention. In this embodiment, a plurality of scanning electrodes (Gm) of the display portion are arranged in a x-y matrix, in addition to the embodiment of the pixel portions shown in FIG. 1. Namely, there are provided a y-directional scanning electrode Gmy for identifying the y-directional position of the pixel, and an x-directional scanning electrode Gmx for identifying the x-directional position of the pixel. A specified one pixel is selected by using these electrodes. The scanning wire selecting circuits are provided along two sides of the display portion, for example, the right side and the bottom side, so as to correspond to matrix-like scanning wires Gmx and Gmy, as shown in FIG. 1. The pixel includes a data holding circuit 22 employing an address decoder 23 which is constituted by connecting an x-directional scanning electrode decoder TFT 24 and a y-directional scanning electrode decoder TFT 25 in series and the signal electrode 21. When a high level voltage is applied to both the x-directional and the y-directional electrodes, and thus both the x-directional scanning electrode decoder TFT 24 and y-directional scanning electrode decoder TFT 25 turn "ON", the signal electrode 21 and the sampling capacitor are connected to each other, and a signal data voltage Vdata indicative of the state of "ON" or "OFF" of the pixel by using the high or low voltage applied from the signal electrode is charged in the sampling capacitor. Driving signals applied to the pixel portion shown in FIG. 12 will be explained hereinafter with reference to FIG. 13.

The voltages of both of the x-directional scanning electrode Gmx and y-directional scanning electrode Gmy, each connected to the pixel which is rewritten, turn to the high level, and thereby the pixel turns to a selected state. The sampling capacitor of the selected pixel is connected to the signal wire 21. An inter-terminal voltage Vmem of the sampling capacitor of each selected pixel is charged up to Vdata by the voltage applied to the signal wire. If Vmem is more than the threshold voltage, the pixel driving TFT turns to the "ON" state and the driving voltage is applied to the liquid crystal as in the case of the above embodiment. Otherwise, the driving voltage is not applied to the liquid crystal. Because the non-selected pixel can not allow the TFTs in the address decoder to turn "ON", the inter-terminal voltage of the sampling capacity in the pixel does not change, and thus the display is not rewritten.

As compared with the previous embodiment, while the rewriting of the display in the first embodiment is performed by selecting a row of pixels connected to one x-directional scanning electrode at the same time, only one selected pixel can be rewritten in this embodiment. Therefore, it becomes possible to partially rewrite in a unit of pixel. Furthermore, control is not necessary, except for controlling the x-directional and y-directional scanning electrodes and the data wiring. It is, therefore, easy to control the display of the panel.

Figure 15:
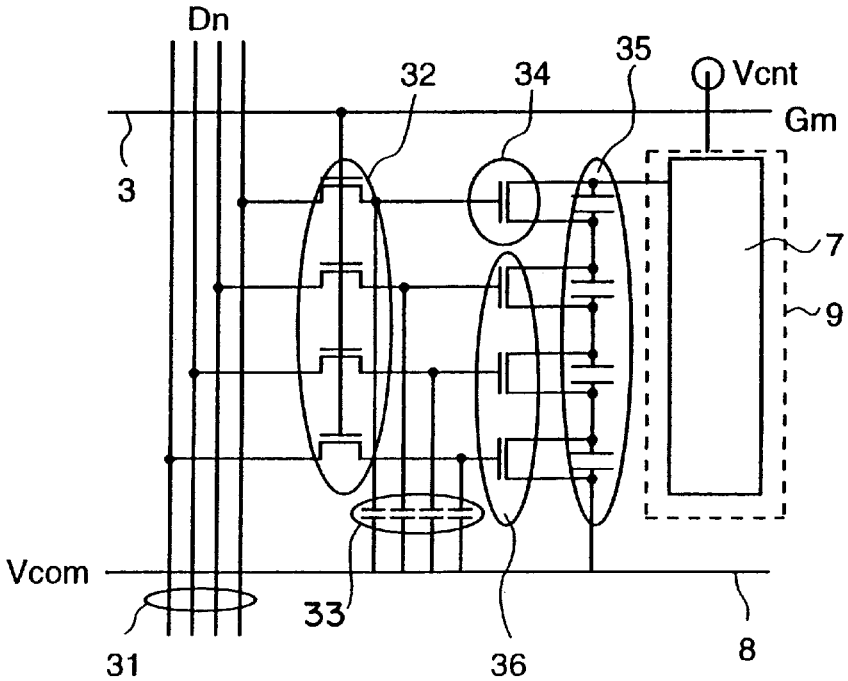
FIG. 15 is a schematic circuit diagram showing the configuration of the pixel portion with a gray level selecting TFT used in the present invention.

FIG. 15 shows the configuration of the pixel portion with gray level selecting TFTs according to a third embodiment. The pixel portion includes a plurality of signal electrodes 31, the scanning electrode 3, the common electrode 8, a plurality of sampling TFTs plurality plurality 32 for changing the gray levels, a sampling capacitor 33, a plurality of gray level selecting TFTs 36, a row of voltage-dividing capacitors 35, and the opposed electrode 9.

Gate electrodes of the sampling TFTs are connected to the scanning electrode. Drains and sources of the sampling TFTs are connected to a plurality of data wires each provided independently of others and sampling capacitors each provided independently of others, respectively. One terminal of each of the sampling capacitors is the common electrode. The terminals of the capacitors connected to the sampling TFT are connected to gates of a plurality of display selecting TFTs 34 and a plurality of gray level selecting TFTs 36. The drain and source of each of these TFTs are connected to each of the voltage-dividing capacitors so as to short-circuit each of the voltage-dividing capacitors.

Figure 16:
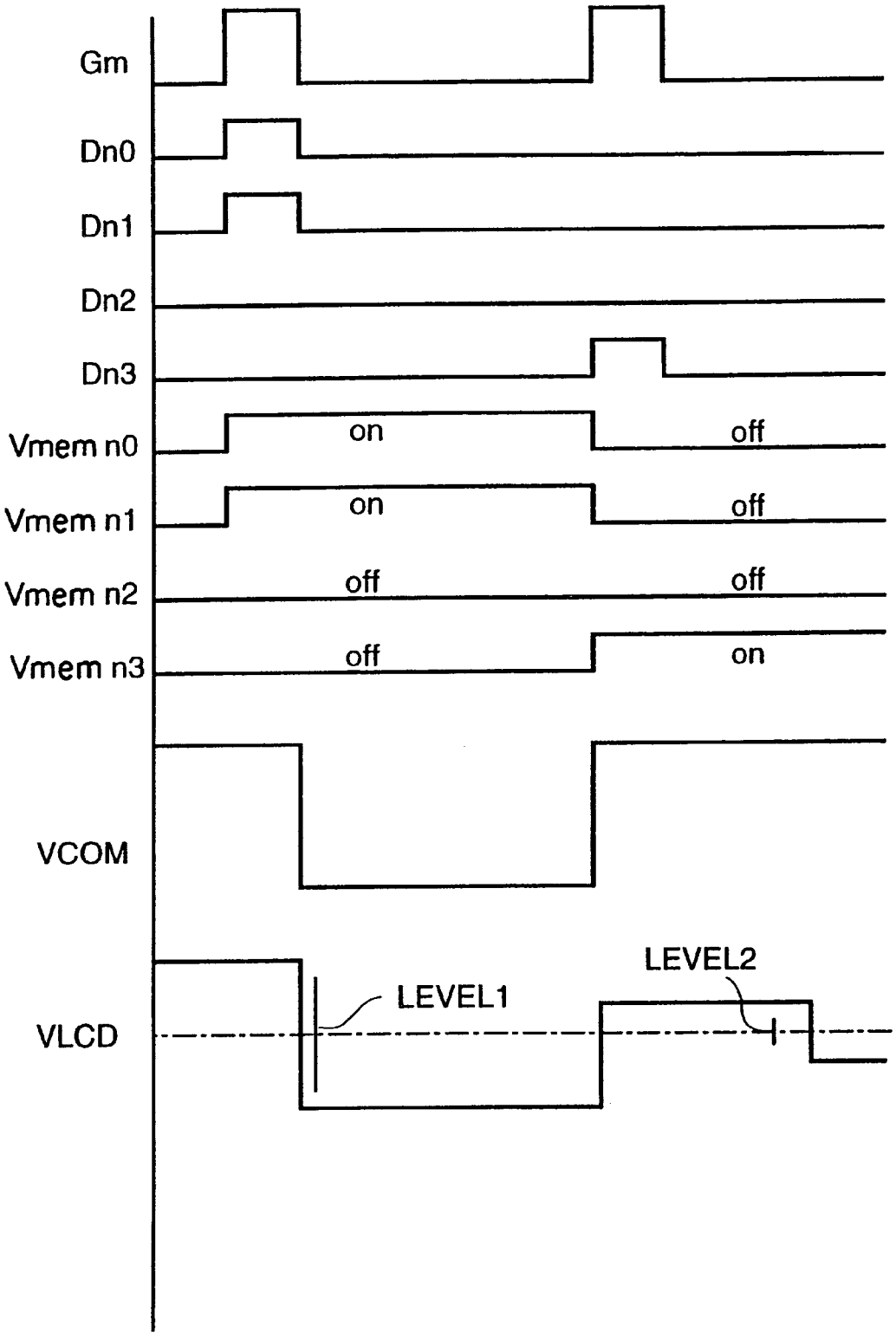
FIG. 16 is a wave form chart of the driving signals applied to the pixel portion shown in FIG. 15.

FIG. 16 is a wave form chart of the driving signals applied to the pixel portion shown in FIG. 15.

When the pixel selecting pulse is applied to the scanning electrode, one line of pixels are selected at the same time. A plurality of sampling TFTs within the pixel turn to the ON state at the same time. As a result, the sampling capacitors are charged by the voltages of the signal electrodes, respectively, and thus Vmem n0 is changed. Until the scanning electrode next becomes a high level, Vmem n3 is held with the sampling capacitors. The above operation is the same as the embodiment 1.

At this time, respective display selecting TFTs 34 and gray level selecting TFTs 36 turn to the ON state due to the sampling capacitors to which a voltage Vmem higher than the threshold voltage of the display selecting TFT 34 and the plurality of gray level selecting TFT 36 was applied, and a row of capacitors each of which is connected in parallel are short-circuited. When the display selecting TFT 34 is not selected, the transparent electrode 7 and the capacitors are insulated. Therefore, since an alternating voltage applied from the opposed electrode is not applied to the liquid crystal, the liquid crystal is not driven. In order to display gray levels, the gray level data made by the combination of a high voltage of the signal electrode with a low voltage is applied to the sampling capacitors. Some of the row of capacitors are short-circuited due to the combination of the voltage values, and thus the combined capacity of these capacitors changes.

The capacity of the liquid crystal formed between the display electrode and the opposed electrode is connected in series with the row of capacitors. A voltage of a liquid crystal driving power source Vcnt is applied between the common electrodes and the opposed electrode. Therefore, the liquid crystal driving voltage applied to the liquid crystal layer is divided by the combined capacity changed by the display data of the capacitor row and the liquid crystal capacity. Therefore, since the liquid crystal applying voltage changes when the combined capacity of the capacitor row chances due to the gray level data, it becomes possible to display the gray levels. As described above, it becomes possible to change in stages the liquid crystal applying voltage, and thus obtain multiple-gray-level display.

Figure 17:
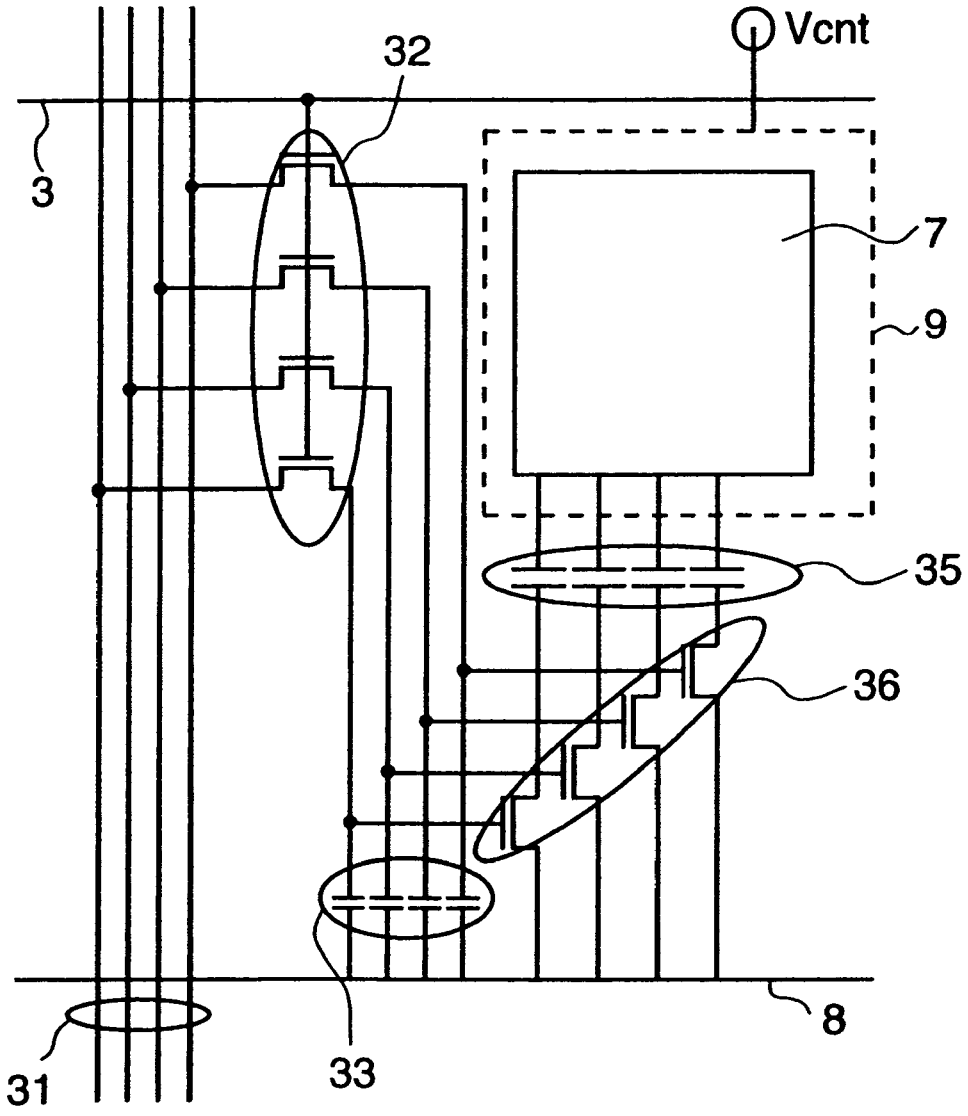
FIG. 17 is a schematic circuit diagram showing the configuration of another pixel portion with a gray level selecting TFT used in the present invention.

FIG. 17 shows another embodiment of the liquid crystal display apparatus which can display the gray levels. In this embodiment, the row of voltage dividing capacitors 35 are connected between and in parallel with the transparent electrode 7 and the common electrodes 8, and gray level selecting TFTs 36 are inserted between respective capacitors and the common electrodes. Because a gray level selecting TFT can be driven reliably by using the above configuration, even if the voltages of the sampling capacitors 33 are low, it is possible to allow the voltage of the signal electrode to be low. Therefore, it becomes possible to decrease the operation voltage of the panel, and reduce the power consumption.

Figure 18:
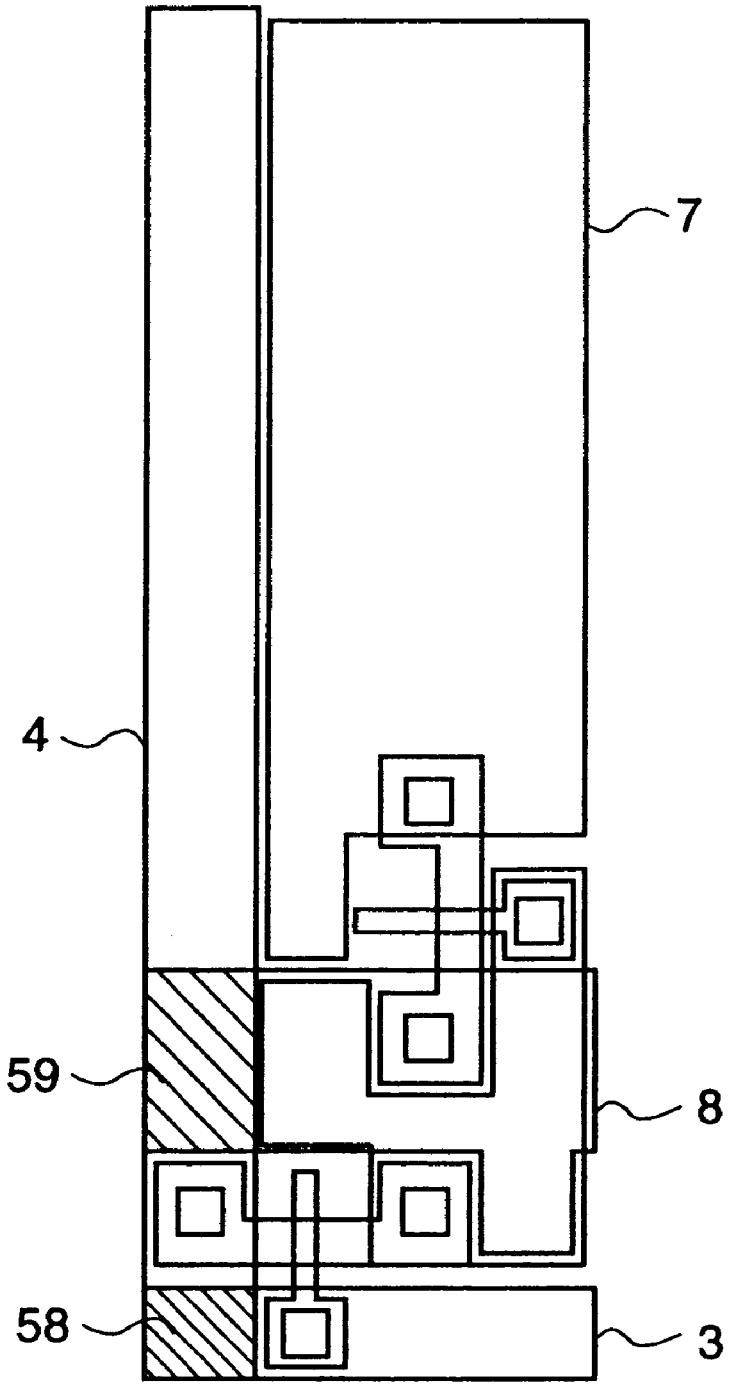
FIG. 18 is a diagram of an external view of the pixel portion used in the present invention.
Figure 19:
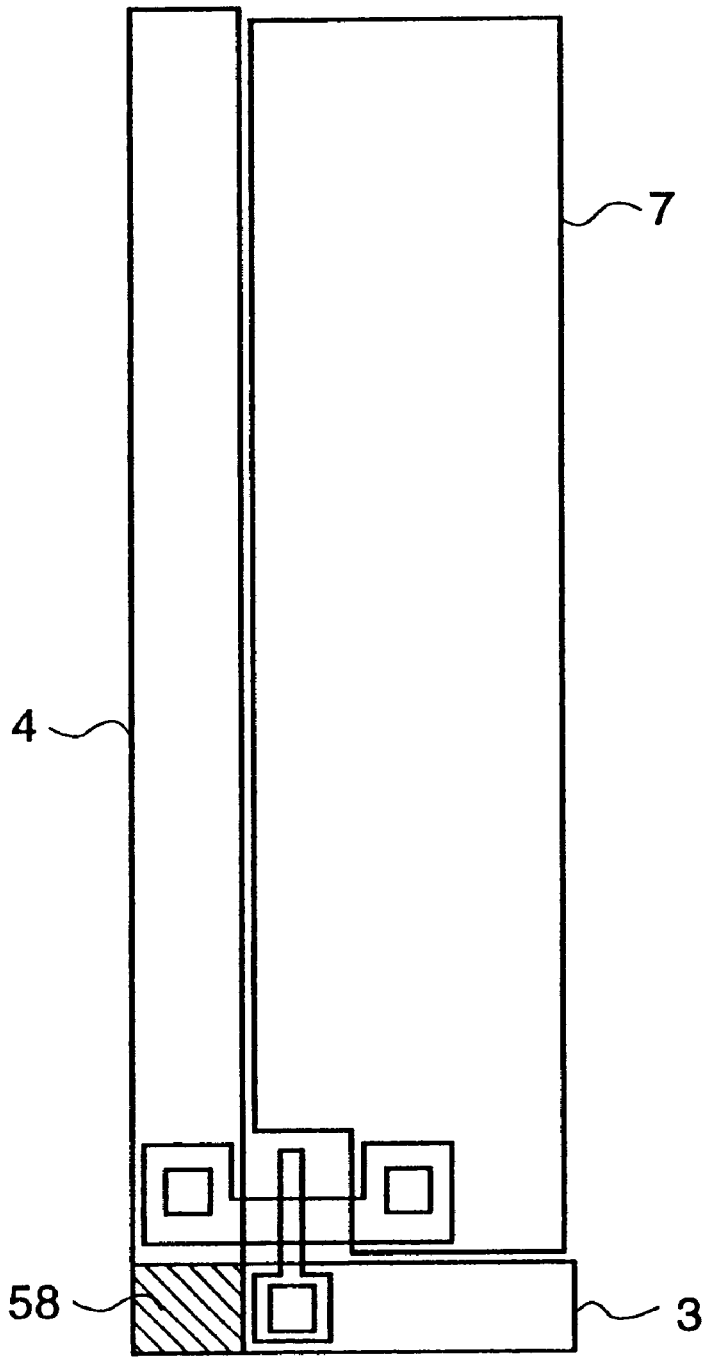
FIG. 19 (PRIOR ART)
FIG. 19 is a diagram of an external view of the pixel portion used in the conventional liquid crystal display apparatus.

FIG. 18 shows another embodiment of the pixel portion used in the present invention. The pixel shown in FIG. 18 has the same configuration as that shown in FIGS. 5 and 6. In this embodiment, the relationship between the capacity of the liquid crystal and that of the intersecting portion can be defined by the following equation. Here, the liquid crystal capacity is an electrostatic capacity formed by the configuration in which the liquid crystal is sandwiched between each electrode and the electrode counter to the TFT substrate (not shown), and the intersecting portion capacity is the sum of the capacity formed at a wire intersecting portion 59 of the signal electrode 4 and the common electrode 8 and the capacity formed at a wire intersecting portion 58 of the signal electrode 4 and the scanning electrode 3.

liquid crystal<(signal electrode capacity+wire intersecting portion capacity)×the number of scanning wires It becomes possible to reduce the power consumption when the content of the display is not rewritten, relative to the prior art having the same wire intersecting portion 58 as that shown in FIG. 19, by defining the above relationship.

The above definition will be explained in detail hereinafter, based on the embodiment shown in FIG. 18.

In a pixel having the configuration shown in FIG. 5, most of the electric power consumed in the pixel is due to the loss which has occurred during the charging and discharging of the parasitic capacity of the respective wires. Assuming that a capacitor C(F) repeatedly charges and discharges at a square wave with the amplitude V(V) and the repetition frequency f(Hz), the power consumption P(W) is proportional to the square of the amplitude voltage and the frequency, and is represented by the following equation:

$$P=C\times V\times V\times f$$

Assuming that the capacity of the opposed electrode and each of the scanning electrode, the signal electrode, the common electrode and the display electrode are, respectively, CDLC, CGLC, CCOMLC, and CPXLC, the electrostatic capacity between the electrodes formed on the TFT substrate and the opposed electrode formed on the substrate counter to their electrode via the liquid crystal are as follows:

$$CDLC=\epsilon\times\epsilon LC\times SD\div tLC$$

$$CGLC=\epsilon\times\epsilon LC\times SG\div tLC$$

$$CCOMLC=\epsilon\times\epsilon LC\times SCOM\div tLC$$

$$CPXLC=\epsilon\times\epsilon LC\times SPX\div tLC$$

where, $\epsilon$ is the vacuum dielectric constant, $\epsilon$LC is the relative dielectric constant of the liquid crystal, SD is the area of the pixel electrode, SG is the area of the scanning electrode, SCOM is the area of the common electrode, SPX is the area of the pixel electrode, and tLC is the thickness of the liquid crystal cell.

Assuming that the intersecting portion capacity of the scanning electrode for a pixel and the signal electrode, and that of the common electrode and the signal electrode, are CGDcross 58 and CDCOMcross 59, respectively, each capacity is represented by the following equation:

$$CGDcross=\epsilon\times\epsilon ins\times SGD\div tins$$

$$CDCOMcross=\epsilon\times\epsilon ins\times SDCOM\div tins$$

Next, the loss of electric power due to the charging and discharging of these capacities will be calculated. When the display is not rewritten in the panel of the present invention, the voltages of the scan electrode and the signal electrode on the TFT substrate are maintained to be constant, and thus the pulse wave is not applied. Therefore, the alternating voltage for driving these capacities is only the liquid crystal driving voltage with the amplitude VLC and the frequency f(LC) applied from the opposed electrode due to CGLC, CDLC, CcomLC, and CpxLC. Accordingly, the power consumption PLC of the liquid crystal system, that is, the sum of the power consumed in a respective capacity, is as follows.

$$PLC=\{CGLC+CDLC+CcomLC+CpxLC\}\times VLC\times VLC\times f(LC)$$

Concretely, assuming that a TN liquid crystal is used, the threshold voltage of the liquid crystal is 3 V, its saturation voltage is 8 V and the threshold voltage of the TFT is 2 V, the VLC is approximately 15 V. Further, when the frame frequency is 60 Hz, the liquid crystal can work et f(LC)=30 Hz. Further, because it is not necessary to write the display data into the pixel in every frame in the present invention, an alternating wave form is not applied to the scan electrodes and the signal electrodes, and thus the power loss due to charging and discharging does not occur.

On the other hand, the prior art of FIG. 19 has the capacities formed between the opposed electrode and each of the scanning electrode, the signal electrode, and the display electrode, as an electrostatic capacity which generates the loss of electric power. Assuming that the capacities per one pixel formed between these electrodes is CGLC, CDLC and CPXLC, respectively, the value of each of the capacities is represented by the following equation:

$$CDLC=\epsilon\times\epsilon LC\times SD\div tLC$$

$$CGLC=\epsilon\times\epsilon LC\times SG\div tLC$$

$$CPXLC=\epsilon\times\epsilon LC\times SPX\div tLC$$

The pulse wave form with the voltage value VG(V) is applied one time to the scanning electrode every frame frequency f(flm) corresponding to the frame frequency of 60 HZ. The amplitude of the voltage is VG. Because it is necessary to set VG to a voltage higher than the sum of the liquid crystal applying voltage VLC and the threshold voltage of the TFT in general, it is necessary to set VG to 20 V if VLC=15 V. Further, an alternating voltage which changes its value every horizontal scanning frequency f(H) defined by the following equation is applied to the signal electrodes. The amplitude of the applied voltage is the same as the liquid crystal driving voltage VLC.

$$\text{(Horizontal frequency)}=\text{(frame frequency)}\times\text{(number of scanning signal)}$$

Concretely, when the frame frequency is 60 Hz and the number of scanning signals is 480, the horizontal frequency 28.8 kHz.

The voltage applied to the display electrode is an alternating liquid crystal driving voltage whose polarity is inverted every frame frequency. The driving frequency is 30 Hz {f(LC)}, half of the frame frequency, and the voltage is VLC.

The power lose due to the charging and discharging of the capacity of the liquid crystal is calculated by the following equation:

$$PLC\ (prior\ art)=CpxLC\times VLC\times VLC\times f(LC)$$

$$+CGLC\times VG\times VG\times f(flm)$$

$$+CDLC\times VLC\times VLC\times f(H)$$

The voltage at the intersecting portion of the signal electrode and the scanning electrode becomes a difference voltage between the voltages of the electrodes. Therefore, the power loss is calculated according to the following equation:

$$Pcross\ (prior\ art)=CGDcross\times[\{VLC\times VLC\times f(H)\}+\{VG\times VG\times f(flm)\}]$$

The sum P (prior art) of the power loss, that is, the sum of PLC (prior art) and Pcross (prior art) is, $$P\ (prior\ art)=CpxLC\times VLC\times VLC\times f(LC)$$

$$+CGLC\times VG\times VG\times f(flm)$$

$$+CDLC\times VLC\times VLC\times f(H)$$

$$CGDcross\times[(VLC\times VLC\times f(H)\}$$

$$+\{VG\times VG\times f(flm)\}]$$

$$=(CDLC+CGDcross)VLC\times VLC\times f(H)$$

$$+(CGLC+CGDcross)\times VG\times VG\times f(flm)$$

$$+(CpxLC)\times VLC\times VLC\times f(LC)$$

Substituting the real number within the range of actual use in the above equation, the horizontal frequency 28.8 kHz when the frame frequency is 60 Hz and the number of the scanning wires is 480. Assuming that a TN liquid crystal is used as the liquid crystal, the threshold voltage of the liquid crystal is 3V, the saturation voltage is 8V, and the threshold voltage of the TFT is 2V, the VLC is approximately 15V. Further, f(LC) operates at 30 Hz when the frame frequency is 60 Hz. Accordingly, the above equation is, $$P\ (prior\ art)=(CDLC+CGDcross)\times 6480000$$

$$+(CGLC+CGDcross)\times 1200$$

$$+(CpxLC)\times 6750$$

where, a first and a second term are negligible. Therefore, P (prior art) becomes the following equation in the actual use.

$$P\ (prior\ art)=(CDLC+CGDcross)VLC\times VLC\times f(H)$$

It is possible to reduce the loss of the driving power as compared with the prior art, by setting the PLC (invention) to a value less than the above electric power in this embodiment. The following equation represents how to obtain such the value.

$$PLC\ (invention)=P\ (prior\ art)$$

$$(CGLC+CDLC+CcomLC+CpxLC)\times VLC\times VLC\times f(LC)$$

$$<(CDLC+CGDcross)\times VLC\times VLC\times f(H)$$

Namely, $$(CGLC+CDLC+CcomLC+CpxLC)\times f(LC)$$

$$<(CDLC+CGDcross)\ f(H)$$

Since f(H)=f(LC)×(number of scanning electrodes), the above equation is rearranged as follows.

$$(CGLC+CDLC+CcomLC+CpxLC)\times f(LC)$$

$$<(CDLC+CGDcross)\times f(LC)\times(number\ of\ scanning\ electrodes)$$

Dividing both sides of the equation by f(LC), $$(CGLC+CDLC+CcomLC+CpxLC)$$

$$<(CDLC+CGDcross)\times(number\ of\ scanning\ electrodes)$$

where, the term (CGLC+CDLC+CcomLC+CpxLC) of the left side represents the sum of the capacities between the opposed electrode and each of the scanning electrode, signal electrode, and display electrode, and the term (CDLC+CGDcross) of the right side represents the sum of the capacity between the signal electrode and the opposed electrode and the capacity at the wire intersecting portion between the signal electrode and the scanning electrode.

Therefore, if the above equation satisfies the following condition, it is possible to obtain an improved panel of which the power consumption is less than that of the prior art.

Figure 20:
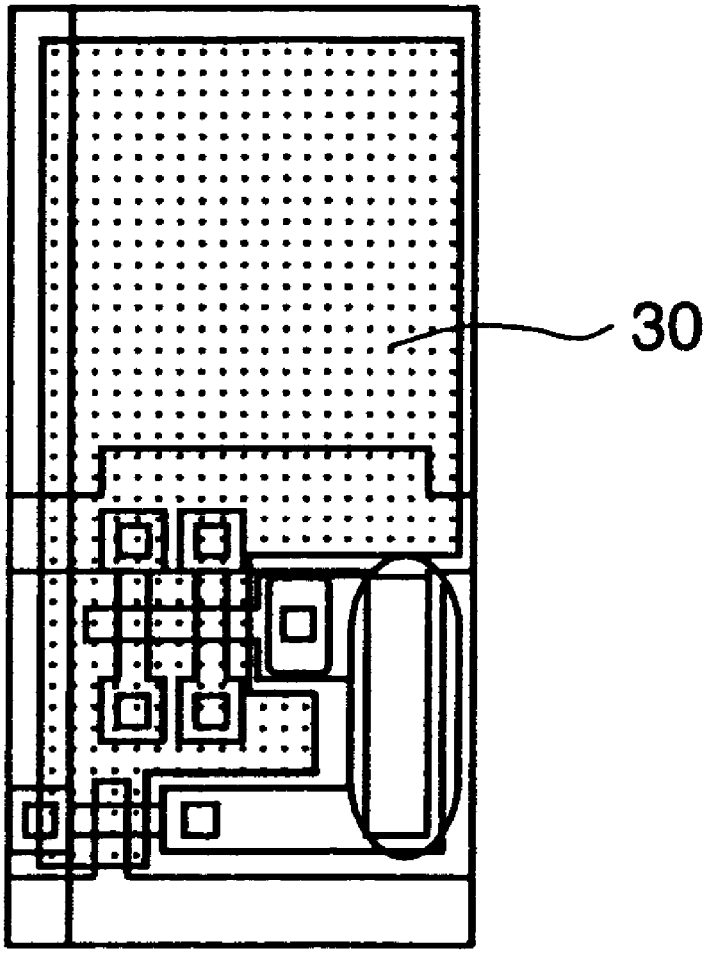
FIG. 20 is a diagram showing the configuration of the mask for the pixel portion with a reflection electrode used in the present invention.

FIG. 20 shows the configuration of the mask for the pixel portion with a reflection electrode 30 used in the present invention. While the configuration of the pixel itself is the same as that in the first to the third embodiments, this embodiment is characterized by the use of the reflection electrode.

Because the reflection electrode can be laid in overlapping relationship with the TFT, the component of the pixel, and the wires by electrically insulating them, it is possible to further enlarge the region of display.

If a reflection type of pixel with a high aperture ratio is constructed in the prior art, the display electrode must be overlapped with the scanning electrode and signal electrode. In such a case, since the capacity connection is formed between the display electrode and each of the signal electrode and the scanning electrode, it is difficult to display correctly the voltage held in the display electrode of the pixel. This is because the display electrode performing a holding operation is electrically insulated from any of the electrodes, and the voltage of the display electrode is affected by the pulse voltage applied to the scanning electrode and the signal electrode.

However, because the selected display electrode is connected to the common electrode through the pixel driving TFT, the voltage of the display electrode is not affected, due to the capacity coupling of the scanning electrode with the signal electrode. As a result, an optimum display can be obtained.

Further, because it is impossible directly to see a lower portion of the display electrode which forms a shadow from the front of the panel, the light emission to a TFT is remarkably reduced by locating the TFT at that position. If the apparatus is used at the outside, a strong light may remarkably increase an OFF current of the TFT in the apparatus, and thus deteriorate the characteristic of display of the apparatus. It is possible to avoid an increase in the OFF current by adopting the configuration according to the present embodiment. Particularly, in a reflection type panel with low power consumption suitable for a panel of a portable device, it is possible effectively to improve an increase in the OFF current of the TFT. Further, because in the reflection type panel it is unnecessary to use the back light with high power consumption, it becomes possible remarkably to reduce the power consumption by adopting the present invention to the reflection type panel.

The process for manufacturing the above panel will be explained next.

In the cross-sectional structure shown in FIG. 7, an insulation layer is formed on a surface of the configuration by using an insulation material such as $SiO_2$ or $Si_3N_4$ after forming the scanning electrodes. A contact hole is formed to connect the display electrode to the pixel driving TFT 6, a metal film such as A1 or silver with high reflection factor is formed, and then the patterning is performed. It should be noted that in order to increase the reflection factor, it is effective to carry out the above process after eliminating uneven spots on the surface by using a planarization technique, such as fine polishing, after the insulation layer is formed.

In this case, it is necessary to use a guest-host type liquid crystal in which the dye is dispersed as a liquid crystal, and use a display mode in which a superior contrast can be obtained in a reflective display mode. It should be noted that the PCGH mode also can be applicable. It can combine the above liquid crystal with the polymer dispersion liquid crystal. The polymer dispersion liquid crystal has an advantage in manufacturing equally a large panel, because it is fixed by a solid resin or a resin with high viscosity.

According to the above-mentioned embodiment, the display information can be stored within the pixel, and it is not necessary to drive the display electrode and signal electrode if the display is not rewritten. Therefore, it is possible to reduce the power consumption of the panel.

It is further possible to rewrite the display on an individual pixel basis by providing a pixel address selecting means within the pixel. Therefore, the power consumption can be reduced. In addition, because the display device can be managed as a bit map memory, the management of the display can be remarkably simplified.

Furthermore, the voltage to be applied to the display electrode can be controlled due to a plurality of display information stored in the pixel. It is, therefore, possible to obtain improved display in multiple gray levels, and obtain a color display by combining a color filter.

Figure 21:
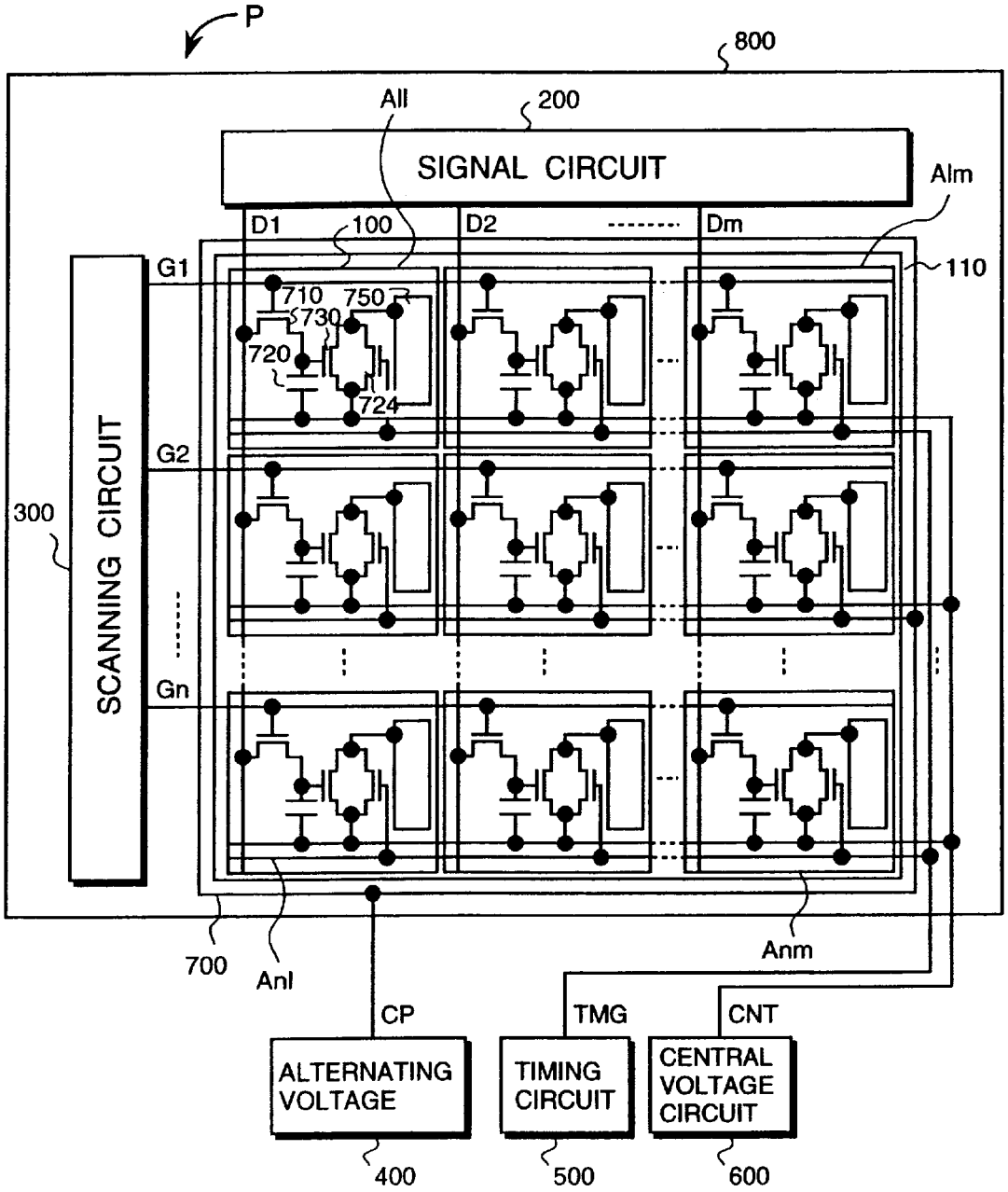
FIG. 21 is a schematic diagram showing the whole configuration of a liquid crystal display apparatus according to a second embodiment of the present invention.

FIG. 21 is a schematic diagram of the whole structure of the liquid crystal display apparatus representing one embodiment of the present invention. In FIG. 21, the liquid crystal display apparatus, which is formed as a TFT active matrix type liquid crystal display, comprises a pixel circuit 100, a display part 110, a signal circuit 200, a scanning circuit 300, an AC voltage circuit 400, a timing circuit 500, a center voltage circuit 600, a counter board 700 and a TFT board 800, in which the pixel circuit 100, the display part 110, the signal circuit 200, the scanning circuit 300 and the counter board 700 and the TFT board 800 are formed on the color panel P. In the present embodiment shown in FIG. 1, only the color panel P and its peripheral circuits as shown, and the detailed structure of the color panel P, such as the optical system, is not shown.

The color panel P has a pair of boards, the counter board 700 and the TFT board 800, in which the individual boards are so laid out that the liquid crystal layer (not shown) including liquid crystals forming a plurality of pixels may be inserted between these boards 700 and 800, so that the individual boards may face each other. The counter board 700 is a transparent plate and a transparent electrode is formed on one side of the board. On the TFT board 800, the pixel circuit 100, the display part 110, the signal circuit 200 and the scanning circuit 300 are formed. The pixel circuits are formed on the display part 100 as an n×m matrix. The n scanning wires G1 to Gn are developed uniformly on the display part 110, and the m signal wires D1 to Dm crossing the scanning wires perpendicularly are developed uniformly as well. On the display surface of the color panel P, on the display part 110 forming a display area, a plurality of display areas All to Anm are formed, each display area being defined by a single scanning wire and a single signal wire. For example, assuming that the number of scanning wires is 640 and the number of signal wires is 480, the color panel P can be established with 640×480 pixel dots. For the individual display area, the AC signal wire CP, the timing line TMG and the reference line CNT are connected to the individual display area, and the AC signal wire CP is connected to the AC voltage circuit 400, the timing line TMG is connected to the timing circuit 500, and the reference line CNT is connected to the center voltage circuit 600.

Figure 22:
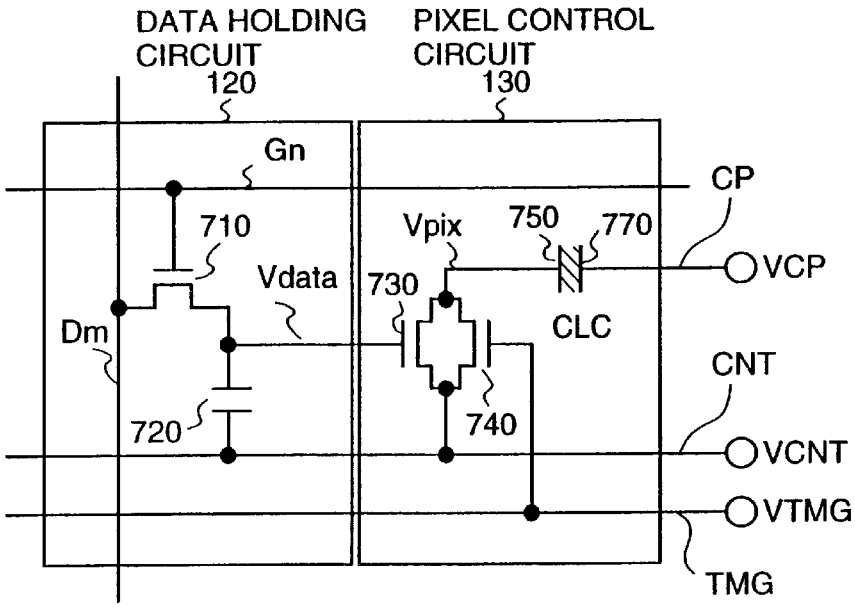
FIG. 22 is a circuit diagram of a pixel circuit used in the second embodiment of the present invention.

As shown in FIG. 22, the pixel circuit 100 defined in the individual display comprises a data hold circuit 120 and a pixel control circuit 130. The data hold circuit 120 comprises a transistor 710 composed of a TFT and a holding capacitance 720, and the pixel control circuit 130 comprises transistors 730 and 740 composed of a TFT, a display electrode 750 and a transparent electrode 770. For the pixel circuit 100 located at the n-th row and the m-th column, the scanning wire Gn is connected to the gate of the transistor 710 and its drain is connected to the signal wire Dm, connected to the gate of the transistor 730 and its source one of the terminals of the holding capacitance 720. The other terminal of the holding capacitance 720 is connected to the reference line CNT. The transistors 730 and 740 are connected in parallel, with their drains connected to their sources mutually, and each drain is connected to the display electrode 770, and each source is connected to reference line CNT. The gate of the transistor 740 is connected to the timing line TMG. The liquid crystal capacity CLC is formed between the display electrode 750 and the opposed electrode 770, and the opposed electrode is connected to the AC signal wire CP.

The transistor 710 is turned on when the level of the scan pulse applied to the scanning wire Gn is "H", and then, the holding capacitance 720 captures the image data transferred on the signal wire Dm. Thus, the voltage Vdata responsive to the image data is applied to the gate of the transistor 730 and Vdata is charged in the holding capacitance 720. The transistor 730 is turned on when the level of Vdata is "H", and works as a pixel driving switching device for applying the charged voltage stored in the holding capacitor 720 to the display electrode 750. The transistor 740 is turned on when the level of the timing signal for transmitting the signal on the timing line TMG is "H", and creates a short circuit between the drain and the source of the transistor 730, and the voltage between the display electrode 750 and the opposed electrode 770 is initialized to 0 V when the transistor 730 is turned off. Thus, the transistor 730 is used as a reset means. In addition, the signal circuit 200 is formed as a image data generation means for applying the image data onto the individual signal wires D1 to Dm, and the scanning circuit 300 is formed as a scan pulse generation means for applying the scan pulses sequentially to the individual scanning wires G1 to Gn.

Next, by referring to FIG. 23 and FIG. 24, the detailed structures of the AC voltage circuit 400, the timing circuit 500 and the center voltage circuit 600 will be described.

The timing circuit 500 is composed of mono-stable multivibrators 501, 502 and 503, a flip-flop 504, an OR gate 505, inverters 506 and 507, and AND gates 508 and 509. A synchronous signal VS synchronized with the signal defining the frame frequency is applied to the input terminal of the timing circuit 500, and the timing signal VTMG including a 760 Hz AC component is extracted from its output terminal.

Figure 24:
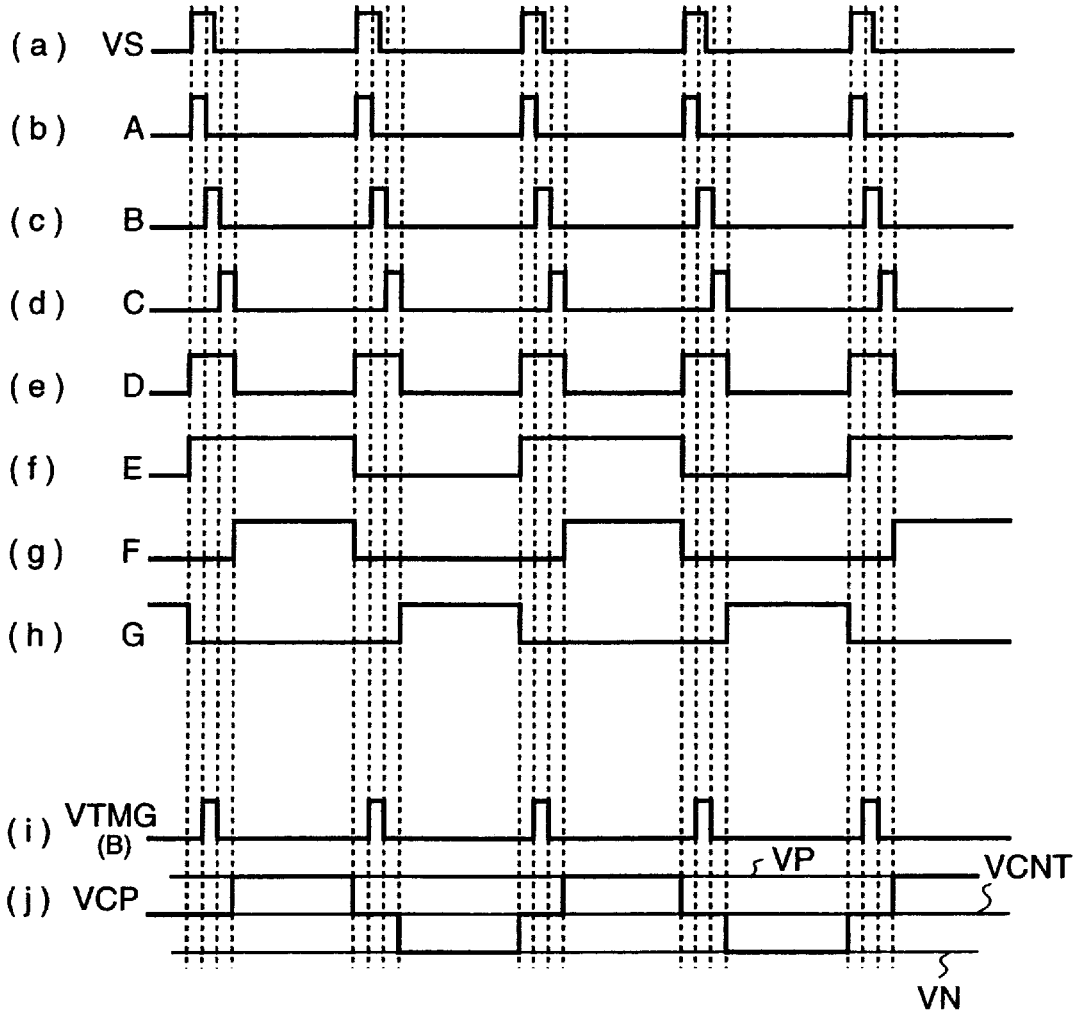
FIG. 24 is a timing chart illustrating the operation of the timing circuit and the alternating voltage circuit.

When the synchronous signal VS is input to the multivibrator 501, pulses with their pulse width specified by the individual multivibrator responsive to the leading edge of the individual input pulse are output from the individual output terminals A, B and C of the vibrators 501, 502 and 503, respectively, as shown in FIG. 24 at lines (b) to (d). Pulses with their phase delayed by a single pulse width with respect to their output pulses are output from the individual multivibrators 501 to 503, and each pulse is input to the OR gate 505. Therefore, as shown in FIG. 24 at line (e), the output pulse obtained by logical OR processing of input pulses is output from the output terminal D of the OR gate 505.

On the other hand, the output pulse from the multivibrator 501 is supplied to the flip-flop 504, and a pulse with its pulse width as shown in FIG. 24 at line (f) is output from the output terminal E of the flip-flop 504. Thus, the flip-flop 504 reverses its output signal at the timing when the synchronous signal VS rises up, and supplies sequentially the pulses with its logic value inverted every time the synchronous signal VS occurs. The output pulse from the flip-flop 504 is input to the AND gate 508, and at the same time, its output pulse reaches the AND gate 509 through the inverter 506. The output pulse from the OR gate 505 is input to the other input terminals of the AND gates 508 and 509 through the inverter 507. Therefore, the output pulse obtained by logical AND processing of the output pulse from the flip-flop 504 and the output pulse from the inverter 507 is output from the output terminal F of the AND gate 508, and the output signal obtained by logical AND processing of the output pulse from the inverter 506 and the output pulse of the inverter 507 is output from the output terminal G of the AND gate 509. Finally, the output pulses from the individual output terminals D, F and G are input to the AC voltage circuit 400, respectively. Thus, the timing circuit 500 is configured as a timing signal generation means for supplying high-level pulses periodically.

The AC voltage circuit 400 is configured to comprise power supplies 401 and 402, and switches 403, 404 and 405, in which the connection point between the power supplies 401 and 402 defined as a reference line CNT is connected to the power supply 601 of the center voltage circuit 600. The positive terminal of the power supply 401 is connected to the AC signal wire CP through the switch 404, and the negative terminal of the power supply 402 is connected to the AC signal wire CP through the switch 405, and the connection point between the power supplies 401 and 402 is connected to the AC signal wire CP through the switch 403.

The switch 403 is so defined as to close its switching gate when the signal level of the output pulse from the output terminal D of the OR gate 505 is "H',; the switch 404 is so defined as to close its switching gate when the signal level of the output pulse I from the output terminal F of the AND gate 508 is "H"; and the switch 405 is so defined as to close its switching gate when the signal level of the output pulse from the output terminal G of the AND gate 509 is "H". As shown in FIG. 24 at line (j), when the signal including the reference voltage corresponding to the output voltage of the power supply 601 or including the center voltage VCNT is output and then the switch 404 is closed, the voltage VP obtained by adding the output voltage of the power supply 601 to the output voltage of the power supply 401 is output; and when the switch 405 is closed, the output voltage VN (negative voltage) of the power supply 402 is output.

Thus, the AC voltage circuit 400 is so defined as an AC voltage generation means for applying the liquid-crystal driving voltage to the opposed electrode, in which the liquid-crystal driving voltage is obtained as a minimum value VN, and for example, with its effective value 3v. As for the AC voltage VCP, the positive voltage period VP and the negative voltage period VN between them and the center voltage VCNT are defined, and the timing signal VTMG arises while the voltage VCP takes the center voltage VCNT value.

Next, referring to the timing chart shown in FIG. 25, the operation of the pixel circuit 100 will be described. The period of the timing signal VTMG is defined as half of the period of the AC voltage signal VCP, in which the AC voltage VCP becomes "H" when the timing signal VTMG is the center voltage value. In addition, the timing with which the voltage Vdata applied to the gate of the transistor 30 changes depends upon the writing operation of the data holding circuit 120, and the phase difference between Vdata and VCP changes responsive to the position of the pixel even if signal synchronization between those voltage signals is taken. Therefore, for purposes of explanation, what is described is an example where data is altered at almost the center of the timing signal VTMG.

Figure 26:
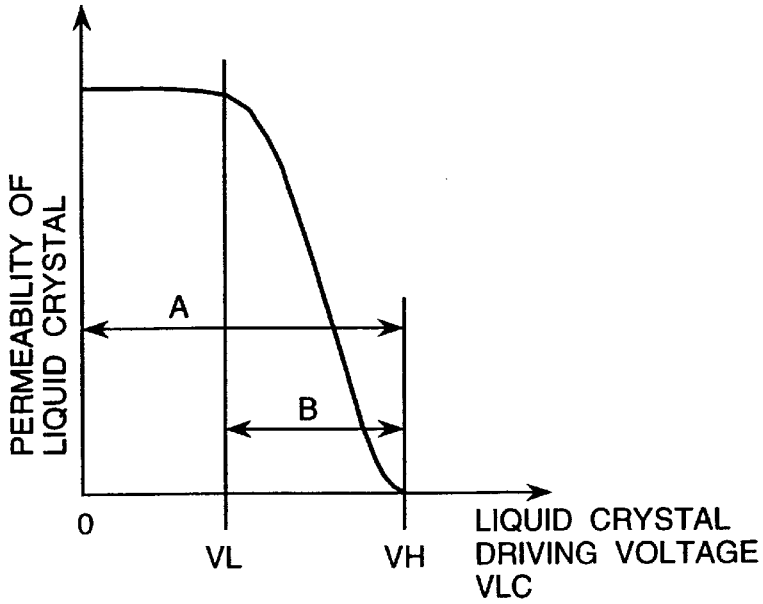
FIG. 26 is a characteristic diagram showing the relationship between the liquid crystal driving voltage and the liquid crystal transmittance.

At first, the transistor 710 is turned on when the scan pulse is applied on the scanning line Gn, the image data being supplied through the signal wire Dm; and, next, when the signal level of the voltage Vdata of the image data is "H", the transistor 730 is turned on and then, the voltage Vpix of the display electrode 750 gets to the VCNT equivalent to the reference voltage CNT. Thus, the AC voltage VCP as a liquid crystal driving voltage VLC is applied directly to the liquid crystal between the display electrode 750 and the opposed electrode 770. Therefore, as shown in FIG. 26, the liquid crystal drive voltage VLC as an effective value is applied to the liquid crystal, and this applied voltage (shown by the arrow A in FIG. 26) changes alternately between the saturation voltage VH (for the minimum liquid crystal transmittance) and 0V (for the maximum liquid crystal transmittance) with which the liquid crystal is turned on and off.

Next, when the signal level of Vdata changes from "H" to "L" and the timing signal VTMG is "L", the transistor 730 changes its state from "ON" to "OFF" while the state of the transistor 740 remains "OFF". As a result, the display electrode 50 becomes in the "OPEN" state in a DC mode, and the liquid crystal drive voltage VLC becomes zero. However, there exists a liquid crystal capacitance CLC between the display electrode 750 and the opposed electrode 770, the voltage when the transistor 730 is at the "ON" state being held in the liquid crystal capacitance CLC transitionally. Therefore, the voltage Vpix is held to be the central voltage VCNT, and the AC voltage VCP is applied to the liquid crystal.

After that, the level of Vdata changes from "H" to "L" and the level of the timing signal VTMG becomes "H", the transistor 40 changes to the "ON" state. As a result, the display electrode 50 is connected to the reference line CNT, and the electric charge stored in the liquid crystal transmittance capacitance CLC is discharged and the internal electric charge in the liquid crystal capacitance CLC is initialized to zero. Thus, the voltage defined between the display electrode 750 and the opposed electrode 770 is initialized to zero. As a result, the liquid crystal is immediately turned off, that is, the light is off, and then, as the transistors 730 and 740 are kept in the "OFF" state, even if an AC voltage is applied to the opposed electrode 770, the electric charge in the liquid crystal capacitance CLC is kept to zero, and the voltage Vpix of the display electrode 750 is equivalent to the voltage VCP of the opposed electrode 770. This leads to the fact that the liquid crystal applied voltage VLC is kept at zero and that the liquid crystal is kept in a "light-off" state.

Thus, in this embodiment of the present invention, by means causing the transistor 740 to be turned "ON" periodically responsive to the timing signal VTMG, and by causing the electric charge stored in the liquid crystal capacitance CLC to be periodically initialized to zero when Vdata is zero, the response of the liquid crystal drive voltage VLC with respect to the voltage Vdata can be made higher, and an animated image and a still image can be displayed in a better condition when the animated image and the still image are displayed on the liquid crystal display panel responsive to the supplied image data.

In the above described embodiment of the present invention, the period of the timing signal VTMG used for the initialization period is so defined as to be equal to half of the voltage VCP applied to the opposed electrode 770. However, the period of the timing signal VTMG can be extended within the allowable range with respect to the response delay of the liquid crystal drive voltage VLC. In this case, it may be possible to make the wave form of the voltage VCP so that the center value of the intermediate value of the voltage VCP may be equivalent to the voltage VCNT at least when the timing signal VTMG is "H".

In the above embodiment, the period of the voltage VCP is selected to be 1/30 second. The period of the voltage VCP can be determined so as to be independent of the timing for writing data in the data hold circuit 120. In this case, though the period of the data writing timing of the data hold circuit 120 is subject to the length of the data, the period of the voltage VCP can be fixed to be a certain period. In addition, the period of the voltage VCP correlates with the flicker operation and the device power consumption. In this circumstance, if the period of the voltage VCP is selected to be shorter, the consumption of power increases while the flicker disturbance can be reduced due to an increase in the flicker frequency. In contrast, if the period of the voltage VCP is selected to be longer, the flicker disturbance will emerge while the device power consumption can be reduced as the AC frequency for driving the liquid crystal is lower.

Figure 27:
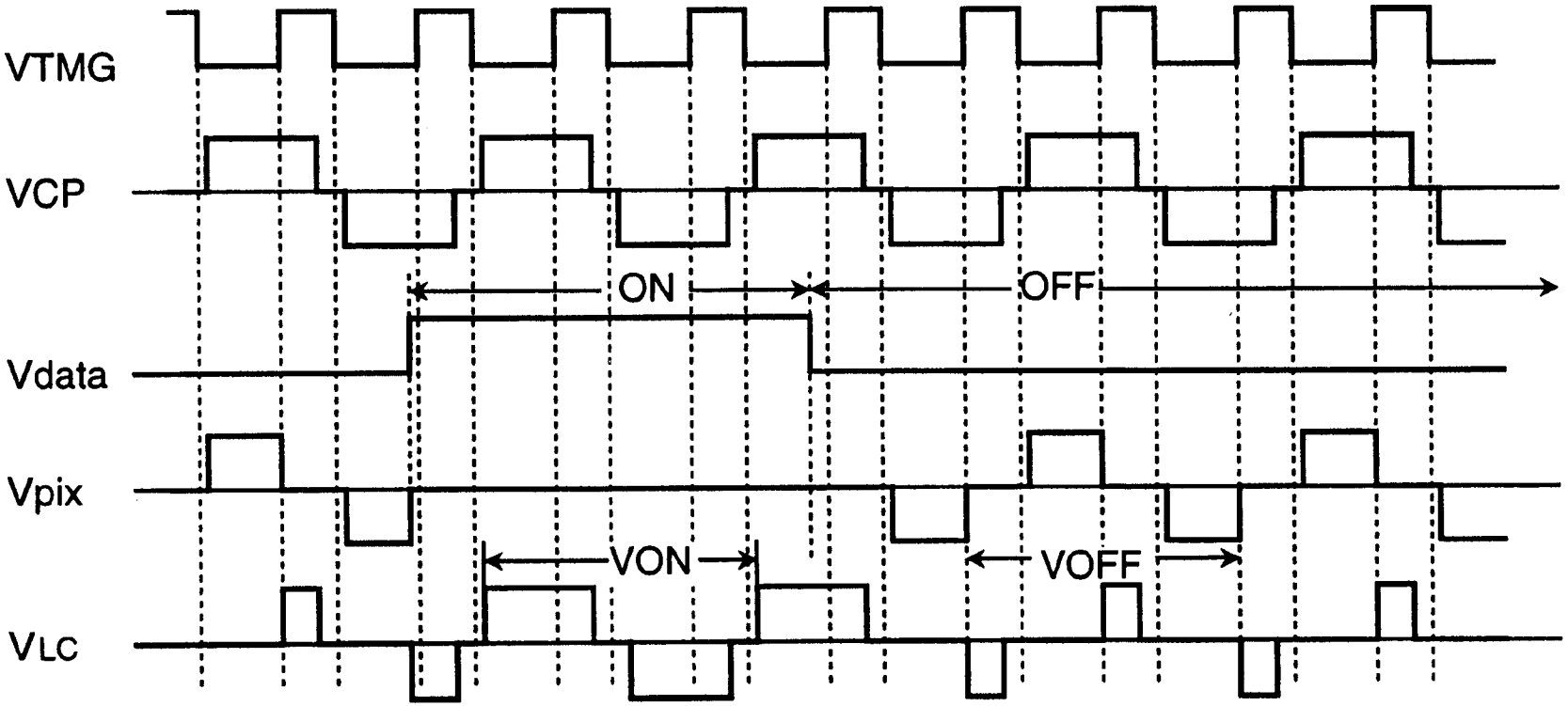
FIG. 27 is a timing chart illustrating the operation of another example of the pixel circuit.
Figure 29:
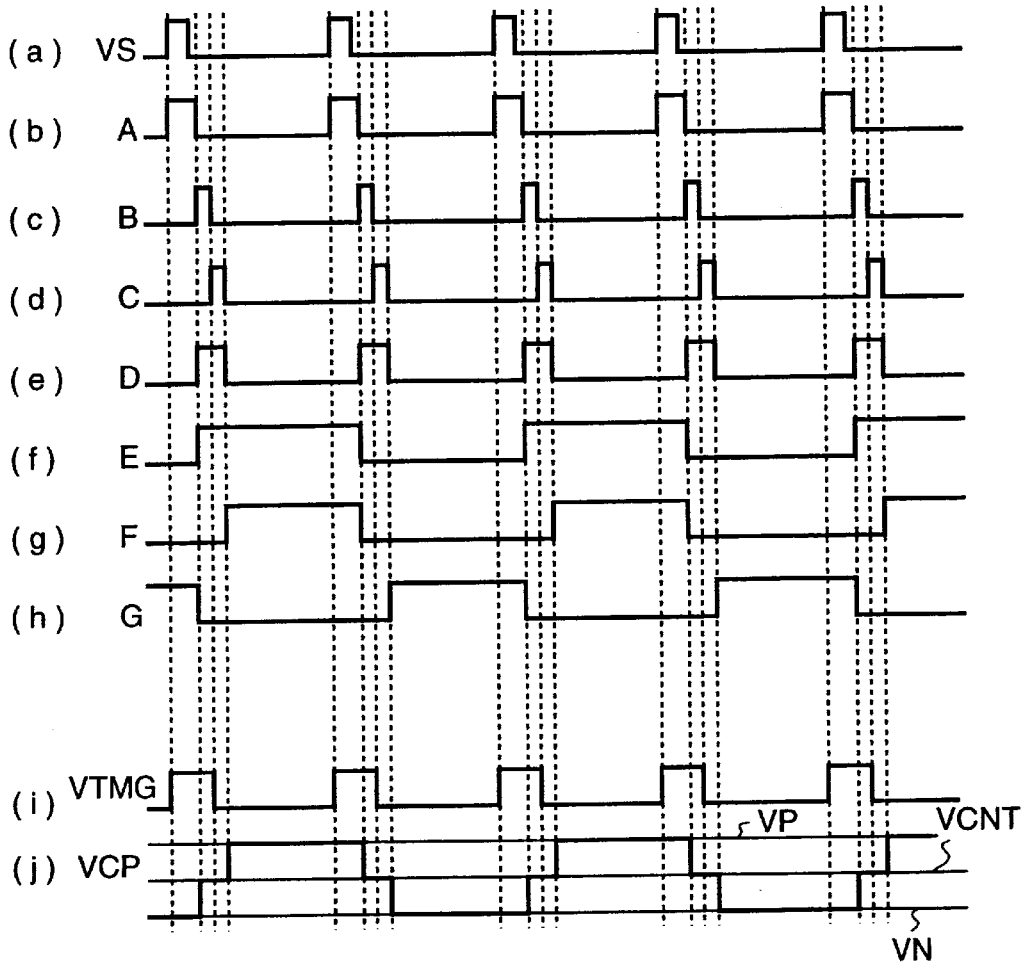
FIG. 29 is a timing chart illustrating the operation of the timing circuit and the alternating voltage circuit shown in FIG. 28.

Next, another embodiment of the present invention will be described by referring to FIGS. 27 and 29.

Figure 25:
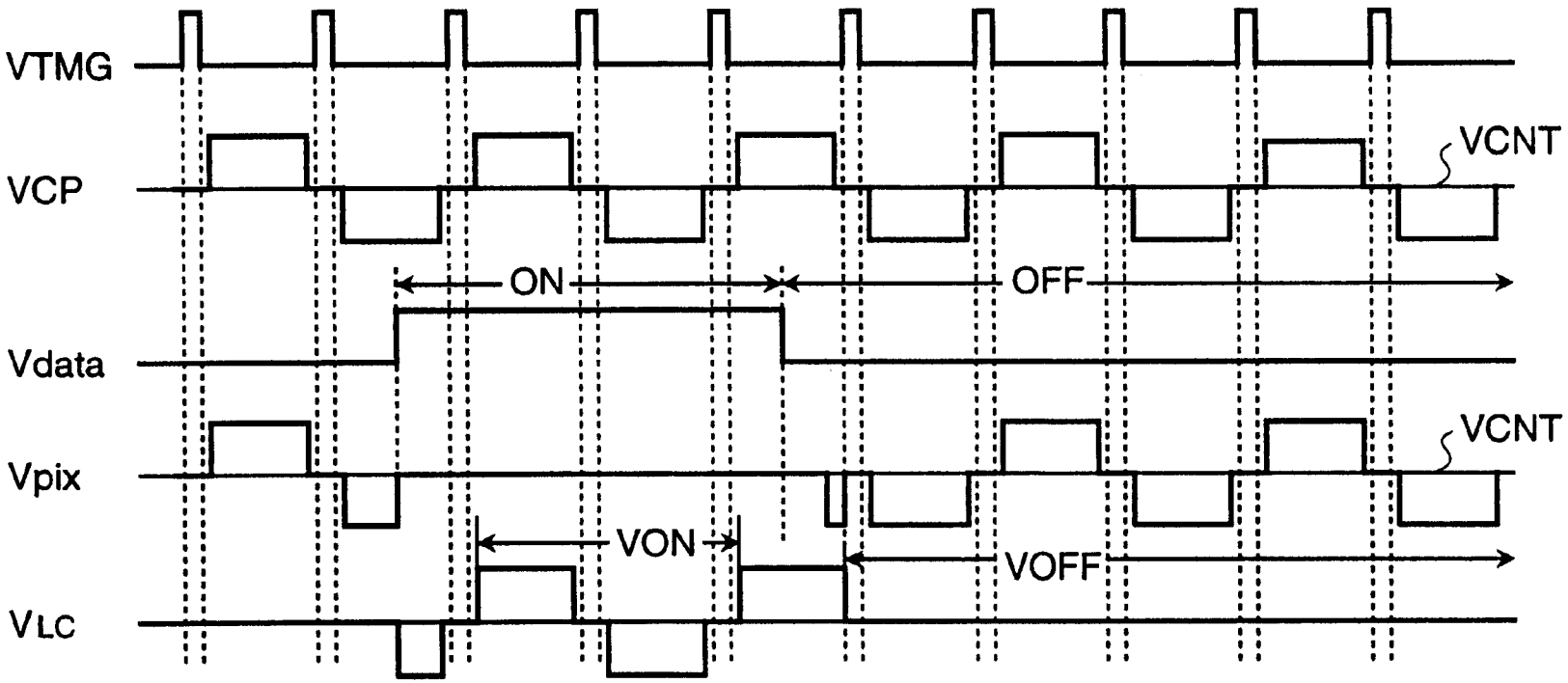
FIG. 25 is a timing chart illustrating the operation of the pixel circuit.

In this embodiment, the pulse width of the timing signal VTMG is shorter than the pulse width of the timing signal VTMG shown in FIG. 25. With this setting, even when the level of the voltage Vdata of the data hold circuit 120 is "L", the transistor 740 can be turned "ON" in a short period of time and, thus, the liquid crystal applied voltage VLC is defined to be the voltage VL equivalent to the threshold value of the liquid crystal shown in FIG. 26.

Figure 23:
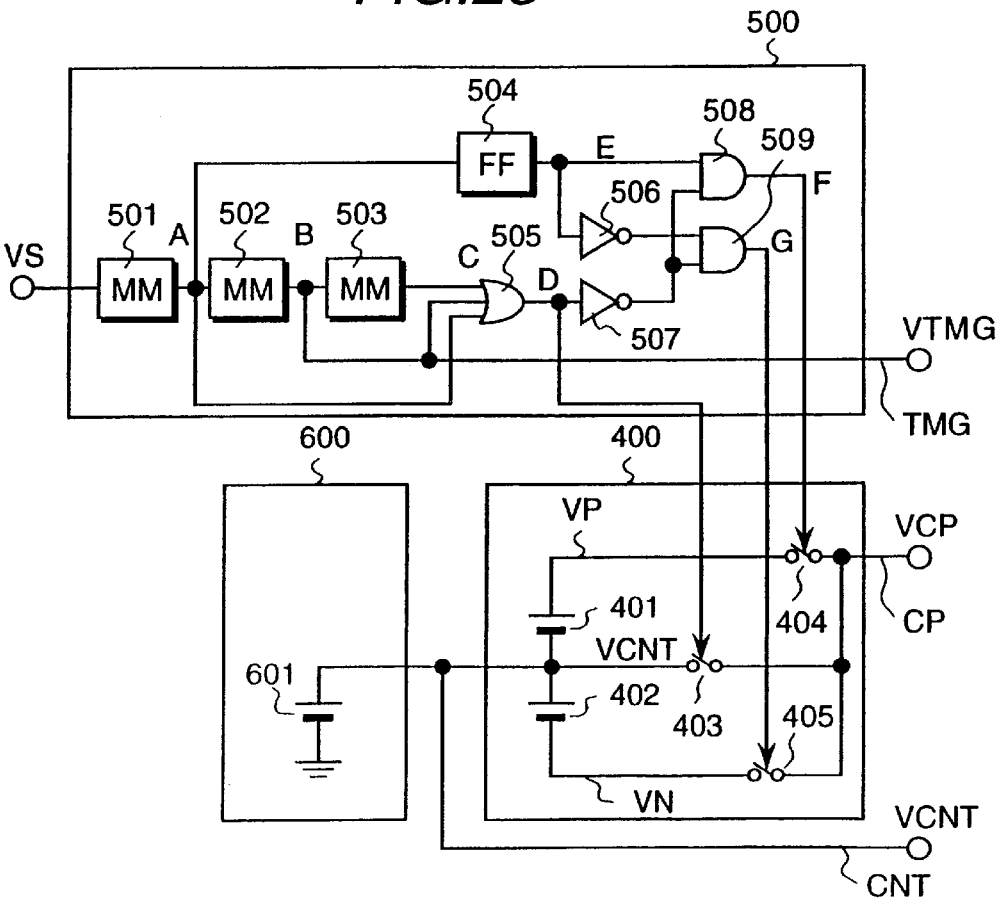
FIG. 23 is a circuit diagram of a timing circuit and an alternating voltage circuit used in the second embodiment of the present invention.
Figure 28:
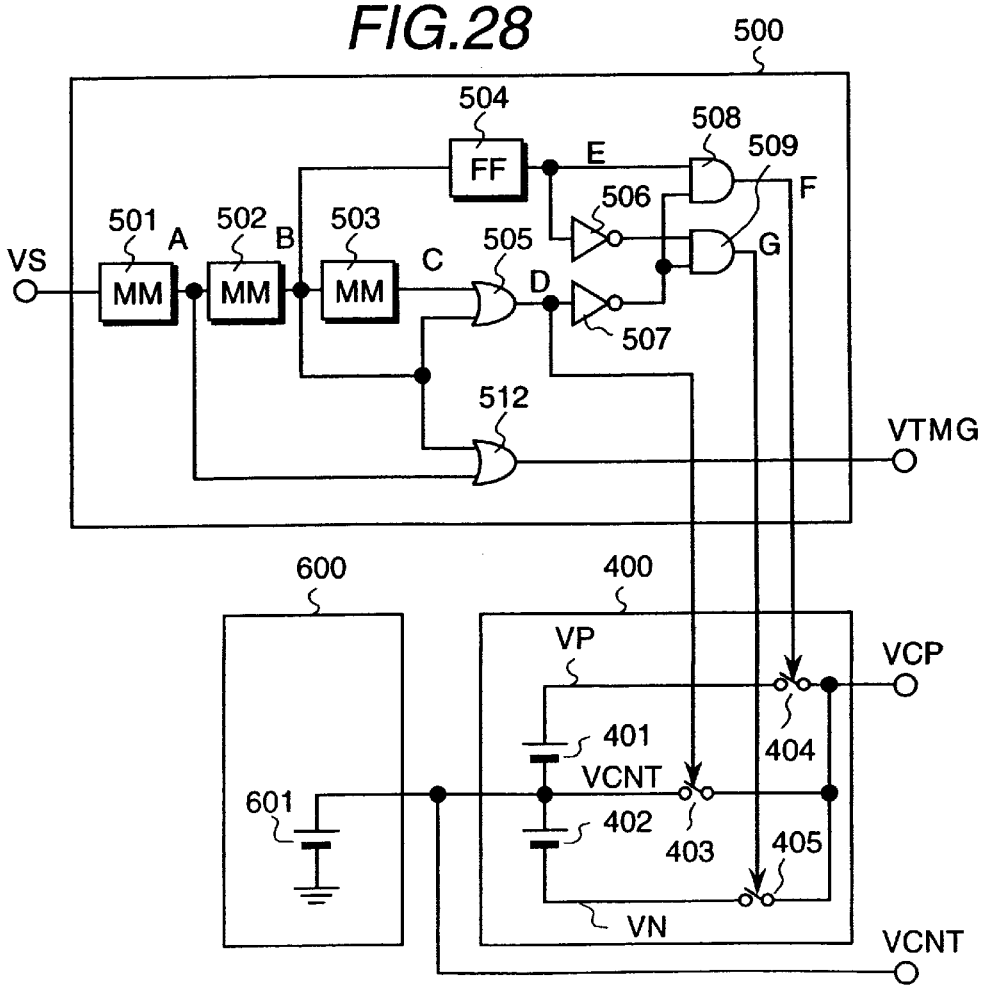
FIG. 28 is a circuit diagram of another example of the timing circuit and the alternating voltage circuit.

As for the detailed circuit structure, as shown in FIG. 28, OR gates 511 and 512 instead of OR gate 505 in FIG. 23 are installed in the timing circuit 500, in which the output pulses from the multi-vibrators 502 and 503 are input to the OR gate 511, the output pulses from the multi-vibrators 501 and 502 are input to the OR gate 512, and the output pulse from the multivibrator 502 is supplied to the flip-flop 504.

With the timing circuit 500 configured as described above, as shown in FIG. 29, when the signal level at the output terminals A and B is "H", the timing signal VTMG becomes "H". As for the AC voltage VCP, when the signal level at the output terminal F is "H", the AC voltage VCP reaches its maximum value VP, and when the signal level at the output terminal G is "H", the AC voltage VCP reaches its minimum value VN. This means that the timing signal VTMG is to become "H" at the positive or negative timing with respect to the center voltage VCNT of the AC voltage VCP.

In the above circuit structure, when the voltage Vdata pf the data hold circuit becomes "H" and then the transistor 30 is turned "ON", the voltage Vpix of the display electrode 50 becomes the center voltage VCNT, and the AC voltage VCP is applied directly to the liquid crystal and the liquid crystal turns on.

Next, the voltage Vdata changes from "H" to "L", and then, the transistors 30 and 40 are turned "OFF" together when the timing signal VTMG becomes "L". At this timing, the voltage Vpix is equivalent to the center voltage VCNT, and the voltage VCP is applied to the liquid crystal. After that, when the timing signal VTMG changes from "L" to "H", the transistor 740 is turned "ON", and then its voltage is applied directly to the liquid crystal if the level of the AC voltage VCP is different from the level of the voltage VCNT. In the state that the timing signal VTMG is maintained at "H", when the level of the voltage VCP is changed to the level of the center voltage VCNT, then the electrode 750 is made to be connected to the reference line CNT, and the electric charge of the liquid crystal capacitance (transmittance capacitance) CLC is initialized to be zero.

After this operation, in the state that the voltage Vdata is "L", when the timing signal VTNG changes to "H" periodically, the transistor 740 is turned "ON" periodically when the level of the AC voltage VCP is at a level different from the level of the center voltage VCNT, and finally, as shown by the arrow B in FIG. 26, the voltage between the saturated voltage VH and the threshold voltage VL is applied to the liquid crystal as the liquid crystal drive voltage VLC, and the liquid crystal turns off.

In this embodiment, as the liquid crystal drive voltage VLC is initialized periodically to be zero, the response of the liquid crystal drive voltage VLC with respect to the change in the voltage Vdata can be increased, and hence, a smooth display operation of an animated image and a still image can be established. And furthermore, since a liquid crystal drive voltage VLC between the saturated voltage VH and the threshold voltage VL may be applied to the liquid crystal even when the voltage Vdata is "L", the response speed of the liquid crystal can be increased beyond than that in the previous embodiment. In case of applying this embodiment to color display devices, since the white balance can be optimized by adjusting the threshold value VL for the individual color components, a liquid crystal display apparatus with high-speed and high-quality resolution can be realized.

Figure 30:
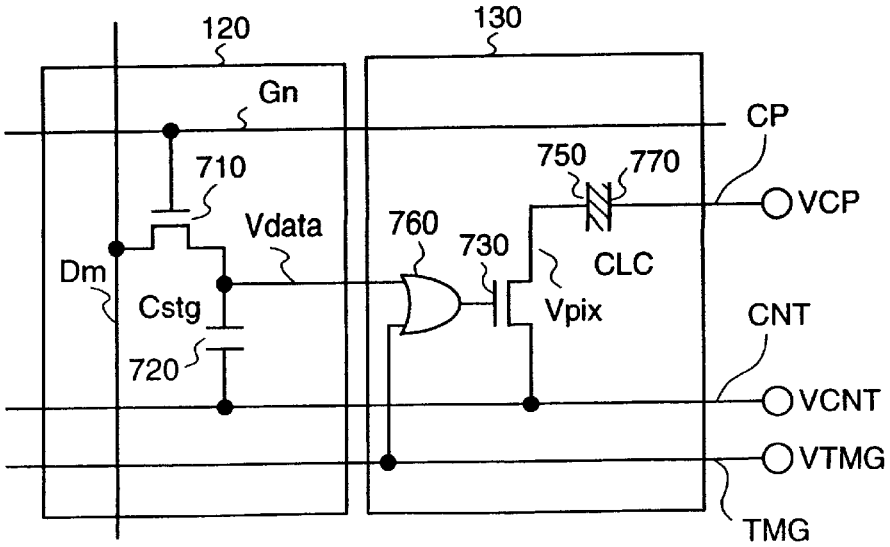
FIG. 30 is a circuit diagram of another example of the pixel circuit.

FIG. 30 shows a circuit configuration yet another embodiment of the pixel circuit 100 in the present invention.

In the pixel circuit 100 shown in FIG. 30, the OR gate 760 is used as the logic device instead of the transistor 740 shown in FIG. 22, in which the OR gate 760 is placed at the gate side of the transistor 730, one input terminal to the OR gate 760 is connected to the source of the transistor 710, the other input terminal to the OR gate 760 is connected to the timing line TMG, and its output terminal is connected to the gate of the transistor 730.

In this embodiment, as the OR gate 760 is turned "ON" when the signal level of either the voltage Vdata or the timing signal VTMG becomes "H", the same effect as shown in FIG. 22 using the pixel circuit 100 can be obtained.

In this embodiment, the transistor 730 is only a transistor connected to the display electrode 750. With this circuit configuration, the leakage current and the noise can be further reduced in comparison with the circuit configuration including a pair of transistors connected to the display electrode 710, and hence, this circuit configuration contributes to the establishment of a higher quality of display images so far.

In the individual embodiments of the present invention described above, the center voltage VCNT is used as the voltage applied to the reference line CNT. As for the voltage applied to the reference line CNT, the average voltage equivalent to the average value of the AC voltage VCP or zero value bias voltage can be used.

In case of displaying still images in the individual embodiments of the present invention, the device consumption of power can be reduced by extending the period for initialization.

In the individual embodiments, as the voltage for the liquid crystal drive voltage VLC can be controlled independently with respect to the threshold voltage VL and the saturation voltage VH, respectively, good color balance conditions can be established in case of displaying color images. That is, by varying the amplitude value of the voltage VCP, both the voltage corresponding to the saturation voltage VH and the voltage corresponding to the threshold voltage VL can be adjusted. On the other hand, by changing the pulse width of the timing signal VTMG, only the voltage corresponding to the threshold voltage VL can be adjusted. Therefore, the drive voltage can be adjusted for the saturation voltage by changing the amplitude value of the voltage VCP when Vdata is "H", and the drive voltage can be adjusted for the threshold voltage by changing the pulse width of the timing VTMG.

As described above, according to the present invention, as the electric charge stored in the liquid crystal may be initialized periodically, when the liquid crystal driving voltage changes responsive to the image data, its change rate may be raised higher, and animated images and still images can be displayed in good conditions.

Figure 31:
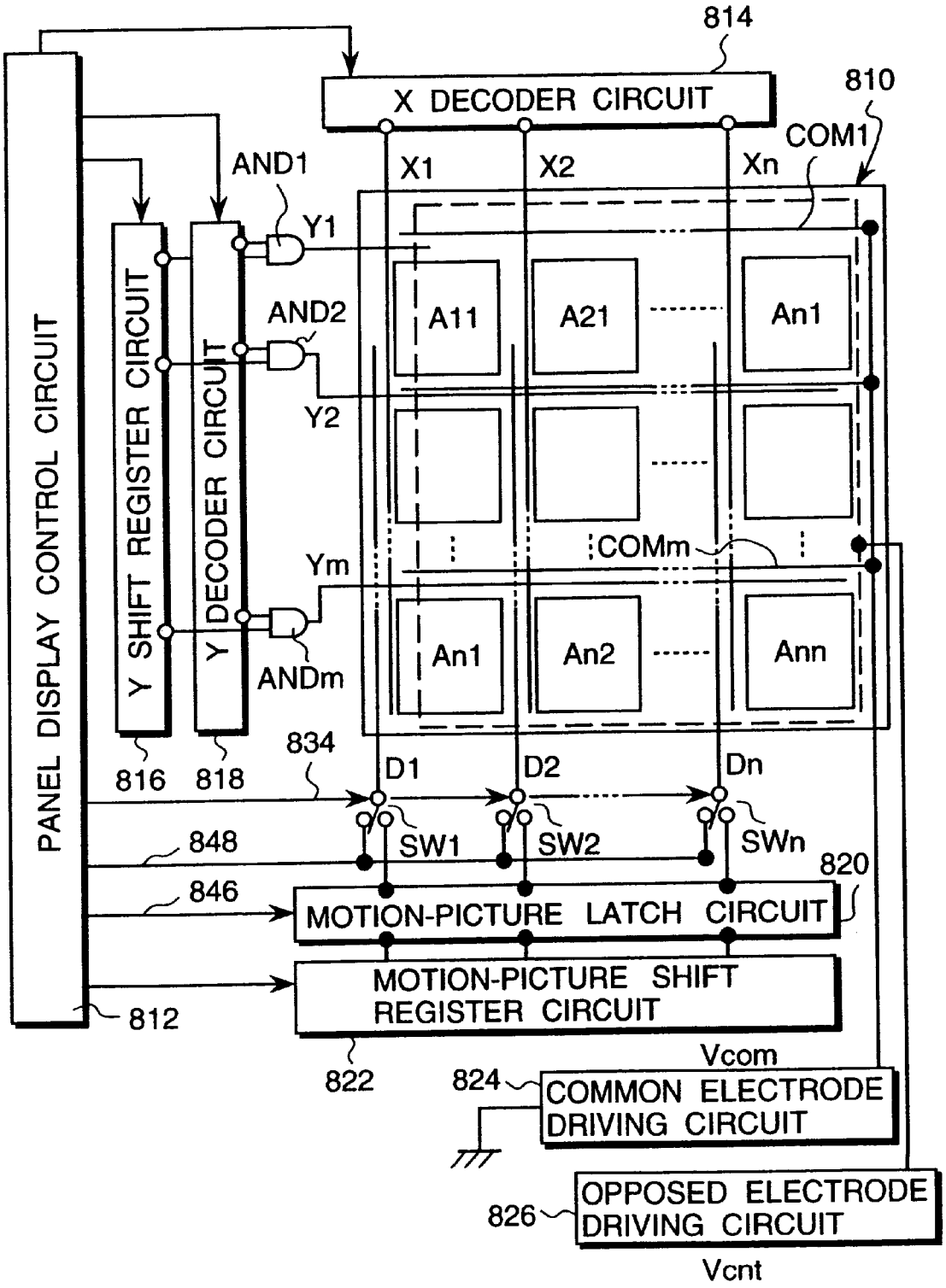
FIG. 31 is a block diagram showing the whole configuration of a liquid crystal display apparatus according to a third embodiment of the present invention.

In FIG. 31, the liquid crystal display apparatus is provided with a color panel 810 having 640×480 dots as a TFT active matrix type liquid crystal display. While in this embodiment only a color panel 810 and its peripheral circuits are shown, the specific configuration such as an optical system is abbreviated. The color panel 810 has a pair of substrates (not shown) of which at least one is transparent. The substrates are arranged so as to oppose each other through a layer of liquid crystal (not shown). A plurality of scanning electrode wires (Y-direction electrode wires) Y1 to Yn and a plurality of signal electrode wires (X-direction electrode wires) X1 to Xn intersecting in a matrix array with the scanning electrode wires are spread out over a surface of the substrate. Further, a plurality of display areas All to Ann surrounded by 480 scanning electrode wires Y1 to Yn and 640 signal electrode wires X1 to Xn are formed on a front surface of the color panel 810. Display electrodes, opposed electrodes, switching devices for static pictures, switching devices for motion pictures, a control circuit for the static pictures and a control circuit for the motion pictures are provided on each of the display areas, and in the neighborhood of each of the display areas, the common electrode wires COM1 to COMn are formed in parallel with the scanning electrode wires, and the picture data electrode wires D1 to Dn are formed in parallel with the signal electrode wires. The electrode wires are insulated from and connected to one another.

The color panel 810 is provided with a panel display control circuit 812, an X decoder circuit 814, a Y register circuit 816, a Y decoder circuit 818, data selecting switches SW1–SWn, a motion picture latch circuit 820, a motion picture shift register circuit 822, a common electrode driving circuit 824, and an opposed electrode driving circuit 826. The common electrode driving circuit 824 is connected to the common electrode wires COM1 to COMn, and the opposed electrode driving circuit 826 is connected to the opposed electrode in each display area.

The panel display control circuit 812 includes a control means display for controlling all of the peripheral circuits based on command and a motion picture display area designating means for designating a specified display area within the display area as a motion picture display area. The X decoder circuit 814 produces liquid crystal driving signals for static and motion pictures based on the panel display control circuit 812. The X decoder circuit includes a liquid crystal driving signal output means for a static picture to output a liquid crystal driving signal for a static picture to each of the signal electrode wires X1 to Xn in synchronization with scanning pulses applied to the scanning electrode wires when a static picture is displayed, and includes a liquid crystal driving signal output means for a motion picture to output a liquid crystal driving signal for a motion picture to a designated signal electrode wire Xi in synchronization with scanning pulses applied to the scanning electrode wires when a motion picture is displayed.

The Y shift register circuit 816 includes a Y decoder circuit 818, 2-input AND logic circuits AND1 to ANDn for pixel selection, and a scanning pulse output means for static pictures to output serially scanning pulses to a designated scanning electrode wire based on the signal from the panel display control circuit 812.

Figure 32:
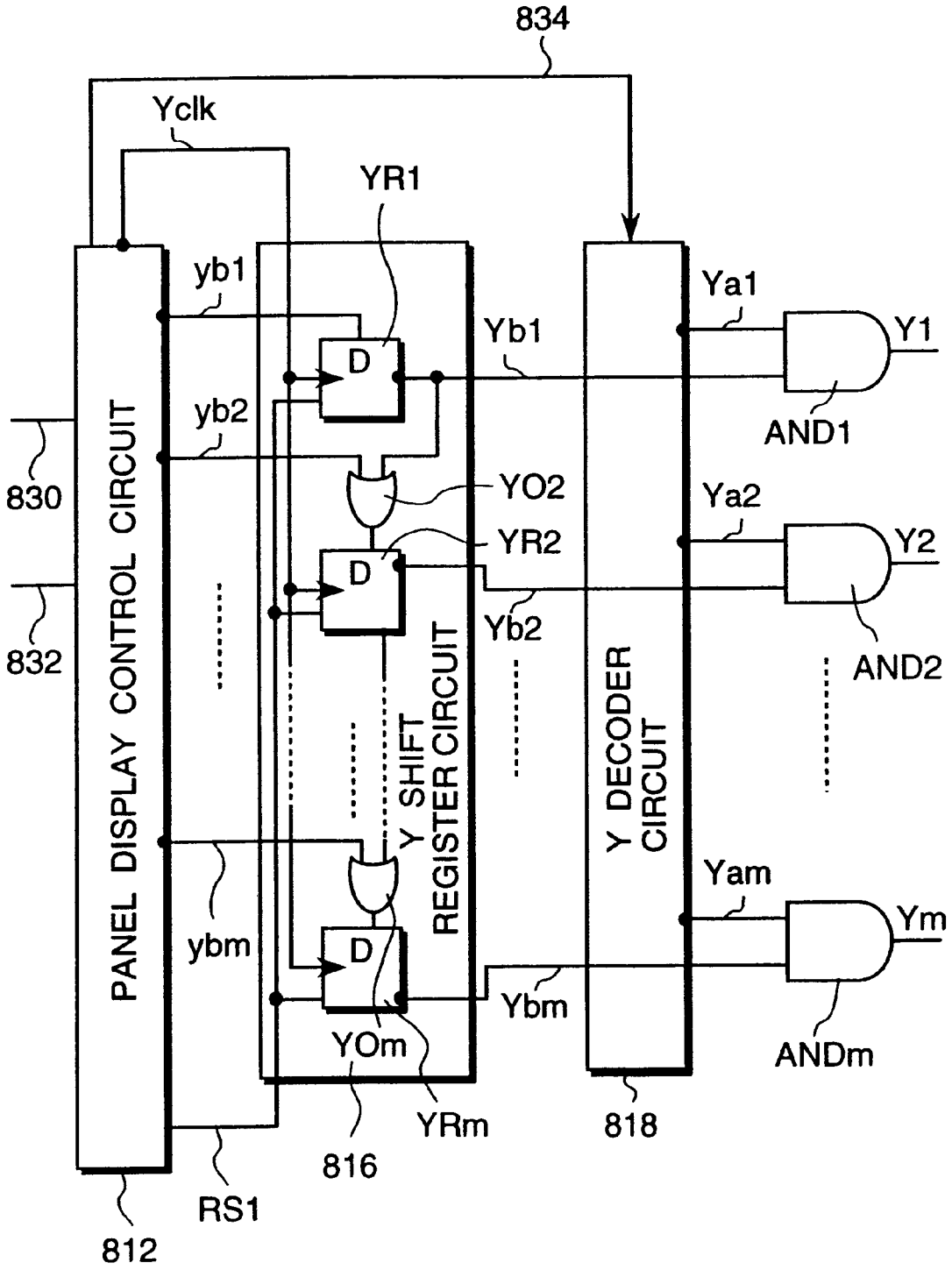
FIG. 32 is a schematic diagram showing the configuration of a Y shift register circuit used in the third embodiment of the present invention.

More specifically, the Y shift register circuit 816 comprises shift register circuits YR1 to Yrm, and 2-input OR circuits Y02 to YOm as shown in FIG. 32. The Y shift register circuit 816 is connected to a panel display control circuit 812 through a clock electrode wire Yclk, start pulse electrode wires ycl to yam and a reset electrode wire RS1, and is connected to the logic circuits AND1 to ANDm through output electrode wires Ybl to Ybm. The panel display circuit 812 outputs 480 clock pulses to the clock electrode wire Yclk every one frame, and selects the start pulse electrode wire corresponding to a start position of the scan based on a signal input to a scanning start number electrode wire 830. Further, the circuit 812 outputs the start pulse to the selected start pulse electrode wire, and outputs a reset signal to the reset electrode wire RS1 when the shift register circuit is set, corresponding to the number designated by a signal input to the scanning number electrode wire 832. Namely, the Y shift register circuit 816 sets the start pulse from the start pulse electrode wire ybi designated by the panel display control circuit 812 in synchronization with clock pulses, and outputs the set pulses to an OR circuit Yoi via an output electrode wire Ybi as the scanning pulse. The scanning pulses corresponding to the designated scanning number are sequentially output to the output electrode wire Ybi. The Y decoder circuit 818 is connected to the panel display control circuit 812 through the address electrode wire 834, and outputs the Y address data to the address signal wires Yal to Yam in response to the address signal from the panel display control circuit 812. The logic circuits AND1 to ANDm output a scanning pulse, according to the logic product of the scanning pulse from the Y shift register circuit 816 and the Y address data from the Y decoder circuit 818, to the scanning electrode wires Yl to Ym. In this case, if every scanning wire is designated, the scanning pulse is applied to every scanning wire, and if the specified scanning electrode wire is designated due to signals from the scanning start electrode wire 830 and the scanning number electrode wire 832, the scanning pulse is applied only to the designated scanning electrode wire.

Figure 33:
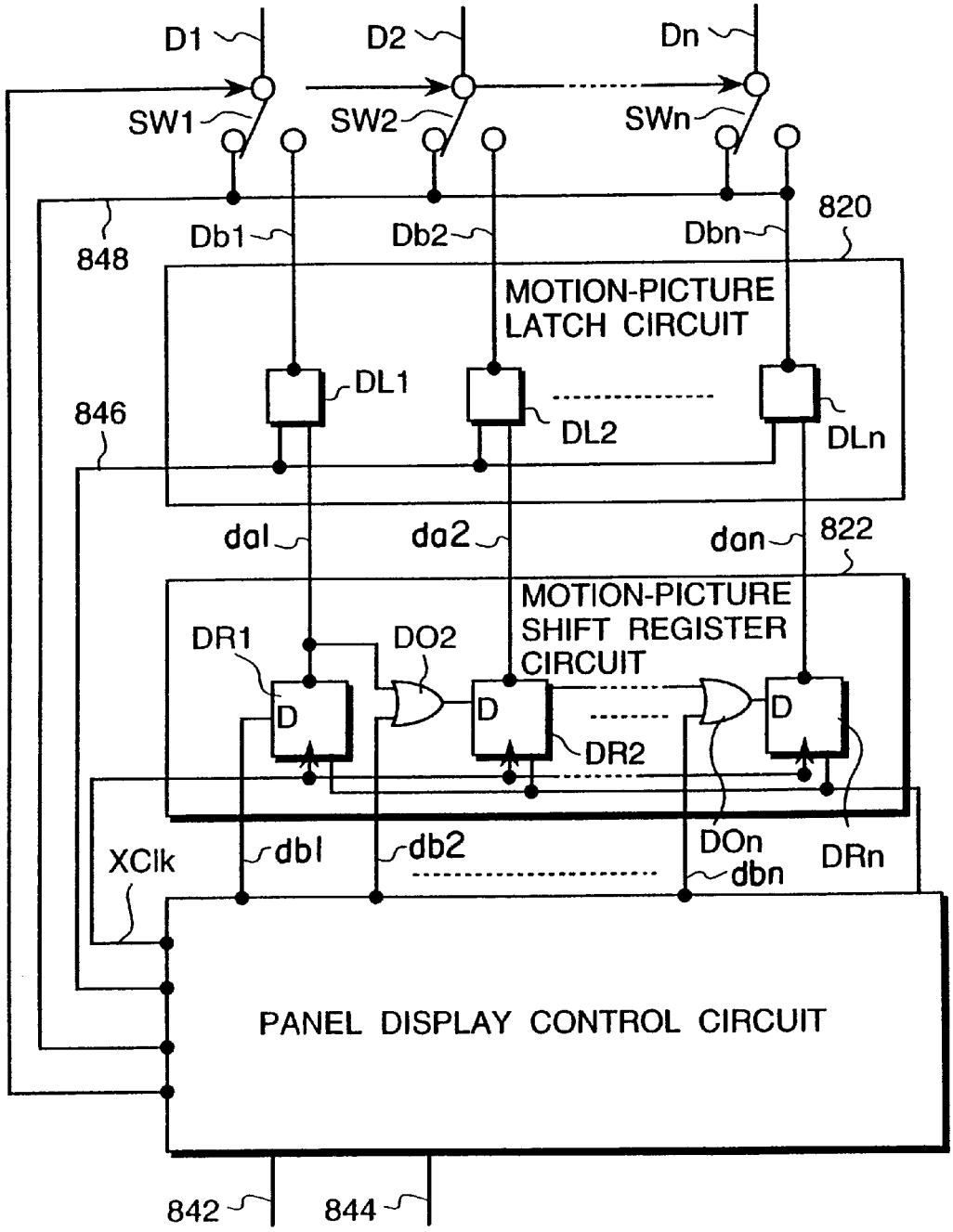
FIG. 33 is a schematic diagram showing the configuration of a motion picture signal circuit.

FIG. 33 shows the configuration of a motion picture signal circuit. Each of a motion picture latch circuit 820 and a motion picture shift register circuit 822 is configured as a motion picture data output means for outputting motion picture data only to a designated display area, based on a signal from the panel display control circuit 812. More specifically, as shown in FIG. 33, the motion picture latch circuit 820 includes 640 latch circuits DLl to DLn, and the motion picture shift register 822 includes shift register circuits DR1 to DRn and 2-input OR circuits DO2 to DOn. Further, the motion picture shift register 822 is connected to the panel display control circuit 812 through the clock electrode wire Xclk, the start pulse electrode wire dal to dan and the reset electrode wire RS2. The panel display control circuit 812 outputs sequentially the clock pulses to the clock electrode wire Xclk. The clock pulses are output sequentially at the same timing as the sequential output of 640 motion picture data when the scanning pulse is applied to the scanning electrode wire.

Furthermore, the panel display control circuit 812 outputs the start pulse to the start pulse electrode wire corresponding to the scanning stars number designated by a signal from the scanning start number electrode wire 842, and outputs the reset pulse to the reset electrode wire RS2 when the shift register circuits to the number designated by an input signal of the scanning number electrode wire 844. Namely, the motion picture shift register circuit 822 outputs the start pulse to the OR circuit DOi in the next stage as the scanning pulse, the start pulse being input to the start pulse electrode wire corresponding to the scanning start number out of the start pulse electrode wire dal to dan. Therefore, only the scanning pulse from the shift register circuit DRi corresponding to the designated motion picture area is output from the motion picture shift register circuit 822. The motion picture latch circuit 820 connected to the panel display control circuit 812 through the motion picture analog signal wire 846, latches the motion picture data input from the motion picture analog signal wire 846 in response to the pulse from the output electrode wire dbi, and outputs the latched motion picture data on the motion picture electrode wires Dbl to Dbn. Namely, the motion picture data from the motion picture latch circuit 820 is output to the motion picture electrode wire corresponding to the motion picture display area out of the motion picture electrode wires Dbi to Dbn. And then, the motion picture data is output to the picture data electrode wires D1 to Dn through the data selecting switches SWl to SWn.

The data selecting switches SWl to SWn operate as the picture data selecting circuit. The data selecting switches select the static picture data when a static picture is displayed and the motion picture data when a motion picture is displayed, and outputs any of the selected picture date to the picture date electrode wires Dl to Dn.

Figure 34:
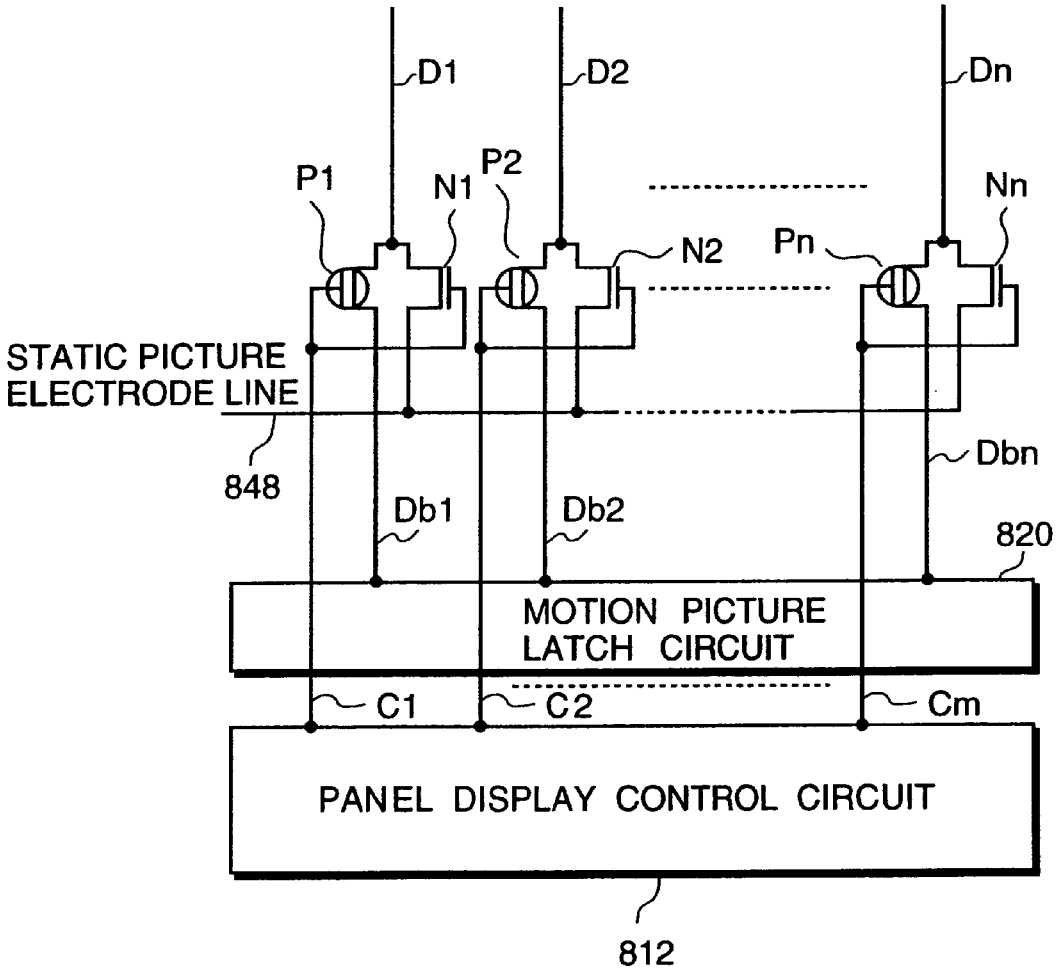
FIG. 34 is a schematic diagram showing the configuration of a picture data selecting switch circuit.

More specifically, as shown in FIG. 34, each of the data selecting switches SW1 to Swn is provided with p-type TFTS or transistors P1 to Pn and e-type TFTs or transistors N1 to Nn. The gate of each of the transistors is connected to the panel control circuit 812 through the selecting signal electrode wires C1 to Cm, and the source thereof is connected to the picture data electrode wires D1 to Dn. Further, the drain of each of the transistors P1 to Pn is connected to the motion picture latch circuit 820 and the drain of each of the transistors Nl to Nn is connected to the static picture electrode wire 848. The transistors N1 to Nn turn "ON" when the level of the selecting signal electrode wire Ci becomes "H during the display of a static picture, and the static picture data is output from the static picture electrode wire 848 to the picture data electrode wire D1 to Dn. While, the transistors P1 to Pn turn "ON" when the level of the selecting signal electrode wire Ci becomes "L" during the display of a motion picture, and the motion picture data is output from the motion picture latch circuit 820 to the picture data electrode wire D1 to Dn.

Figure 35:
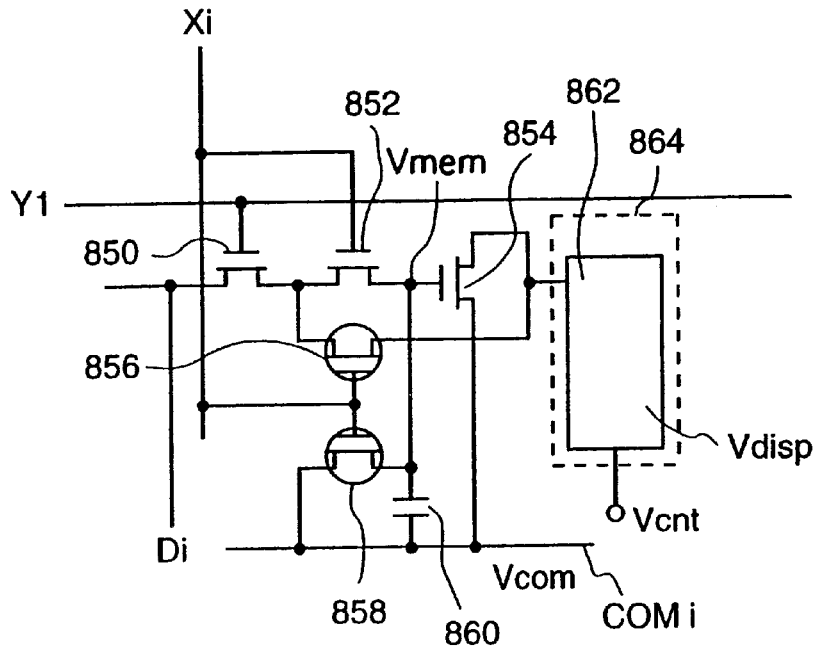
FIG. 35 is a schematic diagram showing the configuration of a display region.

As shown in FIG. 35, n-type TFTs or transistors 850, 852, 854, p-type TFTs or transistor 856, 858, a capacitor 860 for holding the display data, a display electrode 862, and an opposed electrode 864 are provided in each of display areas All to Ann. The display electrode 862 or transparent electrode is arranged to face the opposed electrode 864 through a liquid crystal layer sandwiched between them. The alternating voltage Vcnt is applied to the opposed electrode 864. The display electrode 862 is connected to the transistor 854. The transistor 854 or switching device for the static picture has a source connected to the display electrode 862, a drain connected to the common electrode wire COMi and a gate connected to the source of the transistor 852 and the common electrode wire COMi through a capacitor 860. The transistor 852 is connected in series with the transistor 850. A gate of the transistor 852 is connected to the signal electrode wire Xi and its drain is connected to the source of the transistor 850 and the drain of the transistor 856. A gate of the transistor 850 is connected to the scanning electrode wire Yi and its drain is connected to picture data electrode wire Di. The transistor 850, 852, and capacitor 860 forms a control circuit for the static picture to control the ON state of the transistor 854.

Figure 36:
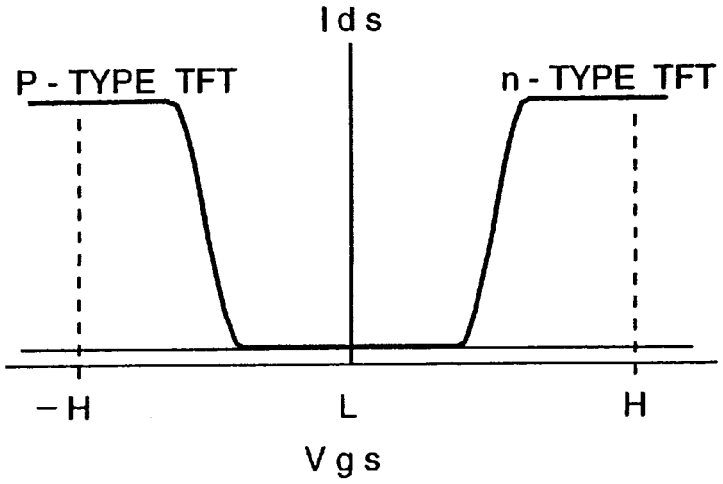
FIG. 36 is a graph showing Vgs–Ids characteristics of the TFT.

The transistor 856 operates as a switching device for a motion picture. The source of the transistor 856 is connected to the display electrode 862, its drain is connected to the source of the transistor 850 and its gate is connected to the gates of the signal electrode wire Xi and a transistor 858. A drain of the transistor 858 is connected to the gate of the transistor 854, and its source is connected to the common electrode wire COMi. As seen from FIG. 36, the transistors 850 to 854 each turns to the "ON" state only when the level of the voltage applied to the gate is at "H". Similarly, the transistors 856 to 858 each turns to the "ON" state only when the level of the voltage applied to the gate is at "−H". Otherwise, a "OFF" state occurs. The transistor 858 forms scanning circuit for a motion picture, along with transistors 850, 852.

Figure 37:
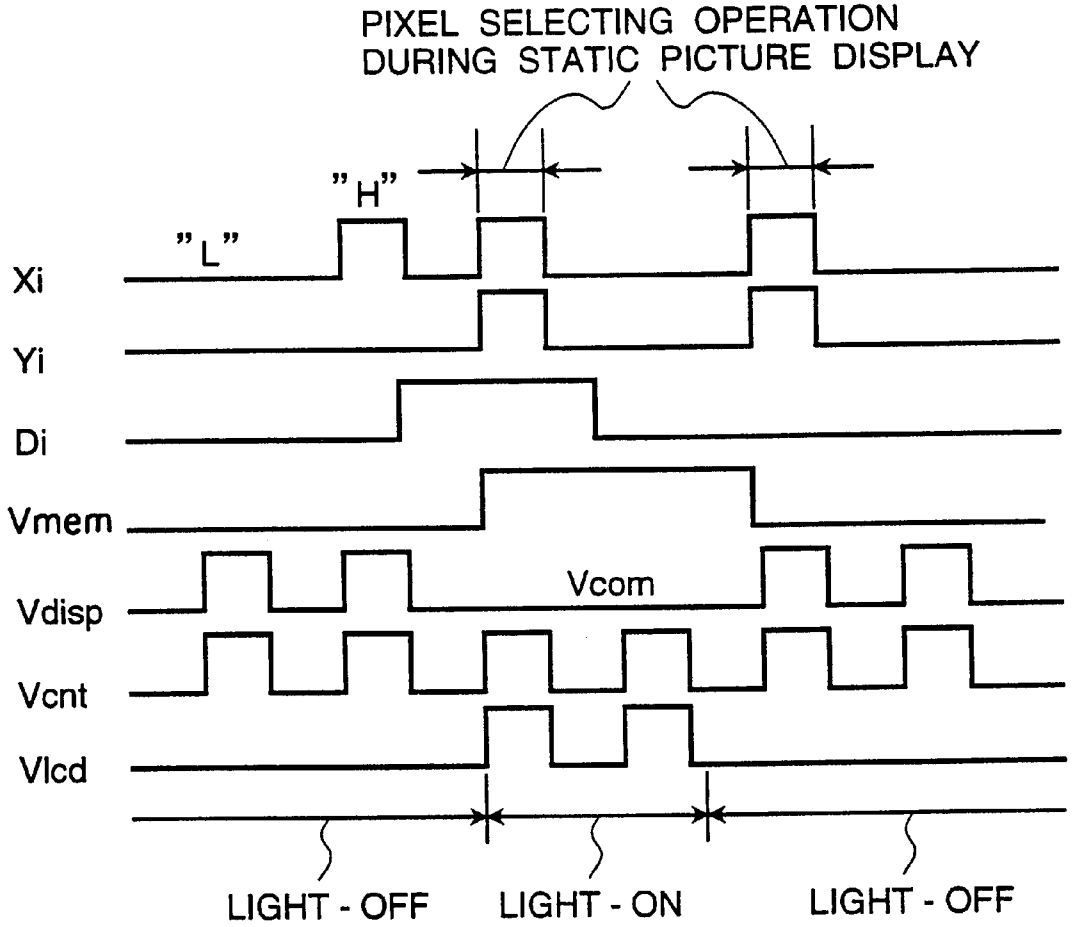
FIG. 37 is a timing chart illustrating the write-in state of a static picture.

An operation state in which a static picture is displayed in each of the display regions will be explained on the basis of the timing chart shown in FIG. 37. In FIG. 37, Vdisp designates an electric potential of the display electrode 862, and Vlcd designates a voltage applied to the liquid crystal sandwiched between the display electrode 862 and the opposed electrode.

In FIG. 37, when a static picture is displayed, the static picture data is selected by using the data selecting switches SWi. If both of the levels of the signal electrode wire Xi and the scanning electrode wire Yi become "H" when the electric potential of the picture data electrode wire Di is at "H", both transistors 850, 852 turn "ON". As a result, the transistor 854 turns "ON" according to the static picture data from the picture data electrode wire Di. At this time, the gate potential Vmem of the transistor 854 turns to "H", and the static picture data is charged to the capacitor 860. Further, due to the "ON" state of the transistor 854, the electric potential Vdisp of the display electrode 862 becomes the same potential as the potential Vcom of the common electrode wire. Because an alternating voltage Vcnt is applied to the opposed electrode 864, the difference voltage Vlcd between the voltages Vdisp and Vcnt is applied to the liquid crystal, and thus the liquid crystal may turn on. If the liquid crystal (pixel) is lighted due to such a pixel selecting operation, the liquid crystal once being lighted maintains a lighting state for a long time because the picture data is held for a long time by the capacitor 860. The holding time depends upon the leakage current of the transistor 854 and the capacity of the capacitor 860. Normally, the leakage current of a transistor is very small. Accordingly, the holding time is far longer than the typical frame time of 16.7 ms.

Since the liquid crystal once lighted on keeps holding the light-on state for a predetermined time, it is, therefore, not necessary to apply a voltage due to the same picture data every one frame (16.7 ms) when it is not required to change the state of the liquid crystal. Accordingly, because it is not necessary to charge and discharge the capacity formed by the wires and the liquid crystal facing the opposed electrode and the capacity formed at the wire intersecting portion of electrode wires in every frame, the power consumption can be reduced.

On the other hand, when the level of the picture data turns to "L" under the "ON" state of the transistors 850, 852 during the pixel selecting operation, the gain Vmem at the gate of the transistor 854 turn to "L", the electric charges being charged in the capacity 860 discharge, and thus the transistor 854 turns to the "OFF" state. Because the voltage Vdisp becomes the same potential as Vcnt at this time, the voltage applied to the liquid crystal becomes interrupted, and thus the liquid crystal takes the state of "LIGHT-OFF".

As described above, when both the signal electrode wire Xi and the scanning electrode wire Yi become "H" during the display of a static picture, and the pixel selecting operation is carried out, the liquid crystal is lighted when the static picture data "H" is input to the picture data electrode wire Di, and the liquid crystal is turned off when the data "L" is input to it. Because in this case, the liquid crystal once lighted (displayed) keeps lighting, it is not necessary to perform periodically the pixel selecting operation to display the static picture. Accordingly, such an operation is performed only when a new static picture is written in. Accordingly, because it is not necessary to charge and discharge the capacity formed by the wires and the liquid crystal facing the opposed electrode and the capacity formed at the wire intersecting portion in every frame when the static picture is displayed, the power consumption can be reduced.

Figure 38:
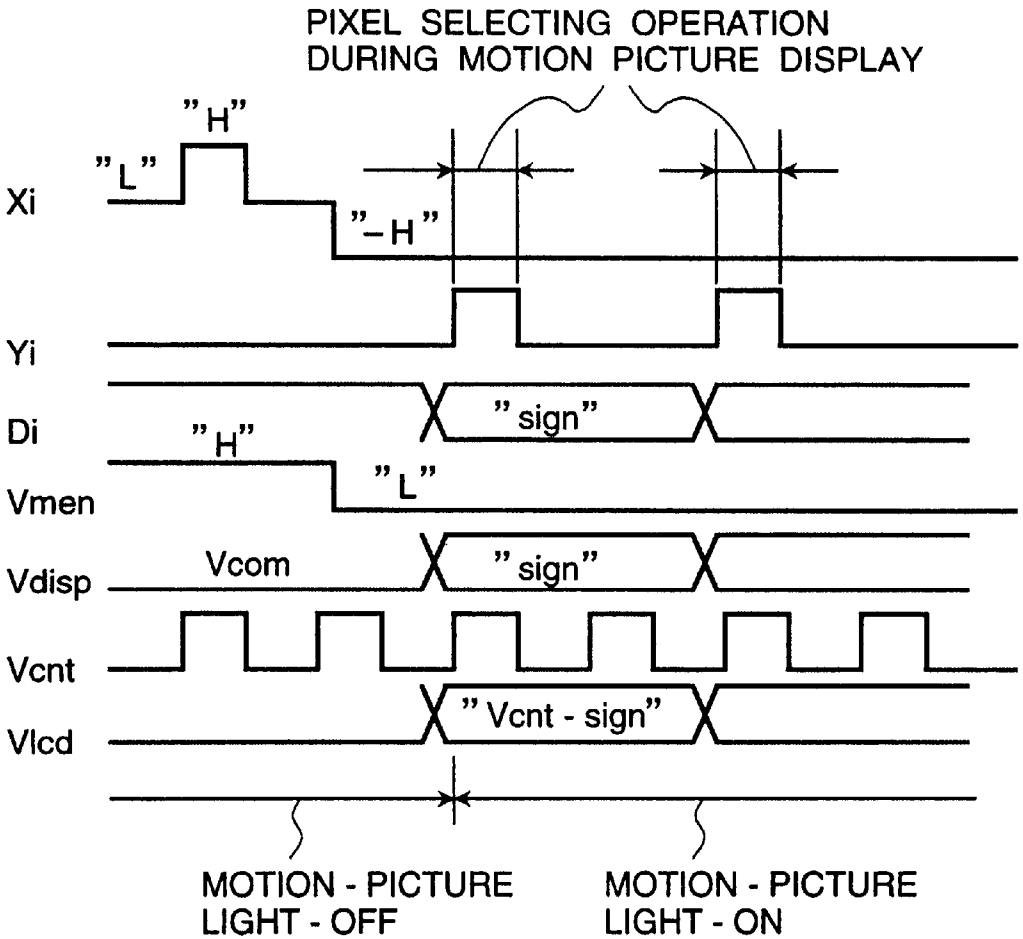
FIG. 38 is a timing chart illustrating the write-in state of a motion picture.
Figure 39:
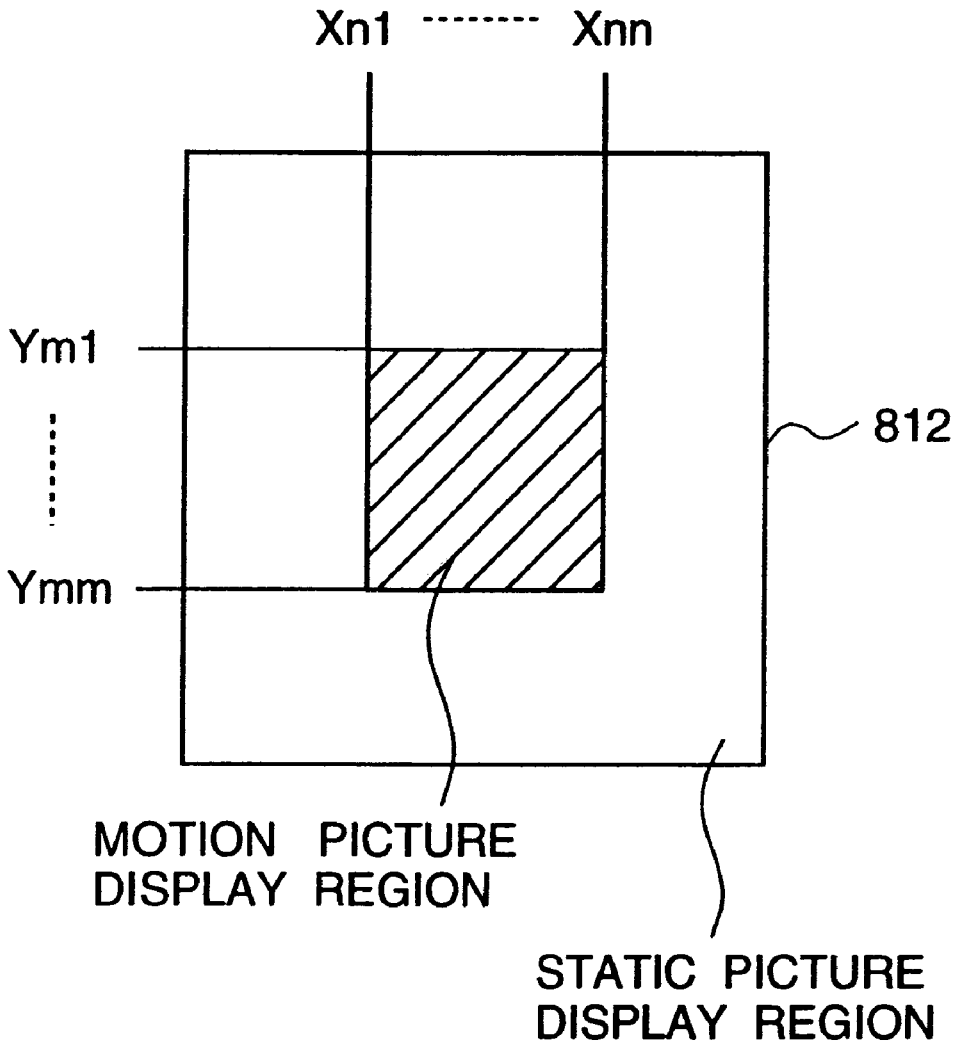
FIG. 39 is a diagram of a setting state of the display regions of the static picture and the motion picture.

An operation state in which a motion picture is displayed in each of the display regions will be explained on the basis of the timing chart shown in FIG. 38. If "sig n" is input to the picture data electrode wire Di as a motion picture data due to the selecting operation of the data selecting switch SWi, when the level of the voltage of the signal electrode wire Xi becomes "−H" and the level of the voltage of the scanning electrode wire Yi becomes "H", the transistors 850, 856, 858 turn to "ON", and the motion picture data is applied to the display electrode 862. At this time, the transistor 852 is at an "OFF" state. Therefore, Vmem turns to "L", and the transistor 854 turns "ON".

The picture data, such as static pictures, being charging in the capacitor 860 is discharged when the transistor 858 turns "ON". The voltage Vlcd applied to the liquid crystal is the difference voltage Vcnt−Vdisp between the voltages Vent and Vdisp. The liquid crystal is lighted based on the difference voltage, namely, the motion picture is displayed. It should be noted that the optimum motion picture can be displayed without flicker by setting the time interval of the selection of motion pictures to 1/60 second.

The static picture and the motion picture can be displayed, respectively, at a static and a motion picture region at the same time, by separating the display region.

When the static picture is displayed at the static picture region, an output of the Y shift register circuit 816 is at an "H" state, and address signals input from the panel display control circuit are sequentially output from a Y decoder circuit 818. Thus, Y address data based on the address signals are output from the logic circuit ANDi. X address data based on the address signals input from the panel display control circuit 812 are output from a Y decoder circuit 814. The data selecting switch Swi selects static picture data from a static picture electrode wire 834, and outputs the selected static picture data to the picture data electrode wire Di. Thus, the X address data is applied to the signal electrode wire Xi in the static picture region, the Y address data is applied to the scanning electrode wire Yi, and the static picture data is applied to the picture data electrode wire Di in synchronization with the Y address data and the X address data.

When a motion picture is displayed at the motion picture region, a scanning pulse is output from the output electrode wires (corresponding to the motion picture display region) designated by the Y shift register circuit 816, and a signal indicative of the "H" state is output from the address signal wires (corresponding to the motion picture display regions) designated by the Y decoder circuit 818. Further, a scanning pulse is output to the scanning electrode wires (corresponding to the motion picture display region) designated by the logic circuit ANDi. While, a signal indicative of the "−H" state is output from the X decoder circuit 814 to the signal electrode wires (corresponding to the motion picture display region). The data selecting switch SWi selects the motion picture data from the designated motion picture electrode wires (corresponding to the motion picture display region) of the motion picture latch circuit 820, and outputs the selected motion picture data to the picture data electrode wire Di. A signal indicative of the "−H" state is applied to each of the electrode wires Xi corresponding to the motion picture display region, a scanning pulse is applied to the scanning electrode wire Yi, and the motion picture data is applied to the picture data electrode wire Di in synchronization with the scanning pulse.

The following Table 1 shows the above relationship.

TABLE 1

| | Static picture region | Motion picture region |
|---|---|---|
| Y shift register | H | Scan pulse |
| Y decoder | Y address data | H |
| 2 input AND circuit for pixel selection | Y address data | Scan pulse |
| X decoder | X address data | -H |
| Data selecting switch | Static picture data | Motion picture data |
| Scanning electrode wire | Y address data | Scan pulse |
| Signal electrode wire | X address data | -H |
| Display electrode | Static picture data | Motion picture data |

Further, in case the light-on, the light-off and the storage operation with respect to the picture data are performed in the static picture region, or in case the light-on and the storage operation with respect to the picture data are performed in the motion picture region, the relationship among the electric potentials of the electrode wires is represented in the following Table 2.

TABLE 2

| | Scanning electrode wire | Signal electrode wire | Picture data electrode wire | Display electrode wire |
|---|---|---|---|---|
| Static Light-on | H | H | H | Vcom |
| picture Light-off | H | H | L | Vcnt |
| region Storage | L | — | — | Vcom > Vcom |
| | — | L | — | Vcnt > Vcnt |
| | L | -H | — | |
| Motion Light-on | H | -H | sign | sign |
| picture Storage | L | -H | sign +1 | |
| region | L | — | — | sign > sign |
| | — | L | — | |

In case the static picture is displayed (lighted on) in the static picture region, by applying "H" to each scanning electrode wire Yi, signal electrode wire Xi and picture data electrode wire Di, the electric potential of the display electrode 862 becomes equal to the electric potential Vcom of the common electrode wire, and the liquid crystal is lighted. On the other hand, the lighted static picture is erased by applying "H" to the scanning electrode wire Yi and "H" to the signal electrode wire Xi, applying the data "L" to the picture data electrode wire Di, and allowing the electric potential of the display electrode 862 to be equal to Vcnt. The once lighted static picture can be retained by allowing either one of the scanning electrode wire Yi and the signal electrode wire Xi. Even if the signal "L" or "H" is applied to the picture data electrode wire Di at this time, the state of the display electrode 862 does not change. Similarly, even if the signal "−H" is applied to the signal electrode wire Xi, it does not change.

In case a motion picture is displayed (lighted on) in the motion picture region, "H", "−H" and "sig n" are applied to the scanning electrode wire Yi, the signal electrode wire Xi and picture data electrode wire Di, respectively. Thereby, the motion picture data "sig n" is applied to the display electrode 862, the liquid crystal is lighted on and the motion picture is displayed. If either one of the signal level of the scanning electrode wire Yi or that of the signal electrode wire Xi is at the "L" level, the displayed motion picture is held. At this time, even if any signals are applied to the picture data electrode wire Di, the state of the display electrode 62 is constant.

Figure 40:
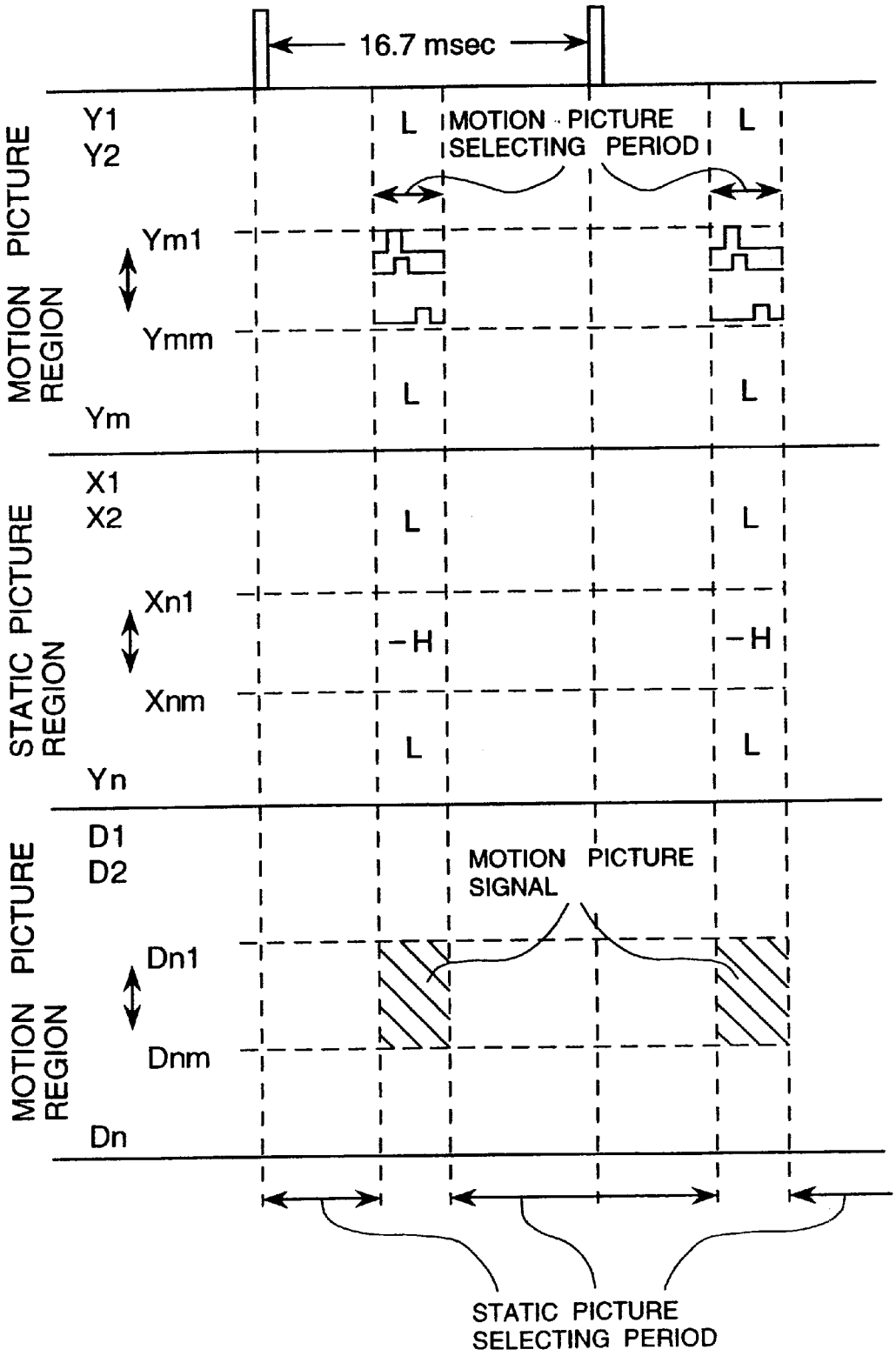
FIG. 40 is a timing chart illustrating the operation of displaying the static picture and the motion picture at the same time.

The display of a motion picture and a static picture in a mixed region formed of the motion picture and the static picture display regions will be explained next, with reference to FIG. 40. FIG. 40 is a timing chart illustrating the operation of displaying a static picture and a motion picture at the same time. Where, the time of one frame is a sixtieth of a second, or 16.7 ms, the electrode wires corresponding to the motion picture display region will be designated by the scanning electrode wires Yml to Ymm, the signal electrode wires Xnl to Xnn, and the picture data electrode wires Dnl to Dnn. Each of the static picture and the motion picture display regions is set in accordance with the command from a panel display control circuit 812. Further, the time for selecting the static picture and the time for displaying the static picture are separated from the time for selecting the motion picture and the time for displaying the motion picture, respectively.

When the processing to display one frame is ~started, the command to display the static picture is output from the panel display control circuit 812, and the data or the signal shown in table 1 is applied sequentially to the scanning electrode wires Yi, the signal electrode wires Xi and the picture data electrode wires Di which belong to the static picture display region. Accordingly, the light-on and light-off states and the holding or storage of the liquid crystal which belongs to the static picture display region is performed based on the static picture data. Namely, the liquid crystal in the static picture display region is turned on and turned off, and held. As a result, the static picture is displayed based on the picture data.

When it becomes time to display the motion picture on the motion picture display region, in the course of the carrying out the selecting scan of the scanning electrodes, the motion picture data or the signal shown in Tables 1 and 2 is applied sequentially to the scanning electrode wires Yi, the signal electrode wires Xi and the picture data electrode wires Di which belong to the motion picture display region. Accordingly, the motion picture is displayed sequentially on the motion picture display region. The motion picture display time exists once every frame, and the processing of the motion picture is repeated every frame.

In case a static picture is displayed, the selecting operation is not performed until it becomes necessary to rewrite with regard to the liquid crystal which belongs to the display region displayed once. Namely, the state of the write-in is maintained until it becomes necessary to rewrite.

As described above, even if the static picture and the motion picture are mixed and displayed at the same time, the pixel selecting operation is not performed with respect to the static picture displayed once until it becomes necessary to rewrite. Accordingly, because it is not necessary to charge and discharge the capacity formed by the liquid crystal between wires and an opposed electrode 864, and the capacity formed at the intersecting portion of wires and that formed every one frame, it can reduce the power consumption.

Further, even if the motion picture is displayed, it is not necessary to display the motion picture on the whole display region, but it is possible to display it on a specified display region. Accordingly, it is possible to reduce the power consumption. Further, because the motion picture data is applied sequentially to the signal electrode wires Xi which belong to the motion picture display region, one the signal electrode wires intersecting the selected scanning electrode wire Yi within the period of time one scanning electrode wire Yi is selected.

Figure 41:
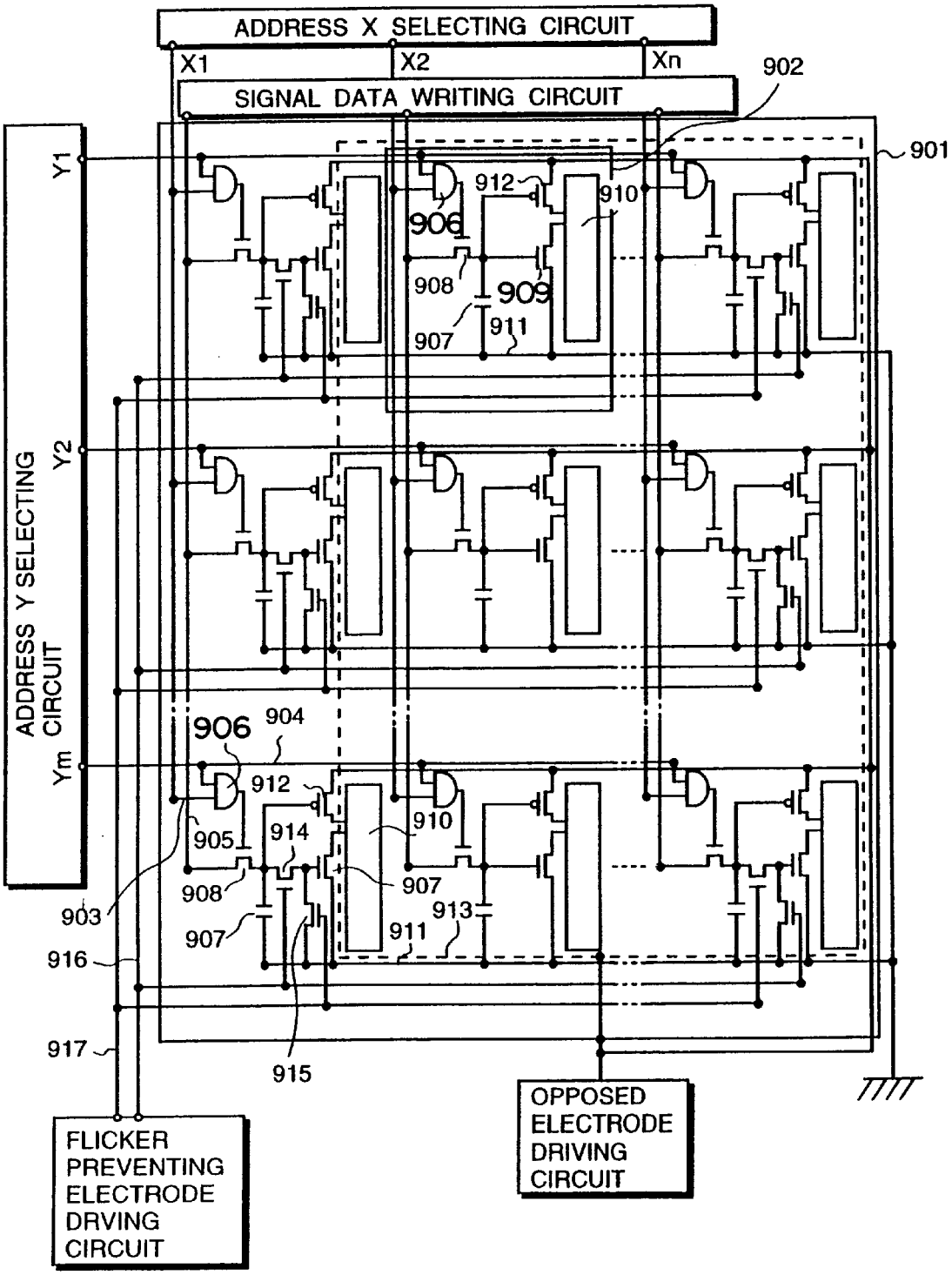
FIG. 41 is a schematic diagram of the liquid crystal display apparatus according to a fourth embodiment of the present invention.

FIG. 41 is a schematic view of the liquid crystal display apparatus according to a fourth embodiment of the present invention. Pixel portions 902 each formed from an m high by n wide matrix of dots are arranged in a matrix array on a display portion 901 formed on a TFT substrate (not shown). An address X electrode 903, an address Y electrode 904 and a signal electrode 905 are connected to each of the pixels. Each pixel includes an AND circuit 906 for recognizing the designated address, a display data holding circuit having a sampling capacitor 907 and a sampling TFT 908, a pixel driving TFT 909 and a display electrode 910. The address X electrode 903 is connected to an address X selecting circuit, the address Y electrode 904 is connected to an address Y selecting circuit, and the signal electrode 905 is connected to a signal data writing circuit. A common electrode 911 is grounded. A display-off TFT 912 for turning off the liquid crystal provides the voltage of the opposed electrode to the display electrode 910 based on an electric potential of the sampling capacitor 907. An opposed electrode 909 formed on a counter substrate faces through a liquid crystal to the transparent electrode provided on the TFT substrate. The opposed electrode 909 is driven by an opposed electrode driving circuit. The liquid crystal display apparatus has a polarizer and a back light (not shown) in addition to the above configuration.

Figure 42:
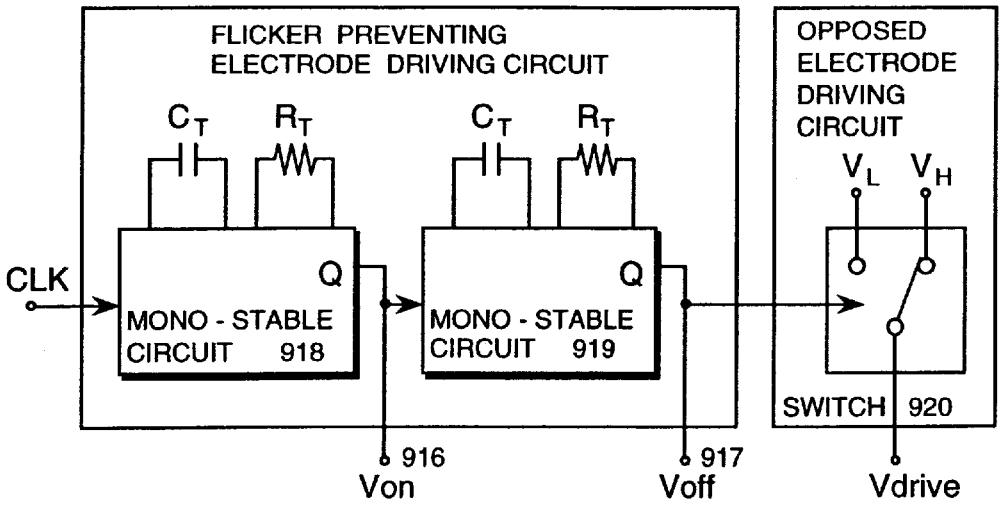
FIG. 42 is a schematic diagram showing the configuration of a driving circuit for flicker preventing electrodes.
Figure 43:
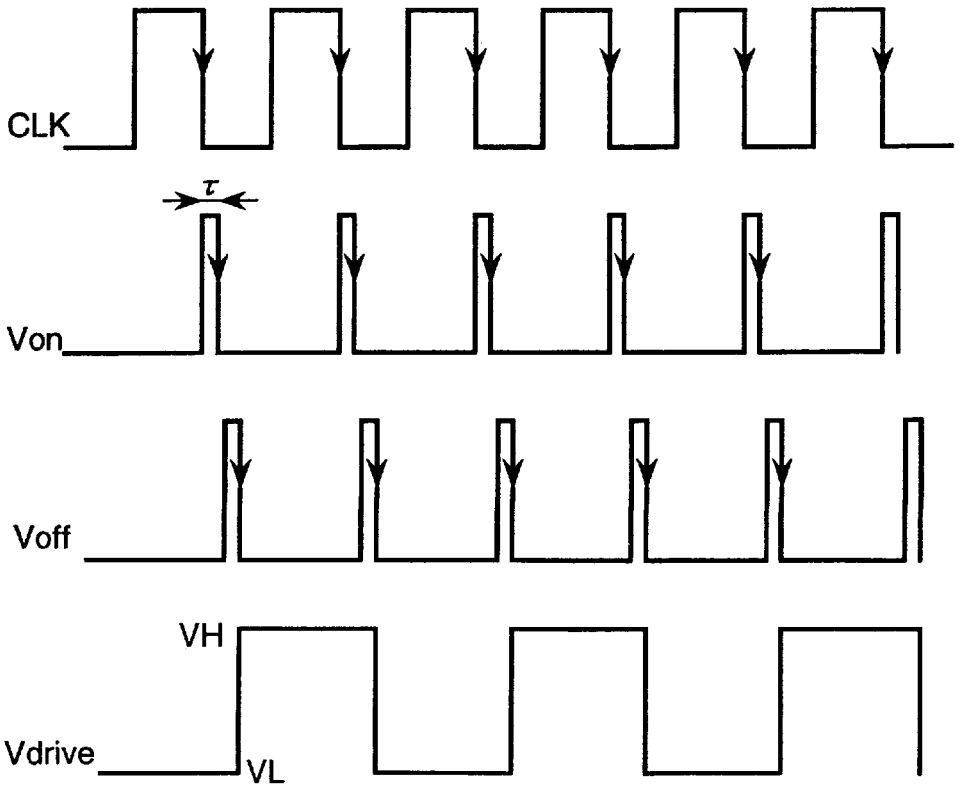
FIG. 43 is a timing chart of the pulses shown in FIG. 42.

In order to prevent flicker, a TFT switch 914 and a TFT switch 915 are provided in pixels 902 of every other row. A gate of each of the TFT switches is connected to the flicker preventing electrodes 916 and 917. The two electrodes 916 and 917 are connected to a driving circuit for the flicker preventing electrodes. The flicker preventing electrode driving circuit is a timing pulse generating circuit for driving the TFT switch 914 and the flicker preventing OFF switch 915. An embodiment of the flicker preventing electrode driving circuit is shown in FIG. 42, and a timing chart of the pulses shown in FIG. 42 is shown in FIG. 43. A mono-stable circuit or mono-stable multivibrator generates a pulse-like signal with a constant time width $\tau$, in synchronization with the fall of the pulse-like signal. After outputting the pulse-like signal with a constant time width, the circuit returns to an initial state. The constantly stable point is one. The time width $\tau$ is determined by the value of a capacity CT and a resistance RT for timing provided outside. If a clock CLK as shown in FIG. 43 is input to the mono-stable circuit 918, the fall of the output Q becomes a pulse-like signal with a constant time width $\tau$ like Von. The output is input to another exactly the same mono-stable circuit 919. An output of the circuit 919 is a pulse-like signal with a constant width $\tau$ like Voff at the fall of Von. A switch 920 is operated like a toggle switch by the output signal of the circuit 919. As a result, a square wave, Vdrive with two values VL and VH is obtained, and the opposed electrode is driven.

Figure 44A:
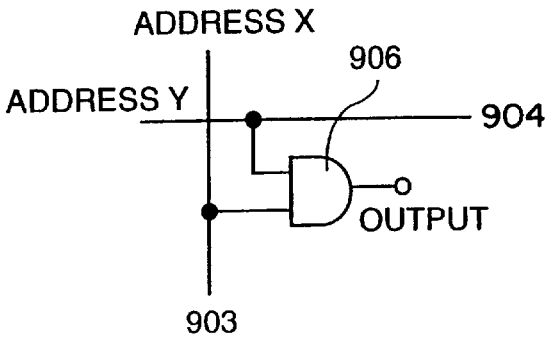
FIGS. 44A and 44B are equivalent circuit diagrams of AND circuits.
Figure 44B:
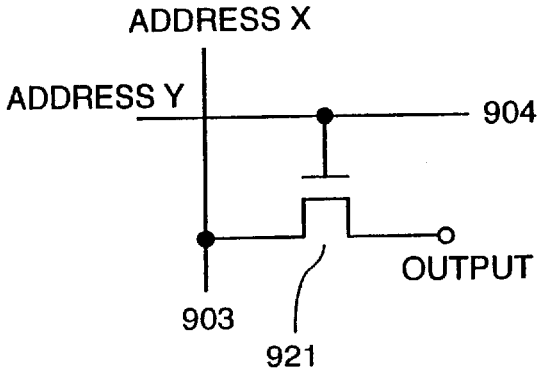

FIG. 44B shows an example of the AND circuit 906 shown in FIG. 44A. The address Y electrode 904 is connected to a gate of an AND TFT 921, and the address X electrode is connected to its source. If the address Y electrode is placed at a high level, the AND TFT 921 turns to an "ON" state and the electric potential of the address X electrode is transmitted to the output.

Figure 45:
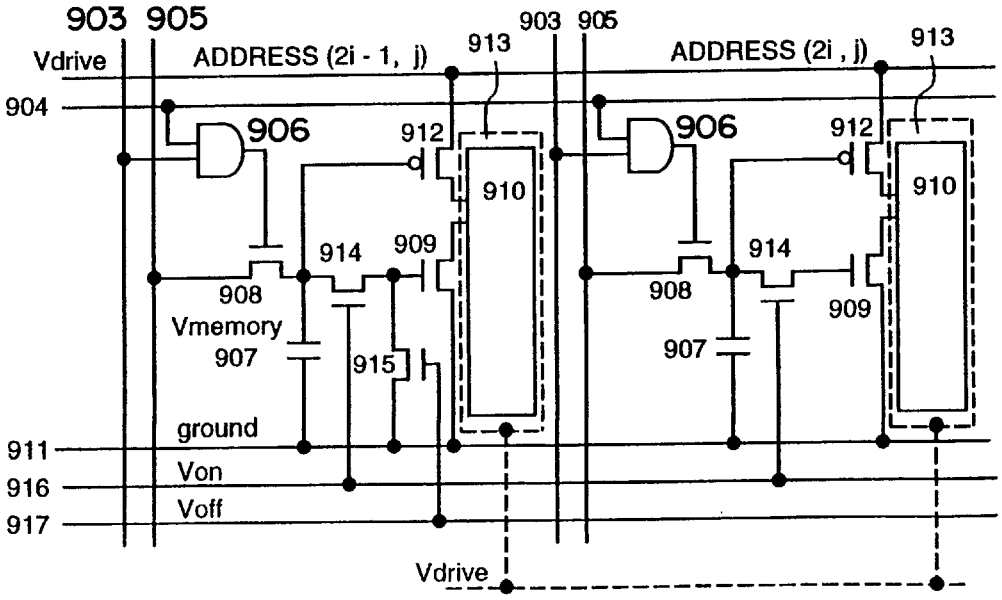
FIG. 45 is a schematic diagram showing the configuration of the pixel circuit.

FIG. 45 shows in detail the address (2i–l,j)and the next address (2i,j) of the pixel shown in FIG. 41, where, i and j are integers which satisfy $1 \leqq i- \leqq n/2$ and $1 \leqq j \leqq m$, respectively.

Figure 46:
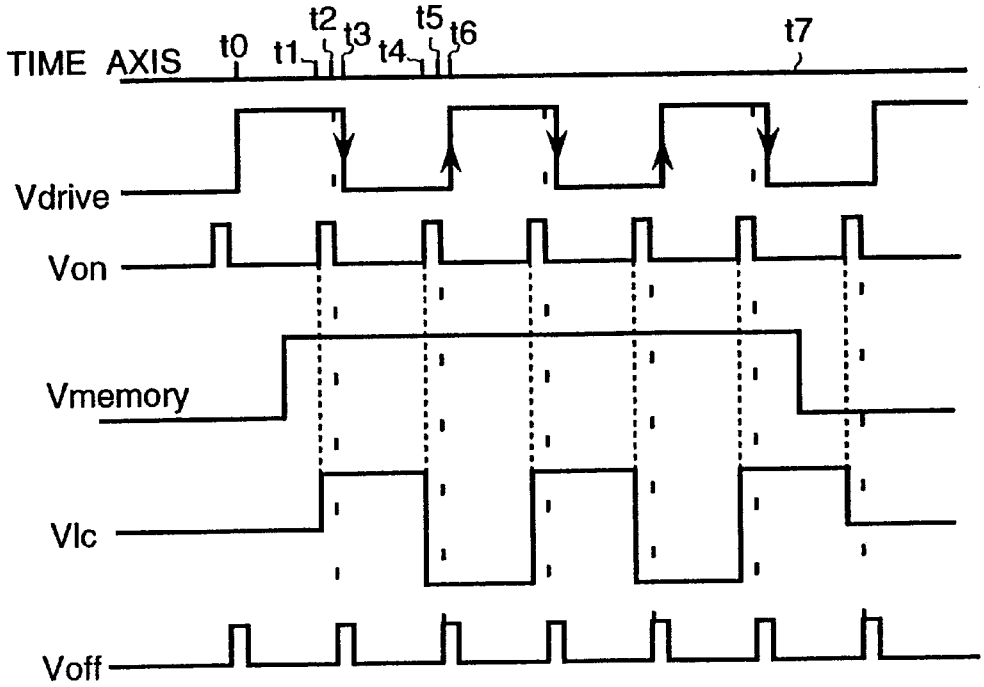
FIG. 46 is a wave form chart illustrating the operation of a liquid crystal display device with the pixel circuit shown in FIG. 45.

FIG. 46 is a wave form chart illustrating the operation of a liquid crystal display device with the pixel circuit shown in FIG. 45. Vdrive is a square-wave-like-liquid crystal driving voltage applied to the opposed electrode 913. Von is a timing pulse applied to a flicker preventing electrode 916 from the flicker preventing electrode driving circuit, for turning a TFT switch 914 on. Voff is a timing pulse applied to a flicker preventing electrode 917 from the flicker preventing electrode driving circuit, for turning a TFT switch 915 on. The signal Von is output just before the rise and the fall of the square pulse Vdrive, and Voff is output just after Von. The pulse time width of Von is the time required to turn the pixel driving TFT 909 on, and that of Voff is the time required to turn the TFT switch 915 on and turn the pixel driving TFT 909 off. Vmemory is the voltage of the sampling capacitor 907 at the address (2i,j). Vlc is the voltage applied to the liquid crystal at the address (2i,j). It should be noted that the liquid crystal driving voltage is the voltage generated in the opposed electrode driving circuit, and the liquid crystal applying voltage is the voltage applied to the liquid crystal sandwiched between the display electrode 910 and the opposed electrode 913, whose magnitude corresponds to the difference of the electric potential between the electrodes 910 and 913.

The principle of operation will be explained with reference to FIGS. 45 and 46. If Vmemory is at a low level before to, the pixel driving TFT 909 will never turn on in any of the states of the TFT switches 914 and 915. When the display-off TFT 912 is in an "ON" state, Vdrive is applied to the display electrode 910. The electric potential of the display electrode 910 is equal to that of the opposed electrode 913, and a voltage is not applied to the liquid crystal. If Vmemory changes its state to a high level at the time t0, the display-off TFT 912 is cut off. Because the display electrode 910 is not electrically connected anywhere, and does not store the electric charge, the electric potential of the display electrode 910 is equal to that of the opposed electrode 913, and thus a voltage is not applied yet to the liquid crystal. If the timing pulse Von is input at the time t1, the TFT switch 914 is turned on. Because, at this time, the TFT switch 915 is in the "OFF" state and the display-off TFT 912 is also in the "OFF" state, the pixel driving TFT 901 is controlled by the voltage Vmemory and is turned to "ON". Thereby, the display electrode 910 is connected to the common electrode 911, and an electric potential is generated between the display electrode 910 and the opposed electrode 913. Therefore, Vdrive is applied to the liquid crystal applying voltage Vlc. If Von turns to an "OFF" level again, the TFT switch 914 turns off. However, because an electric charge is stored in the gate of the pixel driving TFT 909, the pixel driving TFT 909 is maintained in an "ON" state. Accordingly, Vdrive is still applied to Vlc. Next, the timing pulse Voff is input at the time t2 and the TFT switch 915 is turned on. Thereby, the gate of the pixel driving TFT 909 is grounded and turned off. Because the electric charge of the display electrode 910 is still stored, the electric potential between the display electrode 910 and the opposed electrode 913 is not changed and Vlc is not changed. Further, because the electric charge of the display electrode 910 is stored even if the polarity of Vdrive is changed at the time t3, Vlc is not changed. In order to invert the polarity of Vlc, the TFT switch 914 is turned on at the time t4 just before the rise t6 of Vdrive, thereby turning the TFT 909 on. As a result, the voltage of Vdrive is applied to Vlc. The voltage Vlc is maintained by turning the TFT switch 915 on at the time t5 and turning the pixel driving TFT 909 off. By periodically carrying out such switching, the inversion of the polarity is repeated and thus Vlc is alternated. Comparing the phase of Vlc with that of Vdrive when the switching has been carried out at the above timing, Vlc lags approximately 180° in phase with respect to Vdrive as seen from FIG. 46. It is because the edge of the rise of the liquid crystal applying voltage at the pixel including the switch appears just before the edge of the fall of the liquid crystal driving voltage that there is a phase difference of a half period, when there is one periodic cycle or 360° from the edge of the rise of the liquid crystal to the next one. If Vmemory turns to a low level at t7, then the display-off TFT 912 is turned on and Vdrive is applied to the display electrode 910. The electric potential of the display electrode 910 becomes equal to that of the opposed electrode. As a result, a voltage is not applied to the liquid crystal and thus the liquid crystal is turned off.

At the address (2i,j) of the pixel not including the flicker preventing switch, the liquid crystal applying voltage has the same phase as Vdrive. As described above, Vlc will lag approximately 180° in phase with respect to Vdrive. Namely, the liquid crystal applying voltage of the pixel having the flicker preventing switch is inverted in phase with respect to a pixel not having the flicker preventing switch. Further, their pixels are adjacent to each other. There are three states, a first one is a state wherein the polarities of the liquid crystal applying voltages are inverted with respect to each other in the time between adjacent pixels, a second one is a state wherein the polarities of the voltages are the same as each other and are positive, and a third one is a state wherein the polarities of the voltage are the same as each other and are negative. When the distance between the pixels is narrow, the viewing angle between the adjacent pixels becomes narrow. Therefore, in a case where the polarity is inverted, it is difficult to identify the difference in gray levels between the adjacent pixels. In other words, the eyes of a human being normally are able to distinguish a gray level through the averaging of a positive gray level and a negative gray level. In this embodiment, three gray levels, that is, the average gray level, the gray level when the polarity which is positive and the gray level when negative, are sequentially displayed. However, because the phase lag is approximate 180°, the percentage of the average gray level is large, and thus flicker is prevented.

While the configuration for preventing flicker added to the pixel is provided at every other column, it is possible to provide the configuration of every other row or arrange the configuration like a checker board, because a pixel having the flicker preventing switch can be adjacent to a pixel not having the flicker preventing switch.

Another embodiment of the present invention will be explained next. It is also possible to prevent flicker by using the configuration shown in FIG. 47.

Figure 47:
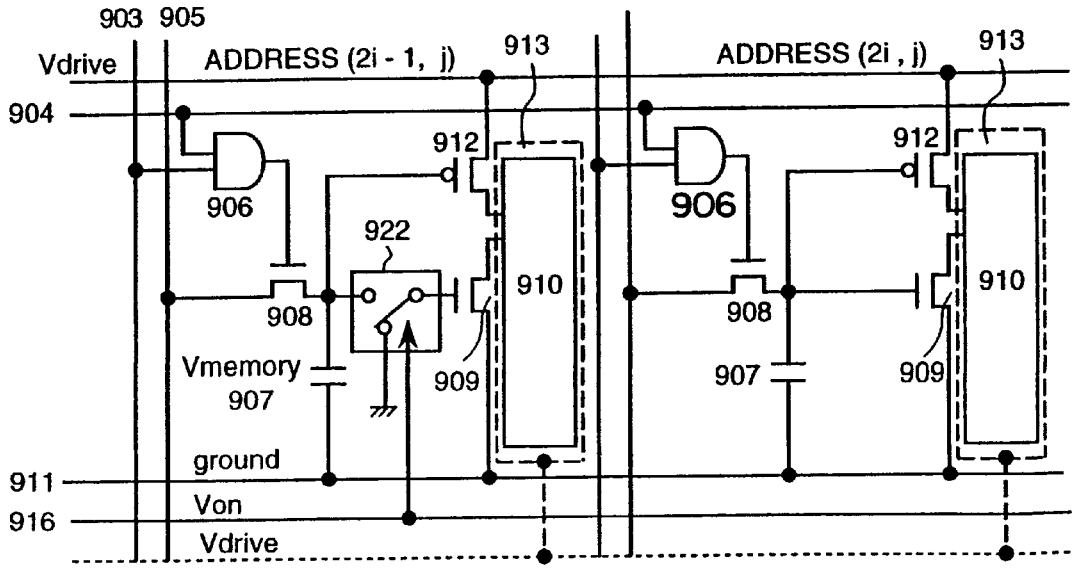
FIG. 47 is a schematic diagram showing the configuration of the pixel circuit with flicker preventing switches.

In the configuration shown in FIG. 47, a flicker preventing switch 922 is utilized instead of the TFT switches 914 and 915.

Figure 48:
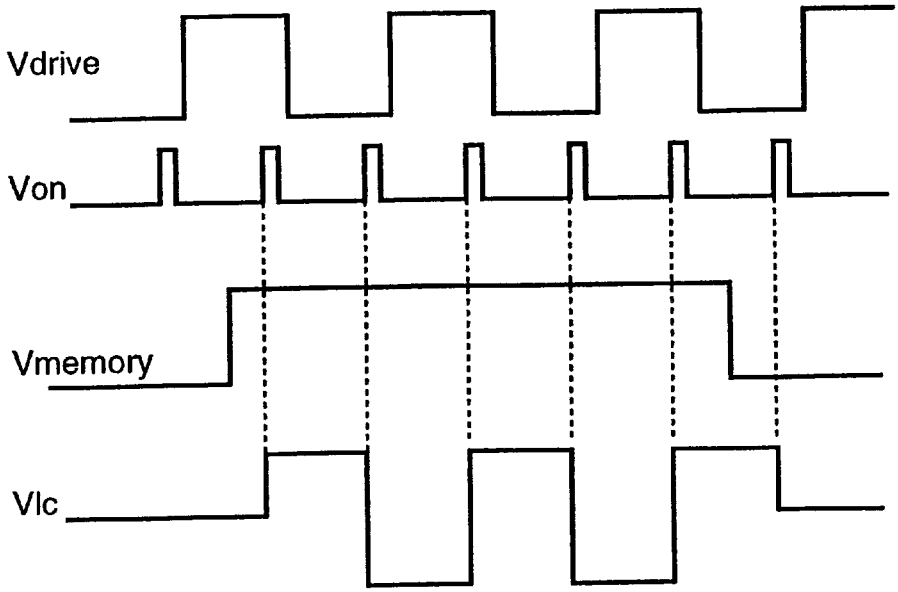
FIG. 48 is a wave form chart illustrating the operation of a liquid crystal display device with the pixel circuit shown in FIG. 47.

FIG. 48 shows the switching operation of the flicker preventing switch 922. Vdrive is a square-wave-like alternating voltage applied to the opposed electrode 913. Von is a timing pulse by which the flicker preventing switch 922 switches from the ground level to the level of the sampling capacitor 907 at the address (2i–l,j). The voltage Von is output just before the rise and the fall of the square pulse Vdrive. Vmemory is the voltage of the sampling capacitor 907 at the address (2i,j). Vlc is the voltage applied to the liquid crystal at the address (2i,j).

The principle of operation of this embodiment will be explained. If Von is at a high level, the flicker preventing switch 922 is turned on. Therefore, the pixel driving TFT 909 is controlled by the voltage Vmemory. At this time, Vdrive is applied to the liquid crystal at the address (2i–l,j) like Vlc.

If Von turns again to the "OFF" level, the flicker preventing switch 922 turns off and thus the pixel driving TFT 909 turns off. Even if the polarity of Vdrive is inverted, that of Vlc is not changed and thus its magnitude is constant. Vlc is alternated by turning the flicker preventing switch 922 on. As a result, the phase of Vlc has a difference of 180° from the phase of Vdrive. Namely, the liquid crystal applying voltage of the pixel having the flicker preventing switch is inverted in phase with respect to a pixel not having the flicker preventing switch. Thereby, flicker can be prevented.

Figure 49:
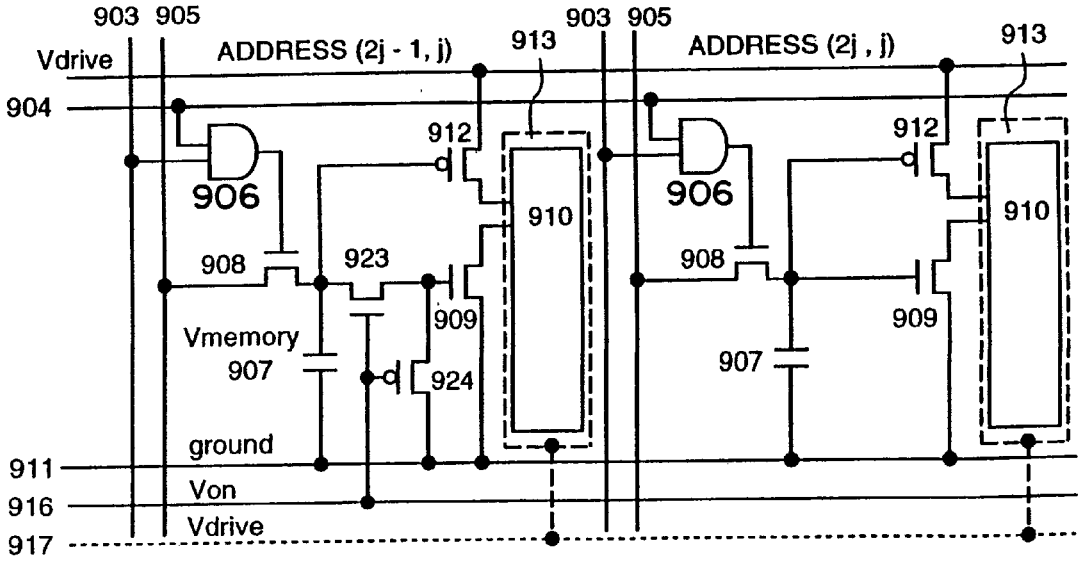
FIG. 49 is a schematic diagram showing the configuration of the pixel circuit with a p-channel TFT.

Another embodiment will be explained. FIG. 49 shows the configuration of the pixel circuit with a p-channel TFT, in which an n-channel TFT 923 and a p-channel TFT 924 are utilized, instead of the TFT switches 914 and 915 shown in FIG. 41 or FIG. 45. The gates of the TFTs are connected to the flicker preventing electrode 916, and a drain of the p-channel TFT 924 is grounded.

Figure 50:
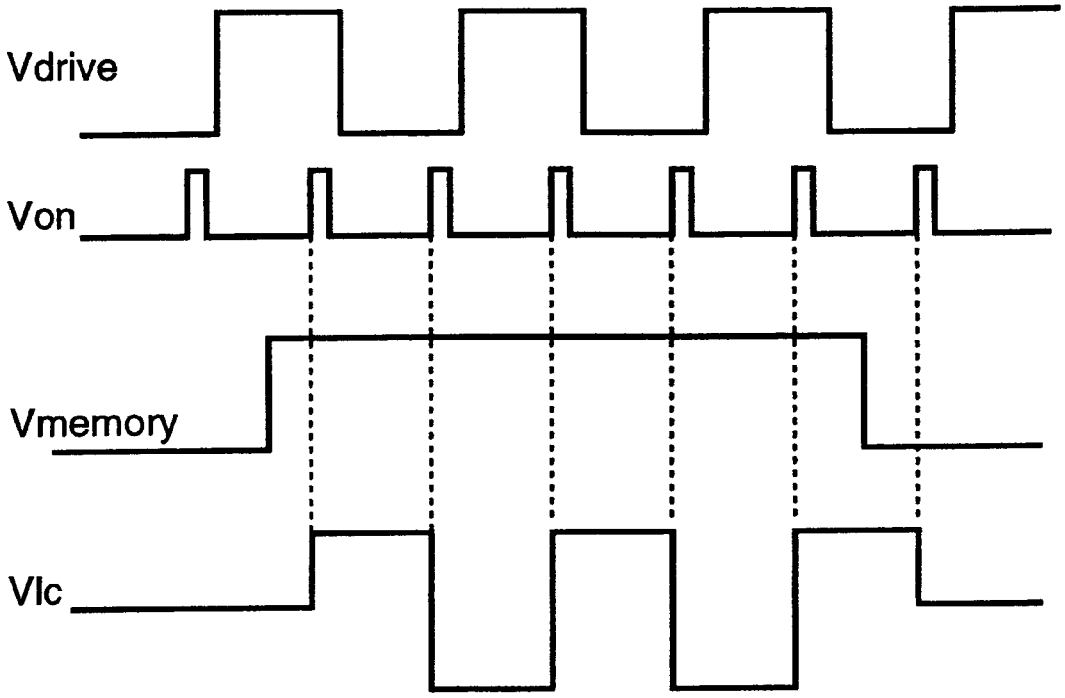
FIG. 50 is a wave form chart illustrating the operation of a liquid crystal display device with the pixel circuit shown in FIG. 49.
Figure 51A:
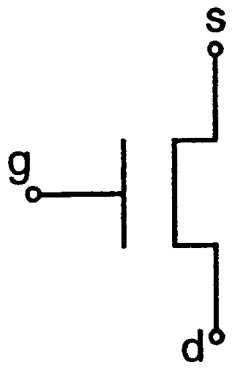
FIGS. 51A and 51B are diagrams of a n-channel TFT and a p-channel TFT.
Figure 51B:
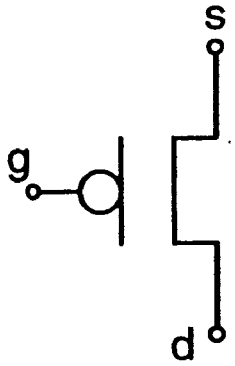
Figure 51C:
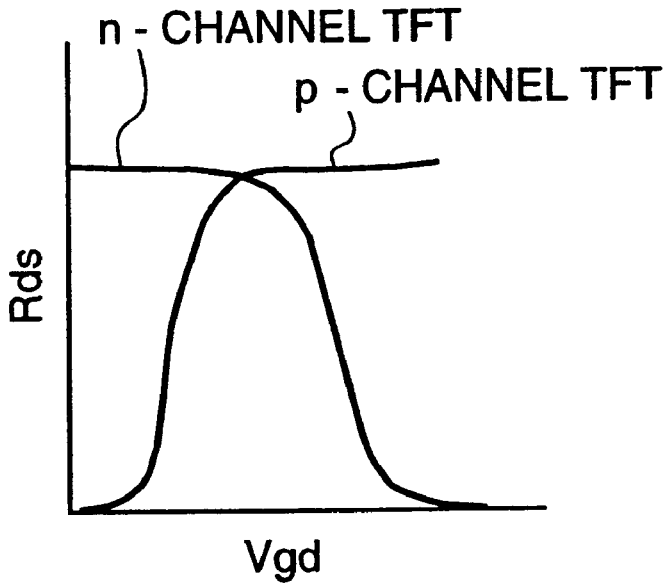
FIG. 51C is a graph showing the characteristics of a n-channel TFT and a p-channel TFT.

FIG. 50 shows the switching operation of the flicker preventing switches. Vdrive is a square-wave-like alternating voltage applied to the opposed electrode 913. Von is a timing pulse applied to the flicker preventing electrode 916 from the flicker preventing electrode driving circuit. The voltage pulse Von is output just before the rise and the fall of the square pulse of Vdrive. Vmemory is the voltage of the sampling capacitor 907 at the address (2i–l,j). Vlc is the voltage applied to the liquid crystal at the address (2i–l,j).

The principle of operation of this embodiment will be explained. If the timing pulse of Von is input to the n-channel TFT 923 and the p-channel TFT 924, the n-channel TFT 923 is turned on and the p-channel TFT 924 is turned off. Therefore, the gate of the pixel driving TFT 909 is connected to the sampling capacitor 907 and controlled by the voltage of Vmemory. At this time, Vdrive is applied to the liquid crystal at the address (2i–l,j). If Von turns again to the "OFF" level, the n-channel TFT 923 turns off and the p-channel TFT turns on. Thus, the pixel driving TFT 909 turns off. Because the electric charge is still stored in the display electrode, the polarity of Vlc is not changed even if the polarity of Vdrive is inverted. Vlc is alternated by periodically carrying out such a switching operation. As a result, the phase of Vlc has a difference of 180° from the phase of Vdrive.

At the address (2i,j) of the pixel not including the flicker preventing switch, the liquid crystal applying voltage has the same phase as Vdrive. As described above, Vlc will lag approximately 180° in phase with respect to Vdrive. Namely, the liquid crystal applying voltage of a pixel having the flicker preventing switch is inverted in phase with respect to a pixel not having the flicker preventing switch. As a result, flicker is prevented.

It should be noted that threshold voltages for the on-off operation of the n-channel and the p-channel TFTs must not be set so as to overlap each other. In a case where there is a value of the voltage at which both TFTs are turned off, the electric charge of the sampling capacitor 907 will flow to ground and thus normal display data will be missed. Further, by combining the n-channel TFT with the p-channel TFT, a reliable operation of the timing switch is insured.

What is claimed is:

1. A liquid crystal display apparatus having a pair of substrates of which at least one substrate is transparent and a liquid crystal layer sandwiched between the substrates, comprising:

a plurality of scanning electrodes formed on one of the substrates; and a plurality of signal electrodes intersecting in a matrix form with each of said plurality of scanning electrodes;

wherein the display apparatus further comprises, within each of the regions forming pixels surrounded by said plurality of scanning electrodes and said plurality of signal electrodes, each of said pixels being connected with a plurality of signal wiring;

(a) a sampling data holding circuit connected to a corresponding signal electrode, for sampling and storing signal data from the signal electrode in response to a scanning signal;

(b) a gray level selecting circuit connected to said sampling data holding circuit, for selecting gray levels for a pixel in response to a state of the sampling of said sampling data holding circuit; and (c) a display electrode connected to said gray level selecting circuit, and a plurality of capacitor-transistor circuits being connected to said display electrode.

2. A liquid crystal display apparatus according to claim 1, wherein said sampling data holding circuit comprises:

a plurality of thin film transistors connected to a corresponding scanning electrode at gates thereof and to respective ones of corresponding signal electrodes at one of drains and sources, for sampling signal data from respective ones of said signal electrodes in response to the scanning signal from the scanning electrode; and a plurality of sampling capacitors connected to respective ones of the other of drains and sources of said plurality of thin film transistors for holding sampled signal data by said plurality of thin film transistors.

3. A liquid crystal display apparatus according to claim 2, wherein said gray level selecting circuit has a plurality of thin film transistors having gates connected to the other of respective drains and sources of said plurality of thin film transistors for sampling and driving said display electrode depending upon holding condition signal data of said sampling capacitor.

4. A liquid crystal display apparatus according to claim 3, wherein one of said substrates is provided with a common electrode connected to said plurality of capacitors of said sampling holding circuit and said plurality of thin film transistors of said gray level selecting circuit.

5. A liquid crystal display apparatus according to claim 3, wherein said thin film transistor is formed with a coplanar structure.

6. A liquid crystal display apparatus according to claim 3, wherein said thin film transistor is an inverse staggered structure.

7. A liquid crystal display apparatus according to claim 3, wherein said thin film transistor is a staggered structure.

8. A liquid crystal display apparatus according to claim 2, wherein a liquid crystal capacity as electrostatic capacity between the scanning electrode, the signal electrode and the common electrode, display electrode of each of the regions formed on one of the substrates, a signal electrode capacity as electrostatic capacity between the signal electrode and a transparent electrode, a wiring capacity as electrostatic capacity at an intersecting portion between the scanning electrode and the signal electrode, and a scanning wiring number satisfy a relationship of (liquid crystal capacity)<{(signal electrode capacity)+(wiring intersecting portion capacity)}×(scanning wiring number).

9. A liquid crystal display apparatus comprising:

a liquid crystal layer including a liquid crystal constructing a plurality of pixels;

a pair of boards facing each other between which said liquid crystal layer is inserted, at least one of said boards being transparent;

a plurality of scanning wires for transmitting scan pulses, distributed on one of said pair of boards;

a plurality of signal wires for transmitting image data, crossing with said plurality of scanning wires in a matrix geometry and distributed on one of said pair of boards;

AC voltage generation means for generating a liquid crystal device voltage for driving said liquid crystal; and timing signal generation means for generating periodically timing signals in synchronization with said liquid crystal drive voltage generated by said AC voltage generation means;

wherein each of a plurality of display areas enclosed by a plurality of scanning wires and a plurality of signal wires have:

(a) a display electrode placed et one side of said pair of boards;

(b) opposed electrodes placed so as to face said display electrode through said liquid crystal layer, to which said liquid crystal drive voltage is applied by said AC voltage generation means;

(c) a switching device for driving pixels connected to said display electrode;

(d) data hold means for holding image data supplied from a signal wire in response to a scan pulse from a scanning wire and controlling said switching operation of said switching device for driving pixels in response to said held image data; and (e) initializing means for initializing a voltage applied between said display electrode and said opposed electrode in response to a timing signal supplied by a thin film transistor provided in parallel with said switching device and said timing signal generation means enabling connection of a pixel electrode with a center voltage circuit.

10. A liquid crystal display apparatus comprising:

a liquid crystal layer including a liquid crystal constructing a plurality of pixels;

a pair of boards facing each other between which said liquid crystal layer is inserted, at least one of said boards being transparent;

a plurality of scanning wires for transmitting scan pulses, distributed on one of said pair of boards;

a plurality of signal wires for transmitting image data, crossing with said plurality of scanning wires in a matrix geometry and distributed on one of said pair of boards;

AC voltage generation means for generating a liquid crystal device voltage for driving said liquid crystal; and timing signal generation means for generating periodically timing signals in synchronization with said liquid crystal drive voltage generated by said AC voltage generation means;

wherein each of a plurality of display areas is enclosed by a plurality of scanning wires and a plurality of signal wires have:

(a) a display electrode placed at one side of said pair of boards;

(b) opposed electrodes placed so as to face said display electrode through said liquid crystal layer, to which said liquid crystal drive voltage is applied by said AC voltage generation means;

(c) a switching device for driving pixels connected to said display electrode;

(d) data holding means for holding image data supplied from a signal wire in response to a scan pulse from a scanning wire and controlling said switching operation of said switching device for driving pixels in response to said held image data; and (e) resetting means for shorting pixel driving by said switching device in response to a timing signal supplied by said timing signal generation means.

11. A liquid crystal display apparatus comprising:

a liquid crystal layer including a liquid crystal constructing a plurality of pixels;

a pair of boards facing each other between which said liquid crystal layer is inserted, at least one of said boards being transparent;

a plurality of scanning wires for transmitting scan pulses, distributed on one of said pair of boards;

a plurality of signal wires for transmitting image data, crossing with said plurality of scanning wires in a matrix geometry and distributed on one of said pair of boards;

AC voltage generation means for generating a liquid crystal device voltage for driving said liquid crystal; and (a) timing signal generation means for generating periodically timing signals in synchronization with said liquid crystal drive voltage generated by said AC voltage generation means;

wherein each of a plurality of display areas enclosed by a plurality of scanning wires and a plurality of signal wires have:

(a) a display electrode placed at one side of said pair of boards;

(b) opposed electrodes placed so as to face said display electrode through said liquid crystal layer, to which said liquid crystal drive voltage is applied by said AC voltage generation means;

(c) a switching device for driving pixels connected to said display electrode;

(d) data holding means for holding image data supplied from a signal wire in response to a scan pulse from a scanning wire and controlling said switching operation of said switching device for driving pixels in response to said held image data; and (e) logic means for controlling said pixel driving switching device into an ON state in response to one of a pixel driving image data held in said data holding means and a timing signal from said timing signal generating means.

12. A liquid crystal display apparatus of any one of claim 9, 10 and 11, switching device is composed of a TFT device, a signal for switching operation is input to a gate terminal of said TFT device, a drain terminal of said TFT device is connected to a display electrode, and a source terminal is connected to a reference line defining an average voltage of a liquid crystal drive voltage; and including AC voltage generation means for generating a liquid crystal drive voltage and timing signal generation means for generating a timing signal which is synchronized with a time when said liquid crystal drive voltage generated by said AC voltage generation means reaches an average voltage, generation of said timing signal being interrupted at a time when said voltage applied between a display electrode and an opposed electrode reaches zero so that the AC voltage is set at a center voltage, and when said timing signal is not applied, said liquid crystal drive voltage is applied to said center voltage circuit.

13. A liquid crystal display apparatus according to claim 12, wherein one of said substrates has a common electrode connected to said memory circuit of said display data holding circuit.

14. A liquid crystal display apparatus according to claim 13, wherein said memory circuit is a flip-flop circuit.

15. A liquid crystal display apparatus comprising:

a liquid crystal layer disposed between a pair of substrates arranged in opposition to each other, at least one of said substrates being transparent;

a plurality of scanning electrode lines distributed in one of a pair of said substrates;

a plurality of display electrodes arranged within a plurality of display regions respectively surrounded by a plurality of said scanning electrode lines and a plurality of signal electrode lines in said one of said substrates;

opposed electrodes respectively arranged in opposition to said display electrodes across said liquid crystal layer;

first switching devices for static picture and second switching devices for motion picture arranged within a plurality of said display regions and connected to respective display electrodes;

static picture controlling means arranged within said plurality of display regions, for controlling respective ones of a plurality of said first switching devices for static picture on the basis of the signal from said each signal electrode line and said each scanning electrode line and static picture data;

motion picture controlling means arranged within said plurality of display regions, for controlling respective ones of a plurality of said second switching devices for motion picture on the basis of the signal from said each signal electrode line and said each scanning electrode line and motion picture data;

wherein for displaying a static picture, the signal from said signal electrode line and said scanning electrode line and said static picture data is applied to said static picture controlling means in said static picture display region for placing said first switching device for static picture in an ON state and holding static picture data; and wherein for displaying a motion picture, the signal from said signal electrode line and said scanning electrode line and said motion picture data is applied to said motion picture controlling means in said motion picture display region for placing said second switching device for motion picture in an ON state and holding motion picture data.

16. A liquid crystal display apparatus comprising:

a liquid crystal layer disposed between a pair of substrates arranged in opposition to each other, at least one of said substrates being transparent;

a plurality of scanning electrode lines distributed in one of a pair of said substrates;

a plurality of display electrodes arranged within a plurality of display regions respectively surrounded by a plurality of said scanning electrode lines and a plurality of signal electrode lines in said one of said substrates;

opposed electrodes respectively arranged in opposition to said display electrodes across said liquid crystal layer;

first switching devices for static picture and second switching devices for motion picture arranged within a plurality of said display regions and connected to respective display electrodes;

static picture controlling circuit arranged within said plurality of display regions, for controlling respective ones of a plurality of said first switching devices for static picture on the basis of the signal from said each signal electrode line and said each scanning electrode line and static picture data;

motion picture controlling circuit arranged within said plurality of display regions, for controlling respective ones of a plurality of said second switching devices for motion picture on the basis of the signal from said each signal electrode line and said each scanning electrode line and motion picture data;

wherein for displaying a static picture, the signal from said signal electrode line and said scanning electrode line and said static picture data is applied to said static picture controlling circuit in said static picture display region for placing said switching device for static picture in an ON state and holding static picture data, and supply of the signal from said signal electrode line and said scanning electrode line and said static picture data to the static picture control circuit holding the static picture data among said static picture controlling circuits in the static picture display region; and wherein for displaying motion picture, the signal from said signal electrode line and said scanning electrode line and said motion picture data is applied to said motion picture controlling circuit in said motion picture display region for placing said second switching device for motion picture in an ON state and holding motion picture data.

17. A liquid crystal display apparatus comprising:

a pair of substrates arranged in opposition to each other, at least one of which is transparent;

a liquid crystal layer sandwiched between said pair of substrates;

a plurality of scanning electrode lines distributed on one of said pair of substrates;

a plurality of signal electrode lines distributed on the substrate, on which said scanning electrode lines are distributed and intersecting with said scanning electrode lines in matrix form;

a plurality of display electrodes respectively arranged in a plurality of display regions on one of said substrates respectively surrounded by said plurality of scanning electrode lines and said plurality of signal electrode lines;

a plurality of opposed electrode arranged in opposition to said plurality of display electrodes across said liquid crystal layer;

a plurality of picture data electrode lines arranged corresponding to said plurality of signal electrode lines and leading the picture data to said plurality of display regions;

a plurality of static picture switching devices respectively connected to a plurality of display electrodes;

a plurality of motion picture switching devices respectively connected to said plurality of display electrodes;

a plurality of static picture control circuits receiving signals from said plurality of signal electrode lines and said plurality of scanning electrode lines and static picture data from said plurality of picture data lines, holding said static picture data when a conditions of said signals and said static picture data satisfies an ON condition of said plurality of static picture switching devices, and controlling respective ones of said plurality of static picture switching devices into an ON state;

a plurality of motion picture control circuits receiving signals from said plurality of signal electrode lines and said plurality of scanning electrode lines and motion picture data from said plurality of picture data lines, and controlling respective ones of said plurality of motion picture switching devices into an ON state when a conditions of said signals and said motion picture data satisfies an ON condition of said plurality of motion picture switching devices;

a plurality of picture data selection circuits selecting the static picture data upon static picture display, selecting the motion picture data upon motion picture display and outputting the selected picture data to said plurality of picture data electrode lines, respectively;

motion picture display region designating means for designating a region for displaying motion picture among said plurality of display regions;

motion picture data outputting means for outputting motion picture data to only the picture data selecting circuit corresponding to the display region by a designation of said motion picture display region designating means among a plurality of picture data selecting circuits, according to designation of said motion picture display region designating means;

static picture scanning pulse outputting means for sequentially outputting scanning pulses for the designated scanning electrode lines among said plurality of scanning electrode lines upon static picture display;

motion picture scanning pulse outputting means for sequentially outputting scanning pulses for the designated scanning electrode lines among said plurality of scanning electrode lines upon motion picture display;

static picture liquid crystal drive signal outputting means for outputting a static picture liquid crystal drive signal to said plurality of signal electrode lines in synchronism with the scanning pulses by output of said static picture scanning pulse outputting means; and motion picture liquid crystal drive signal outputting means for outputting a motion picture liquid crystal drive signal to designated signal electrode lines among a plurality of signal electrode lines in synchronism with the scanning pulses by output of said motion picture scanning pulse outputting means.

18. A liquid crystal display apparatus according to claim 17, wherein said motion picture liquid crystal drive signal outputting means sequentially outputs the motion picture data to the designated signal electrode lines depending upon the number of designated signal electrode lines in response to the scanning pulse when the scanning pulse is output to one of the scanning electrode line among the designated scanning electrode line.

19. A liquid crystal display apparatus according to any one of claims 15, 16 and 17, wherein said motion picture control circuit includes a discharging thin film transistor inserted between input electrodes of the static picture switching device with said display electrode being a load and a picture data inputting thin film transistor connected to said motion picture switching device in series, a gate of said discharging thin film transistor is connected to the signal electrode lines together with a gate of the motion picture switching device, a gate of said picture data inputting thin film transistor is connected to the scanning electrode line, and the motion picture is input to a drain thereof.

20. A liquid crystal display apparatus according to any one of claims 15, 16 and 17, wherein said static picture control circuit includes a capacitor disposed between input electrodes of said static picture switching device with said display electrode being a load and a pair of thin film transistors connected in series with said static picture switching device, one of said thin film transistors being connected to said signal electrode line at a gate thereof, and a gate of the other thin film transistor being connected to said scanning electrode line and a drain thereof as input for a static picture data.

21. A liquid crystal display apparatus according to claim 20, wherein said motion picture control circuit includes a discharging thin film transistor inserted between input electrodes of the static picture switching device with said display electrode being a load and a picture data inputting thin film transistor connected to said motion picture switching device in series, a gate of said discharging thin film transistor is connected to the signal electrode lines together with a gate of the motion picture switching device, a gate of said picture data inputting thin film transistor is connected to the scanning electrode line, and the motion picture is input to a drain thereof.

22. A liquid crystal display apparatus according to any one of claims 15, 16 and 17, wherein said motion picture control circuit is connected to said static picture control circuit for discharging the static picture data held by said static picture control circuit upon displaying the motion picture.

23. A liquid crystal display apparatus according to claim 22, wherein said static picture control circuit includes a capacitor disposed between input electrodes of said static picture switching device with said display electrode being a load and a pair of thin film transistors connected in series with said static picture switching device, one of said thin film transistors being connected to said signal electrode line at a gate thereof, and a gate of the other thin film transistor being connected to said scanning electrode line and a drain thereof as input for a static picture data.

24. A liquid crystal display apparatus according to claim 22, wherein said motion picture control circuit includes a discharging thin film transistor inserted between input electrodes of the static picture switching device with said display electrode being a load and a picture data inputting thin film transistor connected to said motion picture switching device in series, a gate of said discharging thin film transistor is connected to the signal electrode lines together with a gate of the motion picture switching device, a gate of said picture data inputting thin film transistor is connected to the scanning electrode line, and the motion picture is input to a drain thereof.

* * * * *